US012459722B2

(12) United States Patent
France

(10) Patent No.: US 12,459,722 B2
(45) Date of Patent: Nov. 4, 2025

(54) MICROWAVE POPCORN BAG

(71) Applicant: Conagra Foods RDM, Inc., Chicago, IL (US)

(72) Inventor: David W. France, Minneapolis, MN (US)

(73) Assignee: Conagra Foods RDM, Inc., Chicago, IL (US)

( * ) Notice: Subject to any disclaimer, the term of this patent is extended or adjusted under 35 U.S.C. 154(b) by 0 days.

(21) Appl. No.: 16/971,040

(22) PCT Filed: Feb. 19, 2019

(86) PCT No.: PCT/US2019/018512
§ 371 (c)(1),
(2) Date: Aug. 19, 2020

(87) PCT Pub. No.: WO2019/161369
PCT Pub. Date: Aug. 22, 2019

(65) Prior Publication Data

US 2021/0086976 A1 Mar. 25, 2021

Related U.S. Application Data

(60) Provisional application No. 62/632,078, filed on Feb. 19, 2018.

(51) Int. Cl.
*B65D 81/30* (2006.01)
*B65D 81/34* (2006.01)

(52) U.S. Cl.
CPC .. *B65D 81/3469* (2013.01); *B65D 2581/3421* (2013.01); *B65D 2581/3494* (2013.01)

(58) Field of Classification Search
CPC ..... B65D 81/3469; B65D 2581/3421; B65D 2581/3494
See application file for complete search history.

(56) References Cited

U.S. PATENT DOCUMENTS 4,517,787 A * 5/1985 Kreager ..... B65B 9/213 53/550
5,223,288 A 6/1993 Mendenhall et al.
(Continued)

FOREIGN PATENT DOCUMENTS

WO 2004087530 A1 10/2004

OTHER PUBLICATIONS

Shaffer, Rachel. "The Chemicals Called PFCs Are Everywhere and That's A Problem." Apr. 30, 2013. <https://www.edf.org/blog/2013/04/30/chemicals-called-pfcs-are-everywhere-and-thats-problem>. Accessed Apr. 7, 2022. (Year: 2013).*
(Continued)

*Primary Examiner* — Ericson M Lachica
(74) *Attorney, Agent, or Firm* — Ryan T. Grace; Advent, LLP

(57) ABSTRACT

A wick resistant microwavable popcorn arrangement formed substantially entirely of non-fluorocarbon material includes a folded bag defining a bag interior. The folded bag includes first and second opposite face panels joined by first and second opposite side gussets defined by gusset folds. The bag is folded to define a portion of the interior with side creases defined at junctures between the first face panel and the first and second opposite side gussets. One or more non-activated sealant fields are arranged to overlap at least one of the side creases or the gusset folds, and are configured to provide a liquid-resistant barrier. The one or more non-activated sealant fields are configured to retain the unpopped popcorn kernels, an oil component, and/or a fat component positioned within the bag interior between the first and second side gussets.

11 Claims, 55 Drawing Sheets

(56) References Cited

U.S. PATENT DOCUMENTS 5,679,278 A 10/1997 Cox
5,690,853 A * 11/1997 Jackson ..... B65D 81/3469 219/730
6,060,096 A * 5/2000 Hanson ..... B65D 75/008 426/118
6,137,098 A 10/2000 Moseley et al.
6,253,995 B1 * 7/2001 Blok ..... B65D 81/3869 229/940
6,396,036 B1 * 5/2002 Hanson ..... B65D 81/3469 219/730
2004/0103989 A1 * 6/2004 Lin ..... B32B 3/266 428/354
2005/0043158 A1 * 2/2005 Wu ..... B65D 81/2038 493/162
2005/0067411 A1 * 3/2005 Monforton ..... B65D 81/3469 219/727
2007/0024980 A1 * 2/2007 McConnel ..... G09F 23/08 359/619
2008/0268106 A1 10/2008 Jackson et al.
2011/0089168 A1 * 4/2011 Smith ..... B65D 81/3469 493/264
2012/0061385 A1 * 3/2012 France ..... B65D 75/008 219/727
2012/0193350 A1 * 8/2012 Swingley ..... H05B 6/6408 219/727
2013/0129883 A1 * 5/2013 Starkey ..... B65D 81/343 426/394
2015/0071572 A1 * 3/2015 Dreher ..... B31B 70/74 383/105
2016/0311603 A1 * 10/2016 Monforton ..... A23L 7/161
2018/0050829 A1 * 2/2018 Borgström ..... B29C 66/43123
2019/0039764 A1 * 2/2019 Mallya ..... B32B 37/1292

OTHER PUBLICATIONS

Notification of Transmittal of the International Search Report and the Written Opinion of the International Searching Authority, or the Declaration dated May 30, 2019 for App. No. PCT/US19/18512.

* cited by examiner

MICROWAVE POPCORN BAG

BACKGROUND

Microwave popcorn is a convenience food that consists of unpopped popcorn kernels in a sealed paper bag. The bag is intended to be heated in a microwave oven to pop the popcorn kernels.

SUMMARY

A microwaveable popcorn arrangement including a folded bag defining a bag interior is disclosed herein. The folded bag includes first and second opposite face panels joined by first and second opposite side gussets defined by gusset folds. The bag is folded to define a portion of the interior with side creases defined at junctures between the first face panel and the first and second opposite side gussets. One or more non-activated sealant fields are arranged to overlap at least one of the side creases or the gusset folds, and are configured to provide a liquid-resistant barrier. The one or more non-activated sealant fields are configured to retain the unpopped popcorn kernels, an oil component, and/or a fat component positioned within the bag interior between the first and second side gussets.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

DRAWINGS

The Detailed Description is described with reference to the accompanying figures. The use of the same reference numbers in different instances in the description and the figures may indicate similar or identical items.

DETAILED DESCRIPTION

Figure 1:
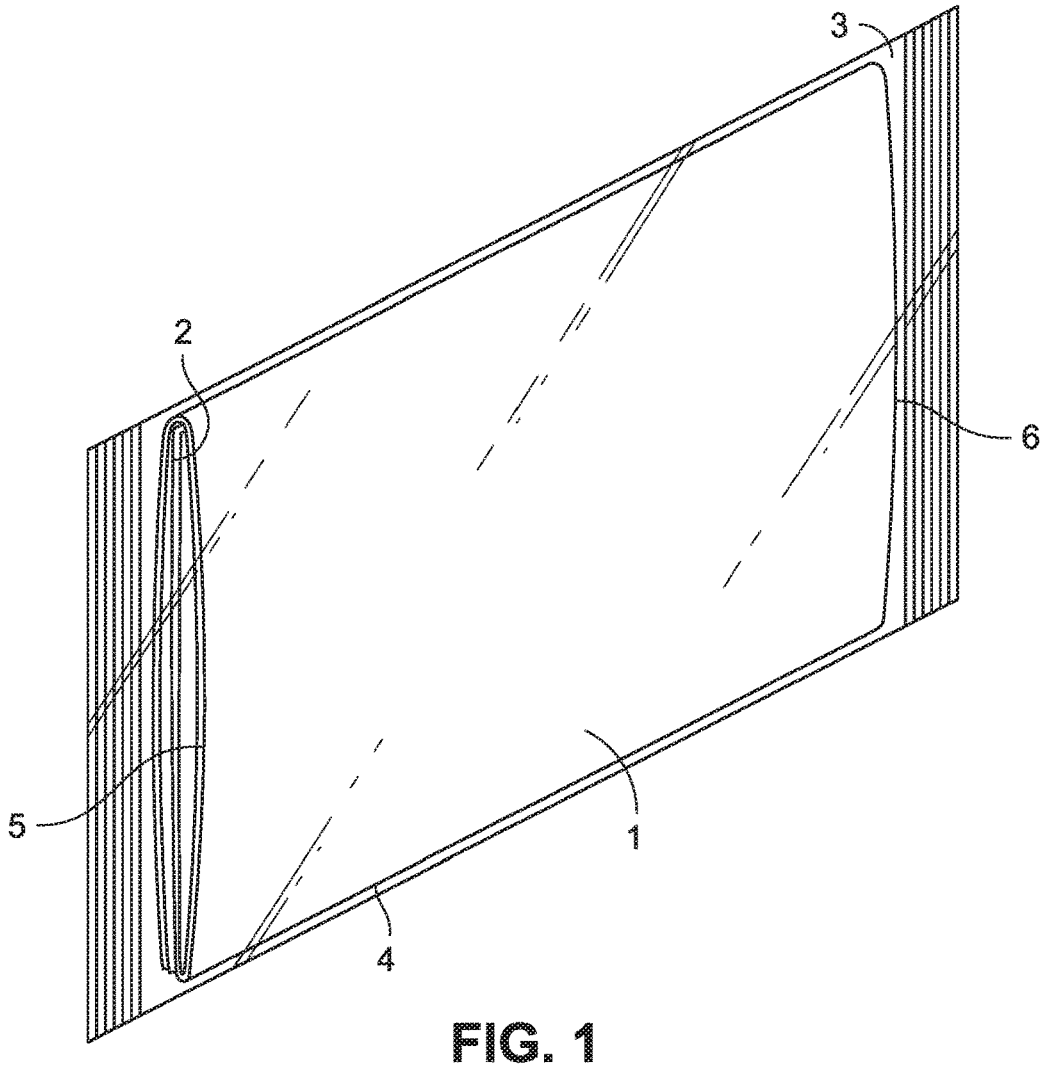
FIG. 1 is a front perspective view of a microwave popcorn bag package arrangement having a microwaveable popcorn charge therein in accordance with embodiments of the present disclosure.

There is a wide variety of microwavable food products including those which are used to pop microwave popcorn. In general, the product is a package which includes an unpopped popcorn charge. In use, the package including the unpopped popcorn charge is positioned appropriately in a microwave oven, and is exposed to microwave energy. During the microwave process, the popcorn is popped.

Microwavable popcorn packaging can include several defining characteristics. First, the bags are generally provided in a configuration wherein side gussets are used to separate the internal volume of the bag into first and second "tubes." When the bag is filled, generally the popcorn charge is placed in one of the two "tubes" and is substantially retained therein, prior to popping.

Also, in general, the popcorn charge is positioned primarily in a center portion (e.g., about a center one-third) of the package, relative to its length. In many arrangements, during storage the bag is folded into a "tri-fold" configuration.

In some instances, it has been found that positioning the popcorn charge substantially only in one of the two tubes, especially in association with a microwave interactive material or susceptor positioned in close proximity, leads to enhanced characteristics of popping.

Herein, when it is said that the popcorn charge is "substantially only" in a location, it is meant that at least 80%, at least 95 wt-%, or essentially all (e.g., at least 99% by weight) of the charge (popcorn, fat, flavor, etc.), is at the stated location.

During production, storage, distribution and handling, if the oil/fat contains any liquid or liquefied component, the oil/fat may begin to undesirably migrate within the bag and wick from the bag. Further, during the microwave popping operation, the oil/fat totally melts and flows.

Flow of liquid oil/fat within the bag can result in leakage or leaking problems. For example, the oil/fat can begin to wick through the bag, especially at locations where fractures in the paper may be present. Also, the oil/fat can migrate to seams or seals, for example, to a seam near an end of the package, and leak through the seam.

Creasing of paper generally results in micro fracture of the paper integrity at the edge of creasing. With some arrangements, if the popcorn charge is allowed to come into direct contact with a creased location, several problems can occur. First, during production, distribution and storage, depending on the content of the microwave popcorn charge, undesirable levels of leakage or wicking of oil/fat material through the paper material at the creased edges can occur. Secondly, during microwave popping, undesirable levels of leakage or wicking of oil/fat can occur along this same creased location.

Popcorn packaging can be mechanically refined to reduce leakage or wicking of fat/oil. For example, starches can be added to the paper of the packaging to decrease permeability. However, the addition of starches also increases the stiffness of the paper, which makes the paper more likely to crack.

Chemically-treated paper can also be utilized to reduce leakage and/or wicking of oil. For example, a chemical surface treatment applied to the paper (e.g., fluorochemical-treated paper). However, fluorochemical additives can migrate from the paper into foods, which may be harmful to consumers.

A microwaveable popcorn arrangement including a folded bag defining a bag interior is disclosed herein. The folded bag includes first and second opposite face panels joined by first and second opposite side gussets defined by gusset folds. The bag is folded to define a portion of the interior with side creases defined at junctures between the first face panel and the first and second opposite side gussets. One or more non-activated sealant fields are arranged to overlap at least one of the side creases or the gusset folds, and are configured to provide a liquid-resistant barrier. The one or more non-activated sealant fields are configured to retain the unpopped popcorn kernels, an oil component, and/or a fat component positioned within the bag interior between the first and second side gussets.

In some embodiments, the folded bag defines a bag interior including first and second opposite face panels joined by first and second opposite side gussets defined by gusset folds. The bag is folded to define a portion of the interior with side creases defined at junctures between the first face panel and the first and second opposite side gussets. One or more sealant fields including a first sealant material are arranged to overlap at least one of the side creases or the gusset folds. The folded bag also includes first and second gusset fold seal arrangements including a seal between an inside surface of the first face panel and an adjacent gusset panel member of the first side gusset and the second side gusset, respectively. The seal can include a second sealant material. The one or more sealant fields and the first and second gusset fold seal arrangements are configured to retain the unpopped popcorn kernels, an oil component, and/or a fat component positioned within the bag interior between the first and second side gussets.

In other embodiments, the folded bag defines a bag interior including first and second opposite face panels joined by first and second opposite side gussets defined by gusset folds. The bag is folded to define a portion of the interior with side creases defined at junctures between the first face panel and the first and second opposite side gussets. One or more coating sealant fields are arranged to overlap at least one of the side creases or the gusset folds. The one or more coating sealant fields are configured to provide a liquid barrier. The folded bag also includes first and second gusset fold seal arrangements including an adhesive seal between an inside surface of the first face panel and an adjacent gusset panel member of the first side gusset and the second side gusset, respectively. The one or more coating sealant fields and the first and second gusset fold seal arrangements are configured to retain the unpopped popcorn kernels, an oil component, and/or a fat component positioned within the bag interior between the first and second side gussets.

FIG. 1 illustrates a microwaveable popcorn bag 1 in accordance with an embodiment of the present disclosure. In FIG. 1, the popcorn bag is depicted in a conventional "tri-fold" configuration for storage. The tri-fold 2 can be sealed within a storage overwrap 3. In some embodiments, the storage overwrap 3 comprises a 90-140 gauge, biaxially oriented polypropylene, although other materials can be used. The overwrap 3 is meant to be discarded when the popcorn bag 1 is removed from storage in preparation for use.

Figure 2:
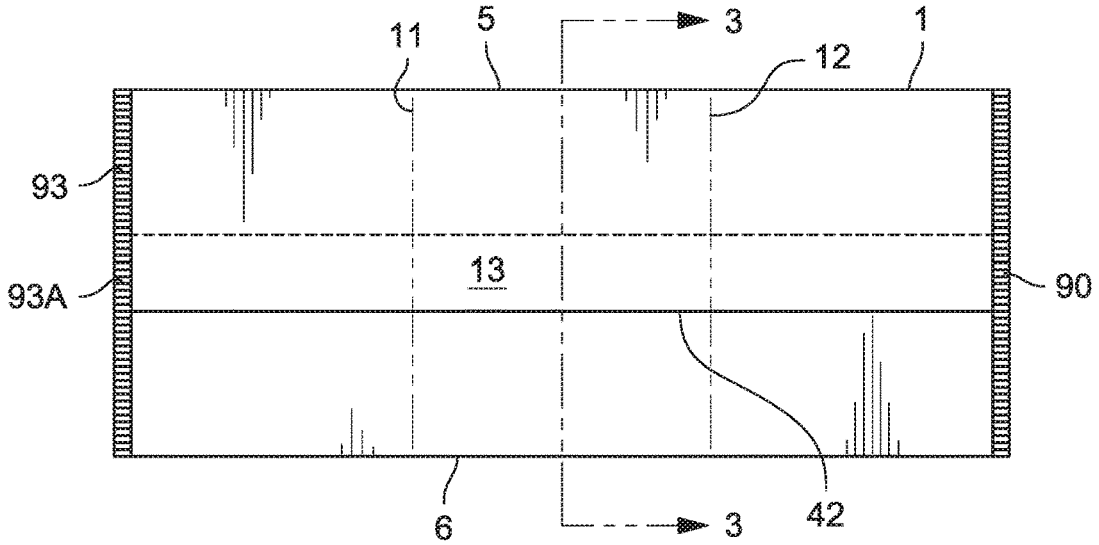
FIG. 2 is a schematic top plan view of the microwave popcorn bag of FIG. 1, depicted unwrapped and unfolded as it would be when positioned in a microwave oven for cooking.

FIG. 2 illustrates a top plan view of bag 1 schematically shown in an unfolded configuration oriented much as it would be when positioned in a microwave oven for popping of an internally received popcorn charge, but before expansion. Lines 11 and 12 indicate fold lines which define a central region 13 and which formed the folds to make the tri-fold 2 of FIG. 1. In central region 13, the unpopped popcorn charge will generally be positioned in an orientation against, and when oriented as shown in FIG. 2, a portion of the bag 1 in which a microwave interactive construction can be positioned. Herein, in this context, the term "microwave interactive" is meant to refer to a material which absorbs energy and becomes hot, upon exposure to microwave energy in a microwave oven.

During the popping operation, moisture inside the popcorn kernels absorbs microwave energy, generating sufficient steam and heat for popping of the kernels and expansion of bag 1. In addition, the microwave interactive material absorbs microwave energy and dissipates heat to the popcorn charge. In some constructions, the microwave interactive material occupies at least central region 13 (internally) and is greater thermoconductive contact with a portion of that region than any other portions an interior of popcorn bag 1. That is, most of the microwave interactive material (by area or weight) is positioned in thermoconductive contact with a region of the bag interior whereat the microwave interactive will be covered by the popping charge, when the bag 1 is positioned in a microwave oven for use. This can lead to an efficient utilization of microwave interactive material and also due to transfer or heat retention characteristics in connection with the popcorn popping process.

In some embodiments, the arrangements described herein generally include an oil/fat material contained within the bag as part of the microwave popcorn charge. In some embodiments, the oil/fat material described can include a "low trans fat" or "low trans" oil/fat materials. "No trans fat", "no trans", "zero trans" oil/fat materials are also described.

In embodiments, the first oil/fat component can include at least 80 wt-% of the oil/fat material and is present in a level of at least 8 wt-% of the unpopped popcorn kernels. In a specific embodiment, the first oil/fat component includes at least 99 wt-% of the oil/fat material and is present at a level of at least 20 wt-% of the unpopped popcorn kernels.

In embodiments, the oil component used can include any glyceride with at least one fatty acid, and/or one or more liquid oils such as a liquid vegetable oil. In one aspect, the oil component can include a liquid vegetable such as soybean oil, canola oil, sunflower oil, corn oil, grapeseed oil, cottonseed oil, mid-oleic sunflower oil, safflower oil, palm oil, coconut oil, partially hydrogenated oils of these oils, mixtures thereof, and so forth. In other aspects, the oil/fat component can include an intersterified blend of an oil component and a stearine component. The oil component used in the intersterified blend can include any of the oil components described above. The stearine component used in the interesterified blend can include, but is not necessarily limited to: cottonseed stearine, soybean stearine, mixtures thereof, and so forth.

In some instances, the first oil/fat component includes a mixture of the interesterified blend and a second stearine component. When this is done, the mixture can contain at least 2 wt-% of the second stearine component. The second stearine component can include, but is not necessarily limited to: cottonseed stearine, soybean stearine, corn stearine, palm stearine, mixtures thereof, and so forth. The second stearine component can be selected independently of the first stearine component.

In aspects where a "zero trans" or "no trans" oil is desired, palm oil may be suitable as a "zero trans" or "no trans" oil, with the embodiments described herein. Other low trans oils, such as those having a Mettler drop point of no greater than 130° F. can also be used.

Figure 3:
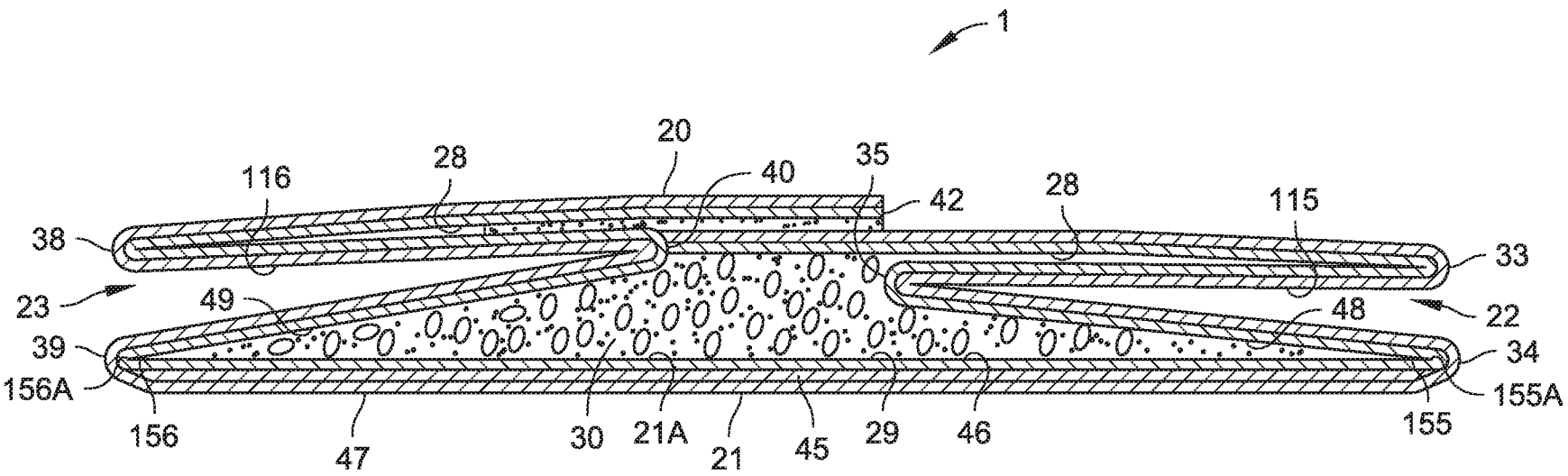
FIG. 3 is an enlarged cross-sectional view of the microwave popcorn bag of FIG. 2, taken generally along line 3-3 of FIG. 2.

FIG. 3 illustrates a cross-section taken generally along line 3-3 of FIG. 2. The bag 1 generally comprises a construction defining first and second opposite face panels 21, 20 joined by first and second side gussets 22, 23. In exemplary embodiments, the opposite face panels can be joined by first and second, opposite, inwardly directed side gusts (e.g., the side gussets 22, 23 point or extend toward one another). In the construction of FIG. 3, the bag 1 has only one inwardly directed gusset at each side.

The gussets 22, 23 generally separate popcorn bag 1 into first and second expandable tubes 28, 29. A popcorn charge is substantially positioned and substantially retained within one of the tubes, in this instance, tube 29. The other tube, tube 28, prior to popping, is generally collapsed. In some embodiments, tube 28 is sealed closed by temporary heat seals prior to the popping operation.

The side gusset 22 can be defined by one or more gusset folds. For example, side gusset 22 can include outwardly directed edge creases (e.g., side creases) or folds 33 and 34, with fold 34 being adjacent face panel 21 and fold 33 being adjacent face panel 20; and inwardly directed central fold 35. Similarly, gusset 23 comprises outwardly directed edge creases (e.g., side creases) or folds 38 and 39, with fold 39 being adjacent 21 and fold 38 being adjacent 20; and central fold 40. When the bag 1 is folded, a portion of the interior is defined with side creases defined at junctures between the first face panel 21 (e.g., defined by folds 34 and 39), and the first and second opposite, inwardly directed side gussets 22, 23. Side creases can also be defined at junctures between the second face panel 20 (e.g., defined by folds 33 and 38), and the first and second opposite, inwardly directed side gussets 22, 23. In some embodiments, the arrangement shown in FIG. 3 is folded from a two-ply sheet of material, and panel 20 includes central longitudinal seam 42 therein.

Underneath popcorn charge 30, bag 1 can include microwave interactive construction (e.g., susceptor 45). The susceptor 45 can include a flexible, metallized polyester sheet. The susceptor 45 is provided in thermoconductive contact with a popcorn charge retention surface, for example, a portion of the inside of the bag against which the microwave popcorn charge is placed. In some embodiments, such as the one shown in FIG. 3, the susceptor 45 is positioned between layers or plies 46, 47 from which the flexible bag 1 is folded. Even with the susceptor 45 positioned between plies 46, 47, the bag 1 is referenced as two-ply. In the arrangement shown, the susceptor 45 only occupies a portion of the area between the plies 46, 47.

In some embodiments, a laminating adhesive may be used between the two plies 46, 47. For example, a laminating adhesive may be used between the two plies 46, 47 that is continuous and covers the entire area between the plies. In other embodiments, a discontinuous coating may be used. In some embodiments, a continuous adhesive may be used at certain locations, and discontinuous adhesive at others. For example, a continuous adhesive can be used at locations at certain locations to provide a greaseproof effect. In an example embodiment, regions for continuous coverage for the lamination adhesive include the regions bounded by: fold lines 68, 69 which form inwardly directed gusset folds 40, 35 respectively, FIG. 3. In specific embodiments, a continuous adhesive can be used as a laminating adhesive in areas of the bag 1 most likely to come into contact with oil/fat during storage, handling or use. For example, a continuous adhesive can be used as a laminating adhesive at locations: (a) within panel 21 on which a popcorn charge will sit in a microwave oven during use; (b) within gusset panels 48, 49 integral with and adjacent panel 21; and/or, (c) within central portions of gusset panels 115, 116 and panel 20. Use of an adhesive pattern, for the laminating adhesive, where possible, to save cost and weight.

In some embodiments, the sheet of material from which the bag 1 is formed from a material containing substantially no fluorocarbon (e.g., a non-fluorocarbon treated paper). The sheet of material can include fluorocarbon in a weight percentage of total content from about 0% to about 5%. For example, the weight percentage of the fluorocarbon in the paper can be from about 0.0%, 0.01%, 0.02%, 0.03%, 0.04%, 0.05%, 0.06%, 0.07%, 0.08%, 0.09%, 0.1%, 0.2%, 0.3%, 0.4%, 0.5%, 0.6%, 0.7%, 0.8%, 0.9%, 1.0%, 1.1%, 1.2%, 1.3%, 1.4%, 1.5%, 1.6%, 1.7%, 1.8%, 1.9%, 2.0%, 2.1%, 2.2%, 2.3%, 2.4%, 2.5%, 2.6%, 2.7%, 2.8%, 2.9%, 3.0%, 3.1%, 3.2%, 3.3%, 3.4%, 3.5%, 3.6%, 3.7%, 3.8%, 3.9%, 4.0%, 4.1%, 4.2%, 4.3%, 4.4%, 4.5%, 4.6%, 4.7%, 4.8%, 4.9%, and 5.0% to about 0.0%, 0.01%, 0.02%, 0.03%, 0.04%, 0.05%, 0.06%, 0.07%, 0.08%, 0.09%, 0.1%, 0.2%, 0.3%, 0.4%, 0.5%, 0.6%, 0.7%, 0.8%, 0.9%, 1.0%, 1.1%, 1.2%, 1.3%, 1.4%, 1.5%, 1.6%, 1.7%, 1.8%, 1.9%, 2.0%, 2.1%, 2.2%, 2.3%, 2.4%, 2.5%, 2.6%, 2.7%, 2.8%, 2.9%, 3.0%, 3.1%, 3.2%, 3.3%, 3.4%, 3.5%, 3.6%, 3.7%, 3.8%, 3.9%, 4.0%, 4.1%, 4.2%, 4.3%, 4.4%, 4.5%, 4.6%, 4.7%, 4.8%, 4.9%, and 5.0%. Although alternatives are possible, the arrangements described herein can be formed from a bag arrangement made of two plies of non-fluorocarbon treated paper. For example, the two plies 46, 47 can be formed from two plies of non-fluorocarbon treated paper. In specific embodiments, the inside ply is made from a paper having a porosity (Gurley-sec) of greater than 800,000, greater than 900,000, greater than 950,000, greater than 1,000,000 or higher (higher Gurley-sec figures indicate lower porosity). In these embodiments, the ply can have a basis weight of 20-30 lbs/ream (3,000 sq. ft.) and, in some embodiments, a basis weight of not greater than 25 lbs/ream. The sheet used for the outer ply can have a basis weight within the same range as stated above. In specific embodiments, it would be a paper material having a porosity (Gurley-sec) of greater than 15,000, greater than 20,000, greater than 25,000, or greater than 30,000 or higher. In another aspect, the outer ply can have a porosity (Gurley-sec) in the same range as stated above for the inside ply (e.g., two plies of the same material). An example non-fluorocarbon treated paper suitable for either ply 46 or ply 47 is Expera FluoroFree® paper available from Expera Specialty Solutions of Kaukauna, WI It is to be understood that while a bag arrangement made of two plies is shown, the bag can also be constructed from a single ply of non-fluorocarbon treated paper.

Still referring to FIG. 3, the gusset 23 includes a panel section 49 adjacent to, and integral with, face panel 21. Additionally, the gusset 22 includes panel section 48 adjacent to, and integral with, face panel 21. Panel 21 includes region 21*a* which defines an unpopped popcorn charge retention surface. This is because the unpopped popcorn charge 30 is generally positioned in contact with, and generally sitting on, region 21*a* when the bag 1 is positioned in a microwave oven.

Referring still to FIG. 3, when used as insulating seals, sealant fields that form seals 155, 156 can be at least 0.25 cm wide. In some embodiments, sealant fields that form seals 155, 156 can be at least 0.5 cm wide. In an embodiment, sealant fields that form seals 155, 156 are 0.8-1.4 cm wide. In this context the "width" is the distance of extension inwardly, i.e., toward each other, from edges 155*a*, 156*a*, respectively. The seals 155, 156, do not need to be of constant width, although they are shown this way.

Figure 4:
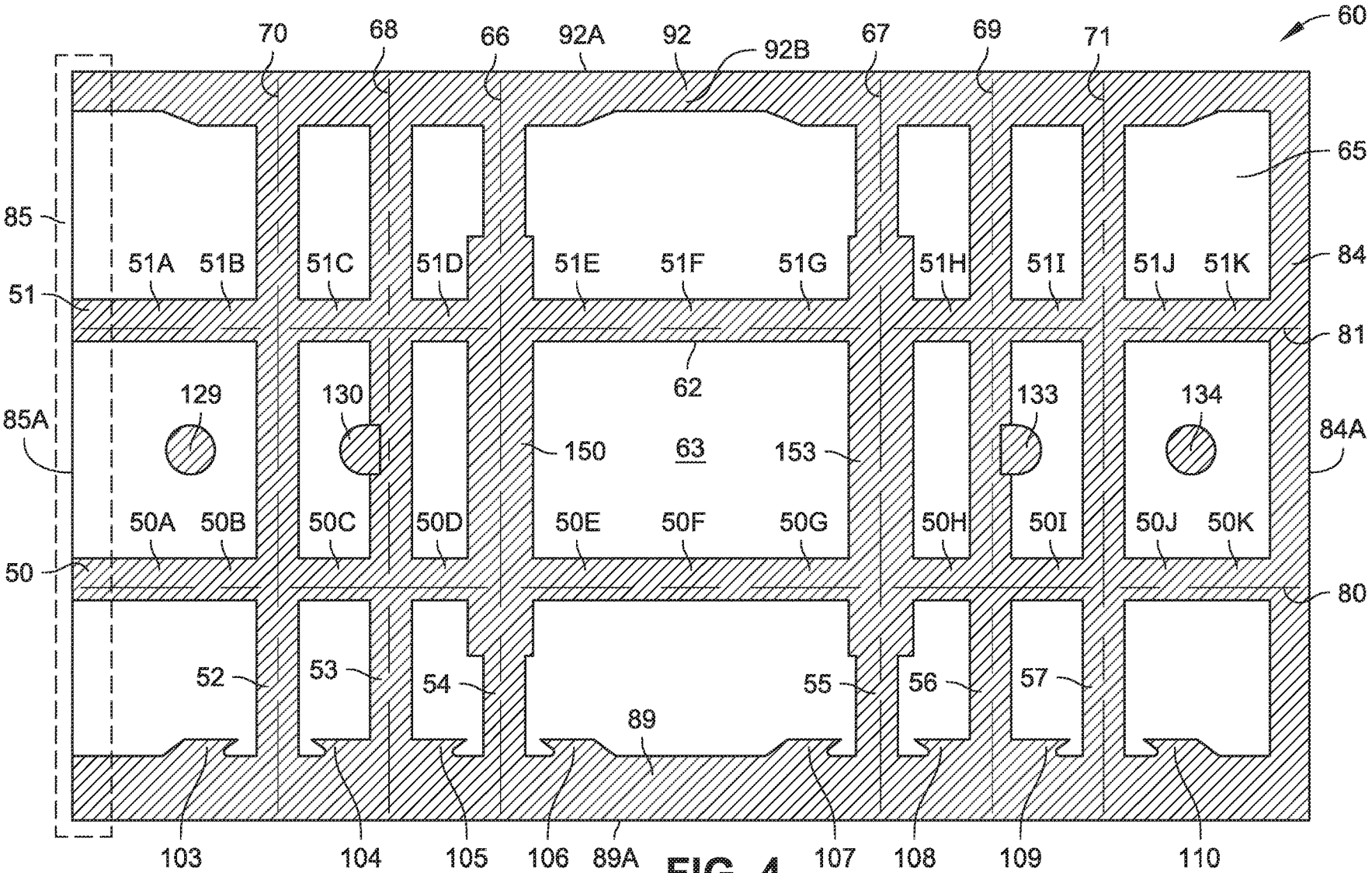
FIG. 4 is an enlarged top plan view of a sheet of flexible material from which a microwave popcorn bag, such as that shown in FIGS. 1 and 2, can be folded in accordance with embodiments of the present disclosure.

FIG. 4 illustrates a top plan view of an example bag blank, panel, or sheet 60 from which an arrangement according to FIG. 1, 2, or 3 can be folded. The view in FIG. 4 is of a side 65 of sheet 60 which forms the interior surface of the assembled bag 1, FIG. 1. The side opposite the side viewable in FIG. 4 will form the exterior surface of the bag. In other embodiments, a mirror image to the view of FIG. 4 could also be used as the interior surface.

In some embodiments, line segment 62 defines a region 63 within which most of the microwave interactive material, such as susceptor 45, would be associated. In addition, the popcorn charge 30 will eventually be positioned over (or against) region 63. The microwave interactive construction, for example susceptor 45, FIG. 4, may be positioned on an interior of the arrangement, an exterior, or between plies 46, 47. In some embodiments, susceptor 45 is positioned between plies 46, 47 of the blank 60.

Still referring to FIG. 4, line 66 generally indicates where fold 34 (FIG. 3) will be formed, and line 67 generally indicates where fold 39 (FIG. 3) will be formed. Folds 34, 39 are generally outwardly directed folds or creases in opposite side gussets 22, 23 adjacent face 21. Region 21A, for positioning of a popcorn charge thereon, in use, extends between folds 34, 39. Line 68 corresponds with fold 35 (FIG. 3); line 69 with fold 40 (FIG. 3); line 70 with fold 33 (FIG. 3); and, line 71 with fold 38 (FIG. 3). Thus, the region between fold lines 68 and 66 will generally define gusset panel section 48 (FIG. 3), and the region between fold lines 67 and 69 will generally define gusset panel section 49 (FIG. 3).

In general, the tri-fold 2 is eventually formed by folding the overall bag 1 such that it folds along lies 80 and 81. It is to be understood that this latter folding can be after the bag construction (e.g., as described with reference to FIG. 2) has been otherwise assembled. Line 81 will form edge 4, FIG. 1. Referring to FIGS. 2 and 4, line 80 will form fold 11 and line 81 will form fold 12.

Referring again to FIG. 4, sealant field 84, along edge 84A positioned on opposite side of panel 60 from side 65, is used to engage region 85 along edge 85A, during folding, to form the longitudinal seam or seal 42, FIG. 3. It will also be apparent that, during folding, various portions of field 89 along edge 89A on side 65 will align with one another to form various portions of end seal 90, FIG. 2; and, various portions of field 92, along edge 92A on side 65, FIG. 4, will align with one another to form end seal 93, FIG. 2. In general, field 92 will form a top edge of the completed bag, through which popped popcorn is removed, after popping. In some embodiments, a thinner or weaker portion of adhesive may used in region 93A in seam 92 to provide opening release and vent during operation.

In some embodiments, the panel 60 includes one or more additional sealant fields (e.g., gusset sealant fields 103, 104, 105, 106, 107, 108, 109, 110). During folding, portions of gusset sealant fields 103-110 align with one another to retain selected portions of the panel adhered to one another (e.g., after application of pressure and/or heat) to provide a desired configuration of the bag 1 during expansion. For example, sealant field 102 engages field 104; sealant field 105 engages field 106; sealant field 108 engages field 107; and sealant field 110 engages field 109, during folding. Engagement between sealant fields 105 and 106, and also between fields 108 and 107 tends to retain selected portions of panels 48 and 49 against panel 21, FIG. 3, in regions where the popcorn charge is not located in the collapsed fold or tri-fold 2, FIG. 1. Sealant field 102 folded and sealed against field 104, and sealant field 110 folded against field 109, help retain panels 115 and 116 against panel 20, FIG. 3, in the collapsed fold or tri-fold 2. This sealant arrangement can help ensure that the popcorn charge 30 is retained where desired in the arrangement. Additionally, the shape and direction of sealant fields 105, 106, 107, and 108 can help ensure that central section 63 will remain relatively flat as the bag 1 expands in use under the steam from popping.

Attention is now directed to sealant fields 129, 130, 133, and 134. In some embodiments, these are also used to ensure that panels 115 and 116 are sealed against panel 20, FIG. 3, so that the popcorn charge 30 is substantially retained in tube 29, FIG. 3, and does not expand or spread substantially into tube 28 until desired during heating. In particular, fields 129 and 130 are oriented to engage one another when the arrangement is folded about fold line 70; and, fields 133 and 134 are oriented to engage one another when the arrangement is folded about fold line 71.

The sealing of various sealant fields described herein can be done with the application of heat and/or pressure. In some embodiments, sealing results from application of pressure, after folding, to the region where the sealant is located. It is noted that for the various seals discussed, sealant is positioned on both adjoining paper surfaces. However if sealant is only positioned on one side, and the two sides are folded together with follow-up application of appropriate pressure, a seal can be formed. It is noted that cold sealing approaches may also be used.

This disclosure also provides optional provisions of arrangements that inhibit the popcorn charge, prior to popping, from undesirable levels of direct contact with certain locations in the bag 1. An example of this are arrangements that inhibit undesirable levels of oil/fat contact with creases at fold lines 66, 67, FIG. 4; i.e., folds 34, 39, FIG. 3. It is noted that certain other figures, discussed below, include alternate applications of related principles and also to additional features that help provide desired oil/fat location of flow within the bag 1, during storage, handling and use.

Attention is first directed to the features of FIG. 4, relating to control of oil/fat flow location. For fold line 66, attention is directed to sealant field 150, and, for fold line 67, attention is directed to sealant field 153. It is noted that for the arrangement shown, field 150 is disposed over fold line 66, and that similarly field 153 is disposed over fold line 67. In other embodiments, additional sealant fields can be disposed over fold lines 66 and 67. When the fold around fold line 66 is made, sealant field opposing sides of sealant field 150 will overlap with seal 155, FIG. 3, resulting. For example, a first portion of sealant field 150 will overlap a second portion of sealant field 150 to form seal 155. Similarly, when folding around fold line 67 occurs, opposing sides of sealant field 153 will overlap with seal 156, FIG. 3, resulting. For example, a first portion of sealant field 153 will overlap a second portion of sealant field 153 to form seal 156.

In specific embodiments, when folding around fold line 66 is made to generate seal 155, at least a portion of seal 155: (a) 30 is located at least 2 inches (50.8 mm) from edge 92*a*; (b) is spaced from sealant field 92 a distance of at least 1 inch (25.4 mm); (c) does not comprise part of a diagonal seal or chevron shape; (d) is positioned at least 2 inches (50.8 rom) from edge 89*a*; and (e) is positioned at least 1 inch (25.4 mm) from end sealant field 89. When it is said that at least a portion of the seal 155 is spaced as characterized, it is not meant that the entire field is necessarily so spaced, unless specifically stated. Rather, it is meant that at least a portion of the seal is positioned where indicated, whereas other portions may be differently spaced. Seal 156 can be analogous to seal 155, and can have analogous features.

When the popcorn charge is positioned in region 63, the popcorn charge including components such as oil/fat therein, are inhibited from flow to, i.e., from reaching, creases or fold lines 66, 67 (i.e., creases at 34, 39, FIG. 3) due to the presence of the seals 155, 156. In part, seals 155, 156, FIG. 3, operate to inhibit oil/fat flow in contact with folds around line 66, 67 respectively (FIG. 4) by tacking gusset folds 34, 39, FIG. 3, closed adjacent the fold lines 66, 67 (FIG. 4). In some embodiments, the seals 155, 156 can be configured to release upon exposure to steam and heat during a microwave popcorn popping operation. In some embodiments, at least a portion of seals 155, 156 is positioned in overlap with region 63, i.e., an overlap in the central portion of region 21*a* with susceptor 45, FIG. 4, underneath.

Seals such as seals 155, 156 will generally be characterized as "opposite gusset seals positioned to extend along opposite sides of central region 63 in overlap with susceptor 45, in the opposite gusset folds 34, 39 integral with panel 21" or by similar terminology. Seals of the type shown at seals 155, 156, are also sometimes referred to herein as "insulating seals" with respect to an associated (typically adjacent) crease or fold. This is because these seals insulate the associated crease or fold, during storage of bag 1, with respect to flow of material from within the popcorn charge, to direct contact with the associated crease or fold. Thus, seal 155 is an insulating sealant field with respect to fold or crease along line 66 to form crease or fold 34 (FIG. 3), and field 156 is an insulating sealant field with respect to fold or crease line 67; i.e., fold or crease 39 (FIG. 3).

Referring to FIG. 4, it is noted that for formation of insulating seals 155, 156, fields 150 and 153 can be continuous, i.e. without gaps therein, in extension along the fold lines 66, 67 respectively, defining opposite edges of central region 63. This continuous nature to the sealant fields and in the resulting seals 155, 156 (FIG. 4), sometimes called "full seals" since they are continuous, helps inhibit undesirable wicking or leaking at the creases caused in fold lines 66, 67. It is noted that some beneficial results can be obtained even if the insulating fields were not continuous. Herein below, in connection with FIG. 18, for example, an arrangement with spaced seals that provide for advantage without full insulation is provided.

When used to form gusset fold insulating seals of the type shown in FIG. 4, a total length to the fields 150 and 153 can be at least 20% of the entire length of the package (or length of the fold lines 66, 67) between ends 90, 93 (FIG. 2). In other embodiments, the length of the fields 150 and 153 can be at least 25% or at least 30% of the length of the package. In an embodiment, they are each at least 45% of the length of the bag 1, FIG. 2, or fold lines 66, 67, FIG. 4; and the length of the fields 150 and 153, in the longitudinal direction of extension of the package, is 50%-70% of the total length of bag 1, or fold lines 66, 67 (FIG. 4), between ends 90, 93. In FIG. 4, the portions of blank 60 that form ends 90, 93, FIG. 2, are edges 89*a* and 92*a*, respectively.

In a specific embodiment, each of the first and second gusset fold insulating seals (e.g., seals 155 and 156) can be at least about 4 inches (10.2 cm) long, at least about 5 inches (12.7 cm) long, and at least about 6.5 inches (16.51 cm) long. The width of the seals can vary and can be selected, in part, based upon the width of the jaws that are used or applied to provide for the heat and pressure, to cause the seals. Herein, in general, the width of the seal can also be distinguished from the width of the sealant field from which it is formed. In a specific embodiment, seals 155, 156 can be at least about 0.1 inches (0.25 cm) wide, or at least about 0.2 inches wide.

In some embodiments, such as the embodiment illustrated in FIG. 4, seals 155 and 156 are configured as a first gusset fold seal 155 and a second gusset fold seal 156, and are positioned to abut gusset folds 34, 39 of the first and second side gussets 22, 23. However, this arrangement is offered by way of example only and is not meant to be restrictive of the present disclosure. In other embodiments, the seals 155, 156 could be spaced in part or in total from the fold. In a specific embodiment, the closest border of the gusset fold insulating seal 155, 156 to the gusset folds 34, 39 is not spaced from the associated gusset fold by more than about 0.5 inch.

In some embodiments, the seals 155, 156 are at least positioned and configured to extend continuously between the folds 80, 81 of the tri-fold (corresponding to folds 11, 12 respectively, FIG. 2). It can be seen from FIG. 4, that the sealant fields that form seals 155, 156 can extend even further than this.

In some embodiments, the fields 150, 153, FIG. 4, terminate with ends spaced from associated edges 92A, 89A of the package blank 60, which will correspond to ends 93, 90 of the folded bag 1, FIG. 2. In an embodiment, the spacing is at least 7 cm or 70 mm (e.g., about 8-9.5 cm or 80-95 mm) from edge 89*a*; and, at least 7 cm or 70 mm from edge 92*a*. The spacing will not necessarily be the same from each edge 89A, 92A. For example, in the embodiment shown, it is not (It is noted that with respect to this observation, fields 120-123 and 92 are not to be considered as part of the gusset fold insulating seals, although alternate definitions are possible.)

Referring to FIG. 4, attention is now directed to sealant fields 50 and 51 overlapping fold lines 80 and 81, respectively. In embodiments, sealant fields 50 and 51 can be continuous, i.e. without gaps therein, in extension along the fold lines 80, 81 respectively, or discontinuous. In one or more embodiments, various portions of sealant field 50 (50A through 50K) overlap along fold line 80, and various portions of sealant field 51 (51A through 51K) overlap along fold line 81, when the bag 1 is folded in the tri-fold 2 (e.g., as described with reference to FIG. 1). During folding around line 66, sealant field 50D will overlap field 50E. During folding around line 67, sealant field 50H will overlap field 50G. Sealant fields 50A, 50K will overlap sealant field 50F when folding around fold lines 68, 70 and fold lines 69, 71. Similarly, during folding around line 66, sealant field 51D will overlap field 51E. During folding around line 67, sealant field 51H will overlap field 51G. Sealant fields 51A, 51K will overlap sealant field 51F when folding around fold lines 68, 70 and fold lines 69, 71.

In some embodiments, the sealant fields 50 and 51 form a barrier coating. The barrier coating can help inhibit undesirable wicking or leaking at the creases caused in the fold lines 80, 81. Where sealant fields 50 and 51 form a barrier coating, a transverse containment seal is generally not needed to obtain appropriate control over oil/fat location. Avoiding the use of transverse containment seals can result in cost savings.

In some embodiments, one or more seals may be formed between the various overlapping portions of sealant fields 50 and 51. In an example embodiment, a seal may be formed between sealant field 50D can seal to sealant field 50E, sealant field 50H can seal to sealant field 50G, and sealant fields 51A, 51K can seal to sealant field 51F, forming a transverse containment seal. The net result, in this embodiment will be formation of a region in a folded bag 1 of a transverse containment seal extending between gusset fold insulating seals 155, 156, FIG. 3. This sealant field will help contain oil/fat within the popcorn 30, at a location between seals 155, 156, FIG. 3, and also at a location over center 63, and away from seal 90, FIG. 2, during production, distribution, storage and initial use. The transverse containment seals can be continuous in extension between insulating seals 155, 156, although alternatives are possible. It is to be understood that the transverse containment seals are optional.

It is noted, that as a result of seals 155, 156 (and the presence of optional transverse sealant fields resulting from overlap of 50A and 50D, with 50F and 50E, respectively; and overlap of 51A and 51, with 51F and 51E, respectively)

and a four-sided insulated seal pouch against panel 60 around a center 63 (FIG. 4) of surface portion 21*a* (FIG. 3) is formed, in which a popcorn charge is stored, during use. It is also noted that this embodiment includes a first transverse product seal formed by sealant field formed at 50E-50H, and a second transverse product seal formed by sealant fields 51E through 51H. In the absence of the transverse seal formed at sealant field 51E through 51H, a three-sided insulated seal pouch is formed. In the absence of one or both of the optional transverse containment seals, adequate oil/fat control can still be obtained where the sealant fields 50 and 51 form a barrier coating, as described above.

In some embodiments, the panel 60 includes one or more additional sealant fields (e.g., as described with reference to FIG. 4). For example the panel 60 can include sealant fields 52, 53, 54, 55, 56, and 57, which overlap fold lines 70, 68, 66, 67, 69, and 71, respectively. In example embodiments, one or more of the sealant fields 52, 53, 54, 55, 56, 57 can correspond to the fold lines and/or edge lines, and can prevent wicking or leaking at the creases caused in the fold lines. Sealant fields 52, 53, 54, 55, 56, 57 can be continuous, not continuous, or a combination thereof. In some embodiments, sealant fields 52, 53, 54, 55, 56, 57 are continuous to further prevent undesirable wicking or leaking at the creases caused in fold lines. For example, sealant fields 52, 53, 54, 55, 56, 57 can extend longitudinally and continuously across panel 60 from sealant field 89 to sealant field 92.

One or more of the seals formed by sealant fields 50, 51, 52, 53, 54, 55, 56, 57, 129, 130, 133, and 134 can be releasable seals, so that heat, steam and package expansion, during a popping operation, will open these seals to allow expansion of the bag. Other seals are non-releasable during expansion of the popcorn bag 1.

Referring still to FIG. 4, one or more of sealant fields 50 through 57, 129, 130, 133, 134, 153, 154, 84, 89, 92, and 103 through 110 can function as coating sealant fields. For example, the coating sealant fields can be formed from a coating sealant material (e.g., polymer sealant material) that is configured to provide a liquid barrier along the side creases (formed by sealant fields 54 and 55) and/or gusset folds (formed by sealant fields 52, 53, 56, 57). Example coating sealant materials that can be used for coating sealant fields include, but are not necessarily limited to: vinyl acetate polymers (e.g., ROVACE™ vinyl emulsions, POLYCO™ vinyl emulsions, each available from DowDuPont, Midland, MI, etc.), styrene-acrylic polymers (e.g., RHOPLEX™ styrene-acrylic emulsions available from DowDuPont, Midland, MI), vinyl acetate-acrylic copolymers (e.g., ROVACE™ vinyl-acrylic emulsions, POLYCO™ vinyl-acrylic emulsions, each available from DowDuPont, Midland, MI, etc.), acrylic polymers (e.g, PRIMAL™ emulsions, RHOPLEX™ emulsions, each available from DowDuPont, Midland, MI, etc.), polyolefin polymers (e.g., HYPOD™ dispersions available from DowDuPont, Midland, MI), and so forth. In embodiments, a coating sealant material can be selected based on its sealing properties. For example, a coating sealant material can be selected that has strong heat sealant properties. A coating sealant material can also be selected based on block resistance properties. In specific embodiments, a coating sealant material can be selected that has both barrier properties (e.g., e.g., liquid barrier, oil/grease resistant barrier, etc.) and strong heat sealant properties. A coating sealant material may also be selected based on flexibility. For example, a coating sealant material can be selected that retains sufficient flexibility when printed on bag sheet 60 to allow for folding of the bag 1 without cracking or tearing.

The coating thickness (e.g., coat weight) of the coating sealant fields can affect the barrier performance of the sealant material and the strength of the seal formed. In example embodiments, the coating sealant material can be applied to the panel 60 with a coat weight in the range of about 2 g/m2 to about 20 g/m2. The coating sealant material may be applied with higher coat weights at some sealant fields and lower coat weights at other sealant fields. In example embodiments, lower coat weights can be used at certain locations on the panel 60 to facilitate expansion of the bag 1 during popping. For example, a lower coat weight can be applied to the tack sealant fields 129, 130, 133, 134; and a higher coat weight can be applied to sealant fields 84, 89, 92.

Figure 5:
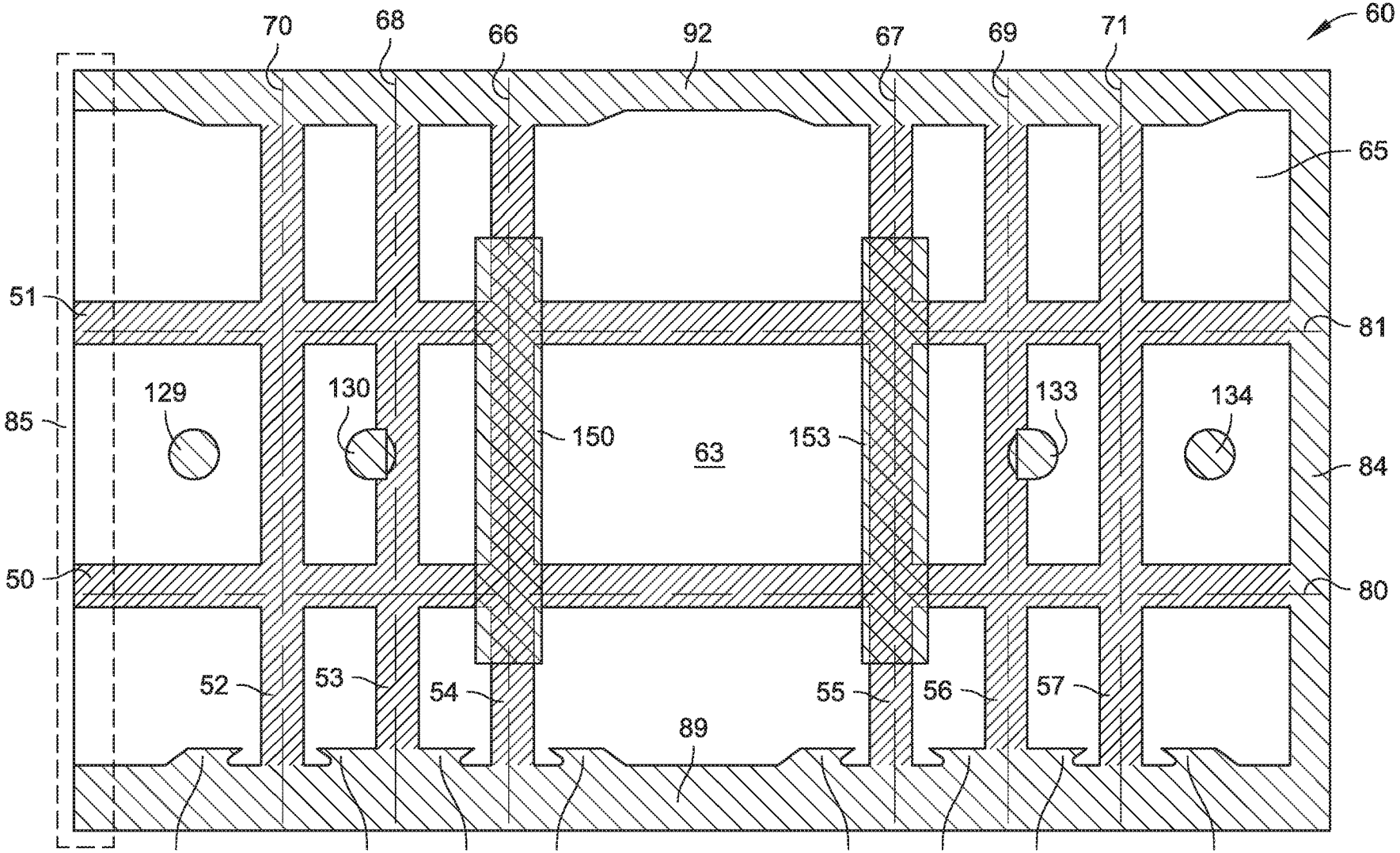
FIG. 5 is another enlarged top plan view of a sheet of flexible material from which a microwave popcorn bag, such as that shown in FIGS. 1 and 2, can be folded in accordance with example embodiments of the present disclosure.

Referring now to FIG. 5, one or more of sealant fields 50 through 57, 129, 130, 133, 134, 153, 154, 84, 89, 92, and 103 through 110 can function as adhesive sealant fields. For example, the adhesive sealant fields can be formed from an adhesive sealant material that is configured to form an adhesive seal (e.g., when aligned adhesive sealant fields are joined, as described herein). Example adhesive sealant materials that can be used for adhesive sealant fields include, but are not necessarily limited to: polyvinyl acetate adhesives (e.g., Duracet 12, available from Franklin International, Inc. of Columbus, OH; H.B. Fuller PWF 3007, available from H.B. Fuller, St. Paul, MN; etc.), ethylene vinyl acetate-polyvinyl alcohol adhesive (e.g., PWF 8540, also available from H.B. Fuller), and so forth. In some embodiments, both coating sealant materials and adhesive sealant materials can be utilized. A first sealant material (e.g. a coating sealant material) can be utilized for selected sealant fields, while a second sealant material (e.g., an adhesive sealant material) can be utilized for other sealant fields. For example, sealant fields 50, 51, 52, 53, 54, 55, 56, 57, 84, 89, and 92 can comprise coating sealant fields; and 130, 133, 134, 150, and 153 can comprise adhesive sealant fields. The used of an adhesive sealant at certain locations can provide strength to help maintain the structure of the bag 1. The use of adhesive sealant at certain locations can also help retain the kernels and/or the fat/oil component generally in the center area 63 near the susceptor 45 (FIG. 3). In some embodiments, the sealant can be applied to the panel 60 in layers. For example, a first layer of a first sealant (e.g. coating sealant material) can be applied to the panel 60, followed by a second layer of a second sealant (e.g., adhesive sealant material). In some embodiments, one or more sealant fields including an adhesive sealant material can be configured to overlap one or more sealant fields including a coating sealant material. For example, adhesive sealant fields 150, 153 can overlap coating sealant fields 54 and 55. Overlapping the coating sealant material with the adhesive sealant material can increase the structural integrity of the seals, increase the integrity of the seal barrier, and/or help retain the unpopped kernels near the susceptor 45 (FIG. 3).

In embodiments where a coating sealant material is utilized, one or more aligned sealant fields can be joined to form seals (e.g., seals that join one or more portions of the bag to form seams, tack seals, and so forth) by the application of heat and/or pressure. It is contemplated that some sealant fields are configured to mate and seal, while other sealant fields form a barrier coating (e.g., the physical properties of the selected polymer forms a barrier). For example, one or more sealant fields can be activated to form seals by selectively applying heat and/or pressure to the desired region, while heat/pressure is not applied where formation of a seal is not desired (e.g., the sealant fields remain non-activated). Where heat/pressure is not applied, the non-activated sealant field functions as a barrier coating. In example embodiments, areas where heat/pressure can be applied (e.g., activated sealant fields) include: aligned portions of sealant field 150 and aligned portions of sealant field 153 forming insulating seals 155 and 156, respectively; aligned portions of sealant fields 84 and 85 to form longitudinal seal 42; aligned sealant fields 129 and 130, and aligned sealant fields 133 and 134 to form tack seals; aligned portions of sealant field 92 to form end seal 93; and/or aligned portions of sealant field 89 to form end seal 90. In some embodiments, various aligned portions of sealant field 50 and/or various aligned portions of sealant field 51 can also be heat and/or pressure sealed to form containment seals, as described above. In example embodiments, areas where heat/pressure are not applied (e.g., non-activated sealant fields) include: sealant fields 54 and 55 (e.g. side creases); sealant fields 52, 53, 56, and 57 (e.g., gusset folds); sealant field 50; and sealant field 51.

In embodiments, the characteristics of the seal and/or coating can be controlled by the amount of sealant material applied per ream of material. For example, if it is desired that a seal be maintained, even during the popping process, adhesive can be applied at a basis weight of about 5 lbs per ream. If the seal is to open during processing, about 60% of this amount can be used. Another variable that can be managed, to facilitate opening, is to provide a sealant field which is relatively narrow. For example, at region 92B, FIG. 4, a narrow region of sealant material can be used to facilitate venting.

Figure 6:
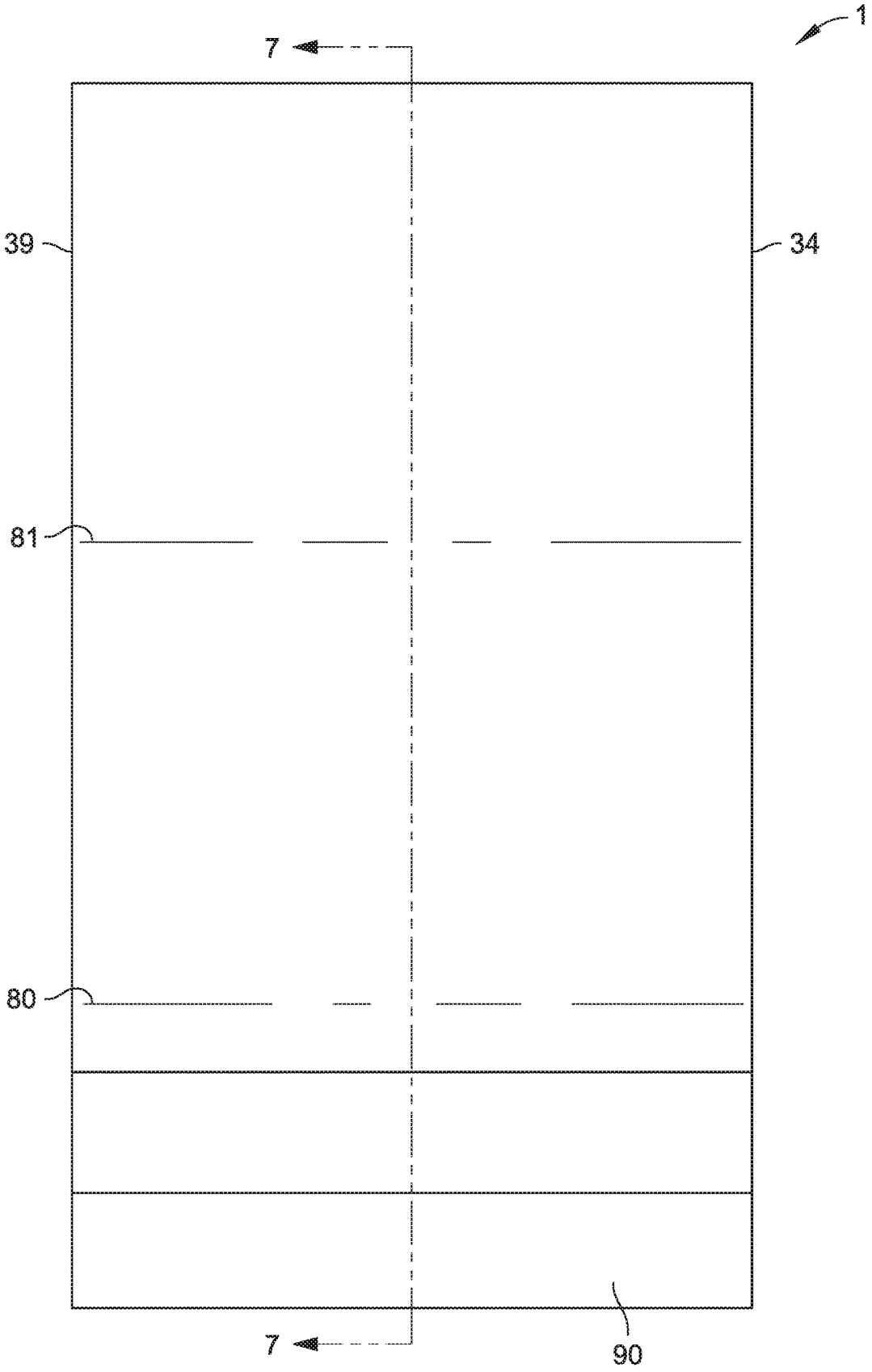
FIG. 6 is a front elevation view of a microwave popcorn bag folded from a sheet of flexible material, such as that shown in FIG. 4, in accordance with embodiments of the present disclosure.
Figure 7:
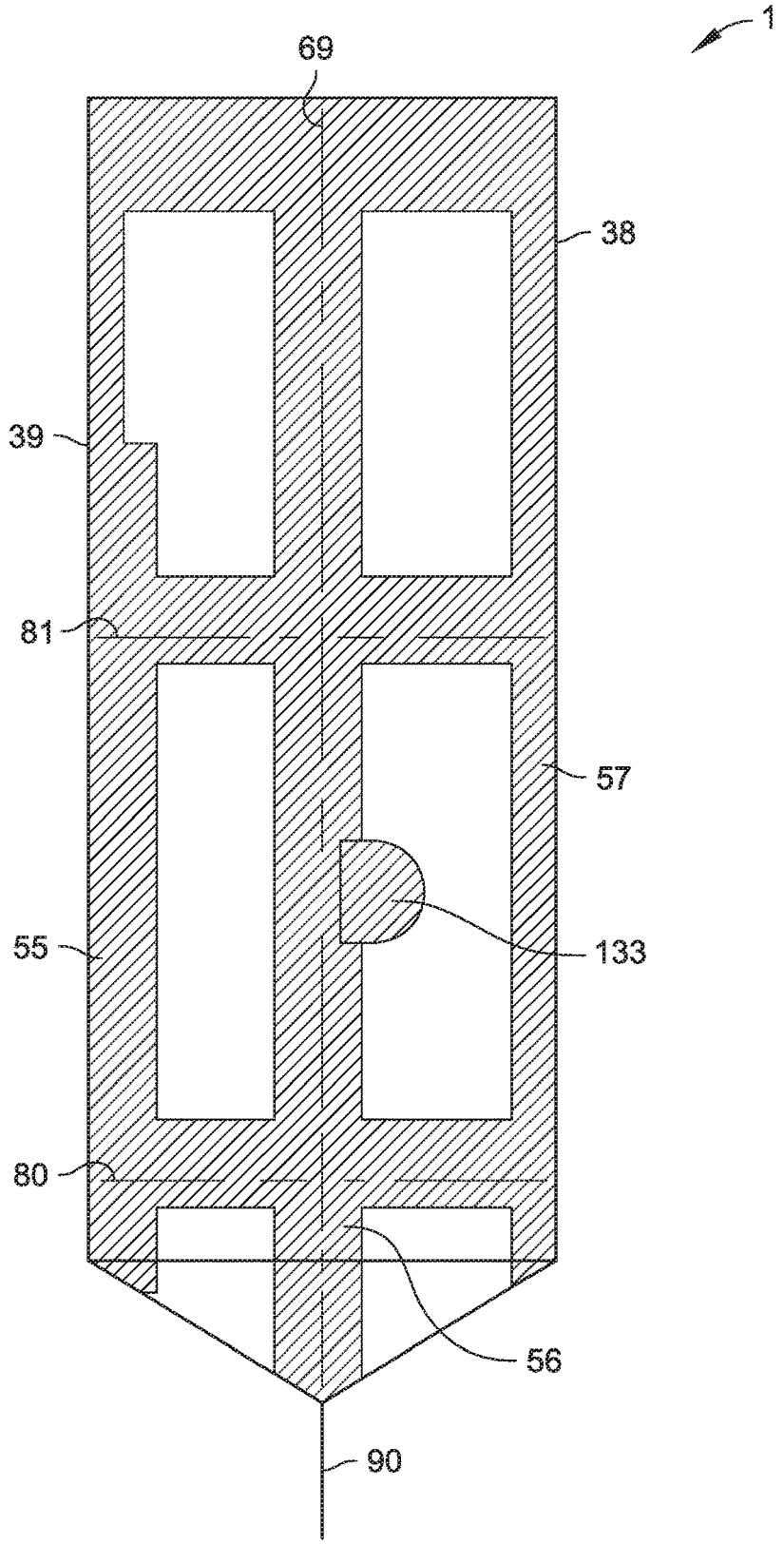
FIG. 7 is a cross-sectional right side elevation view of the microwave popcorn bag of FIG. 6, taken generally along line 7-7 of FIG. 6.
Figure 8:
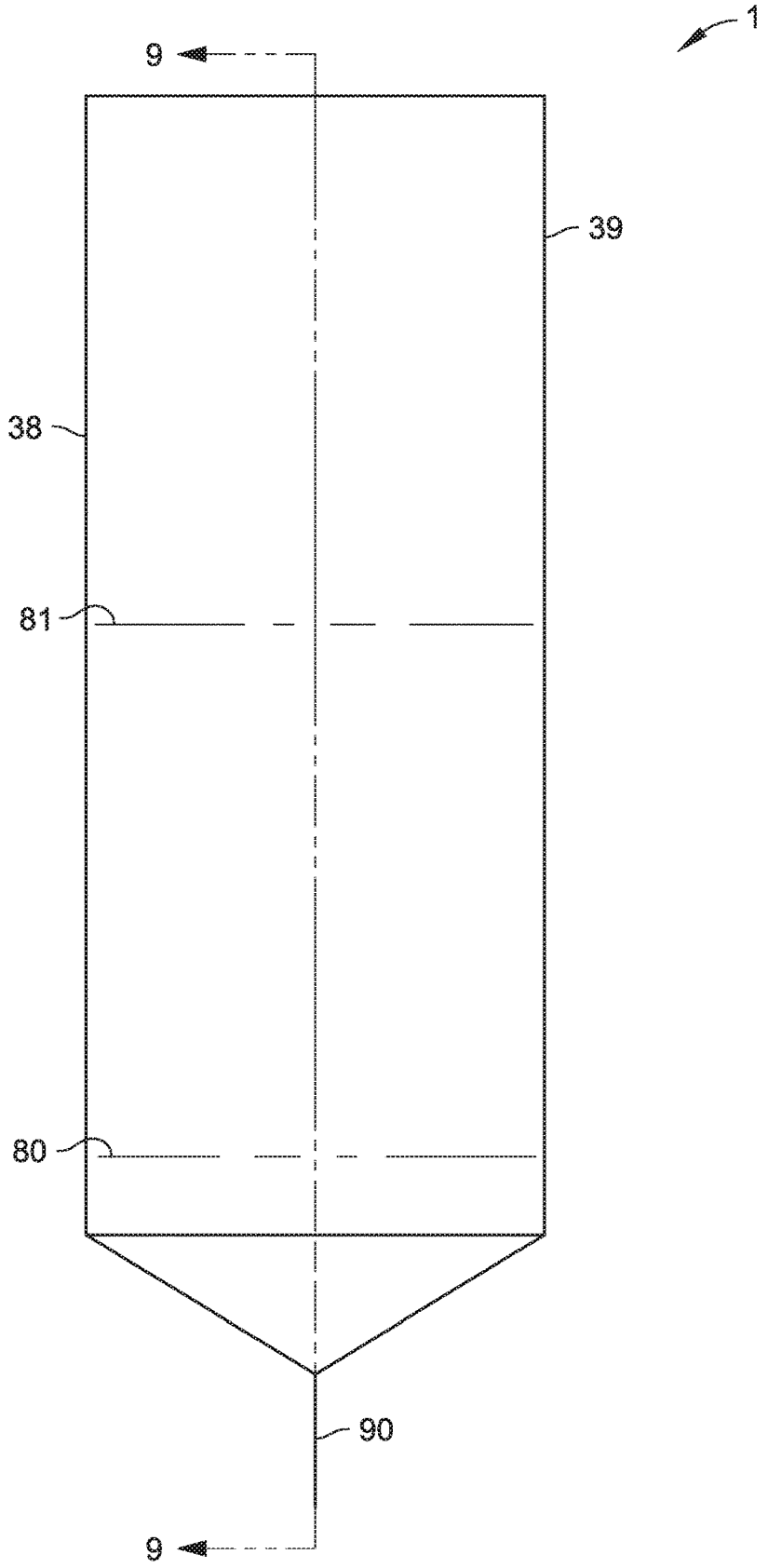
FIG. 8 is a right side elevation view of the microwave popcorn bag of FIG. 6.
Figure 9:
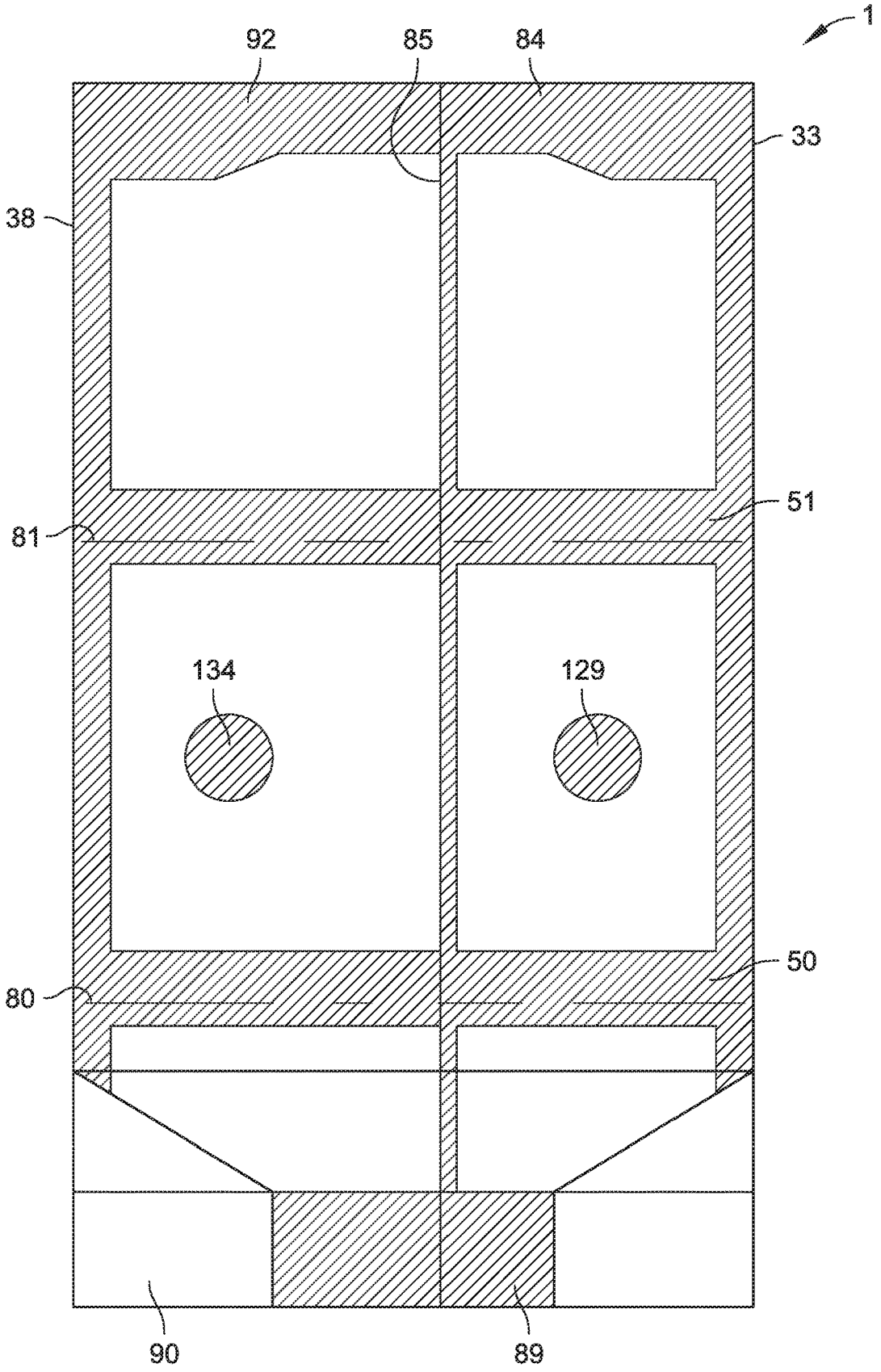
FIG. 9 is a cross-sectional front elevation view of the microwave popcorn bag of FIG. 6, taken generally along line 9-9 of FIG. 8.

FIGS. 6 through 17 further illustrate an example arrangement of the fold lines and sealant fields of panel 60 (e.g., as described with reference to FIG. 4) once the folded bag 1 is expanded (e.g., popped). FIGS. 6 and 7 best illustrates the arrangement of sealant fields on inwardly directed side gusset 22 of the expanded bag 1. Sealant fields 55 and 57 overlap folds 39 and 38, respectively (e.g., as described with reference to FIGS. 6, 7, 14, and 17). Sealant field 56 overlaps fold line 69 of side gusset 22 (e.g., as described with reference to FIGS. 7 and 17). FIG. 7 also illustrates the position of sealant field 133 on the expanded bag 1. FIGS. 8 and 9 illustrate the arrangement of the sealant fields on the face panel 20. Sealant field 84 engages region 85 to form longitudinal seam 42, as described above (e.g., as described with reference to FIG. 3). While sealant fields 84 and 85 appear as a mirror image to the view of FIG. 4, it is to be understood that sealant fields 84 and 85 can also be positioned as they appear in FIG. 4. Sealant fields 50 and 51 overlap fold lines 80 and 81, respectively (e.g., as described with reference to FIGS. 9 and 13). FIG. 9 also illustrates the positions of the sealant fields 129 and 134 after the tack seals formed between regions 129 and 130, and regions 133 and 134, have released during expansion of the bag 1.

Figure 10:
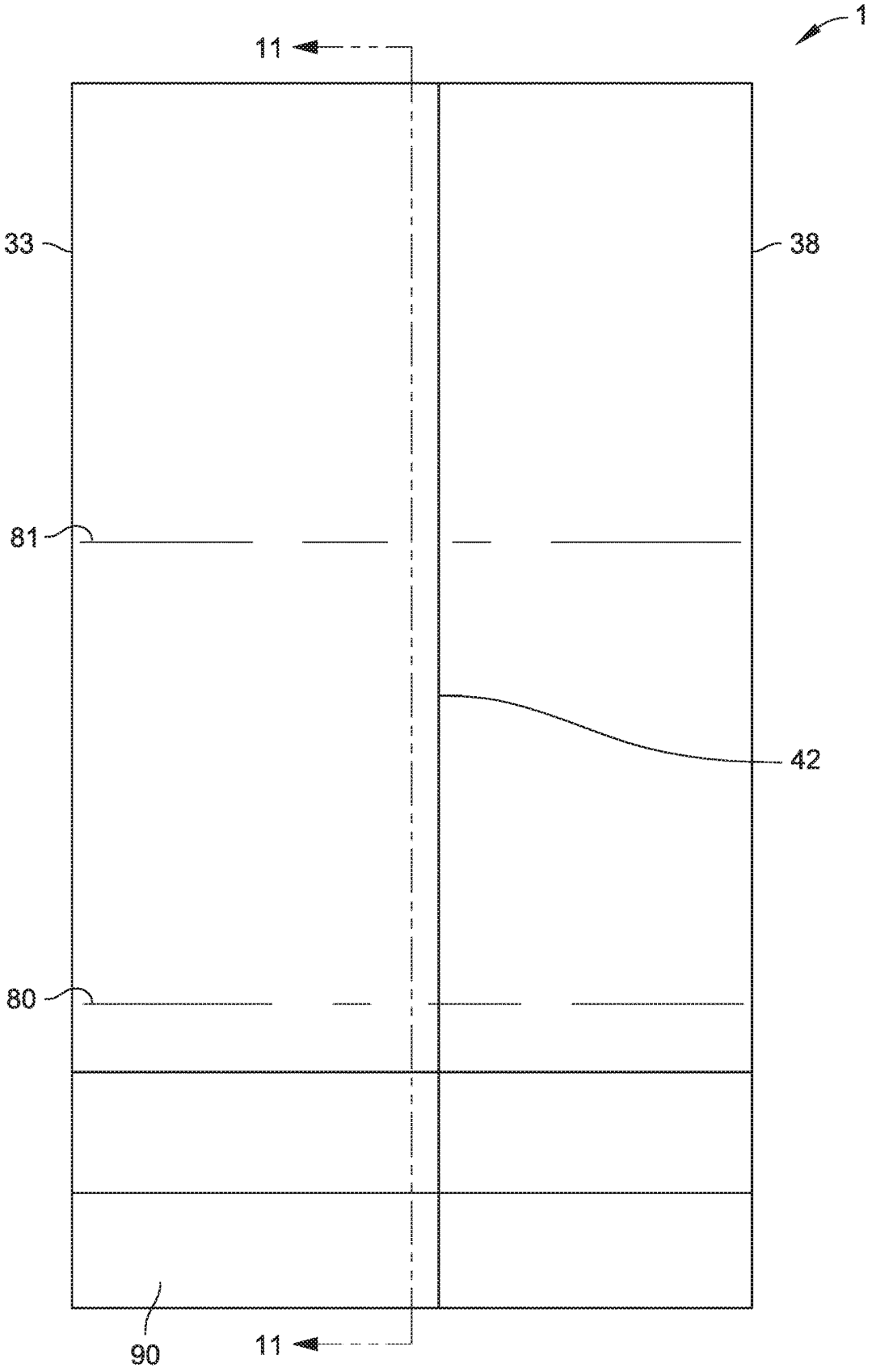
FIG. 10 is a back elevation view of the microwave popcorn bag of FIG. 6.
Figure 11:
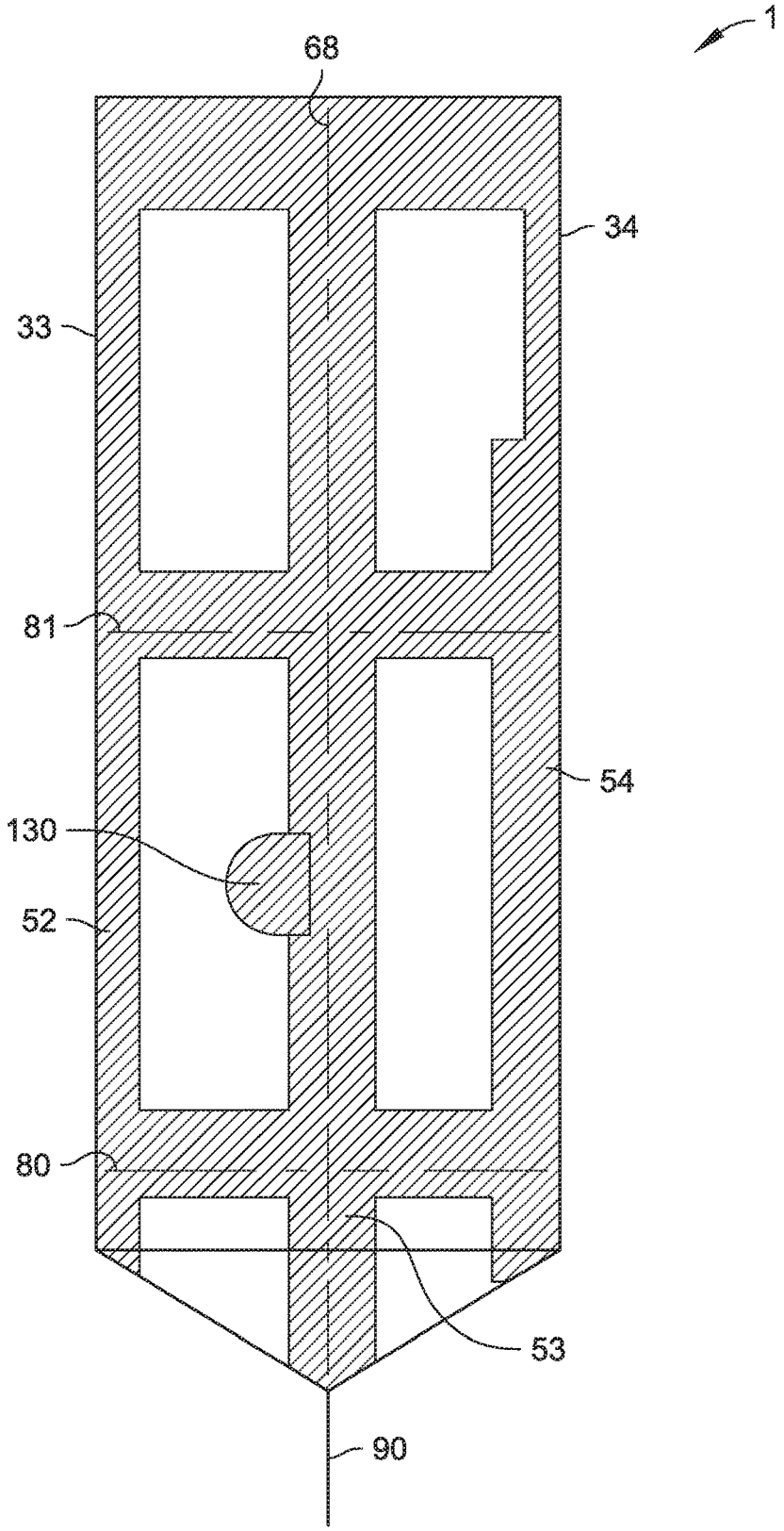
FIG. 11 is a cross-sectional left side elevation view of the microwave popcorn bag of FIG. 6, taken generally along line 11-11 of FIG. 10.
Figure 12:
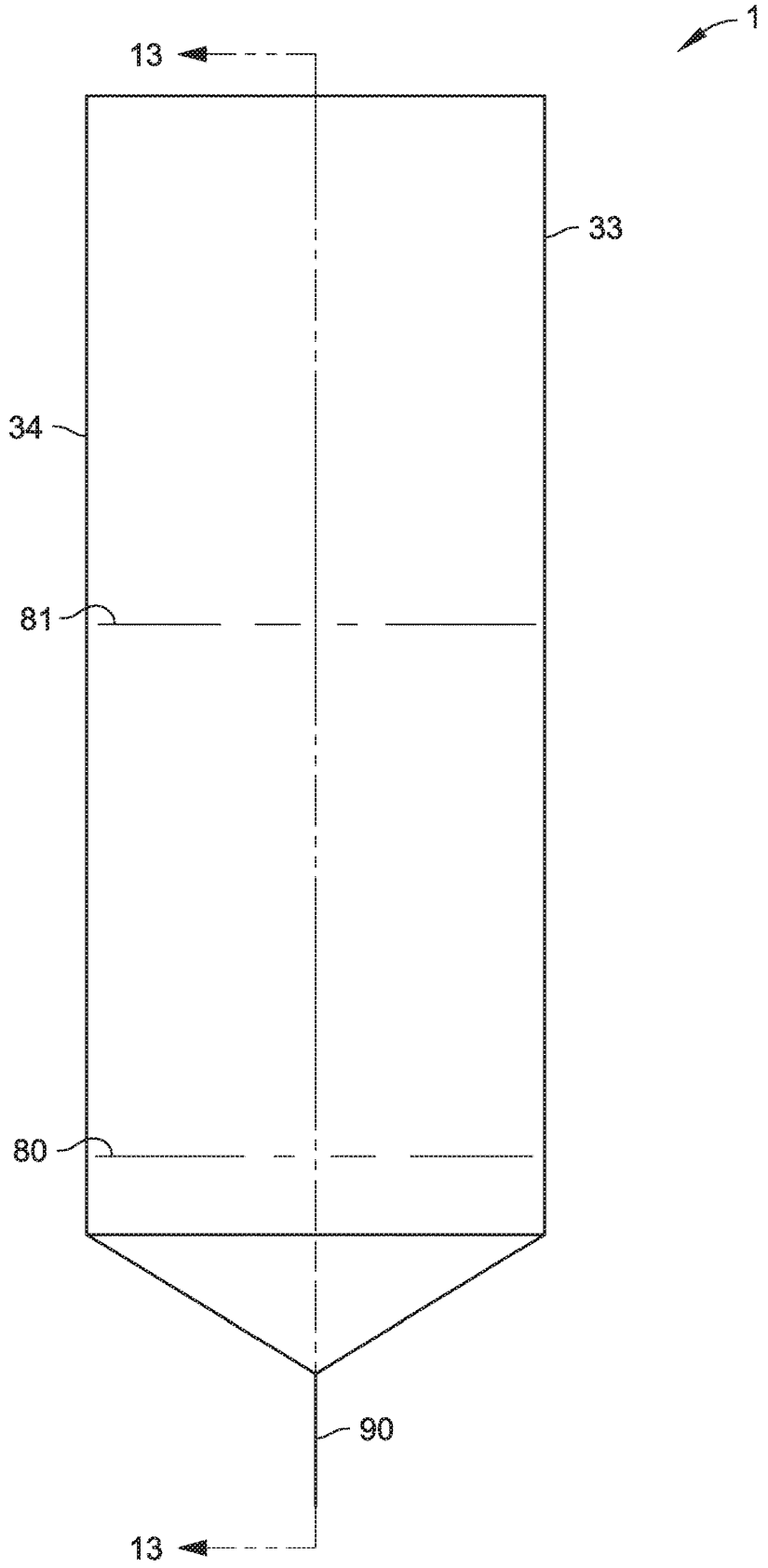
FIG. 12 is left side elevation view of the microwave popcorn bag of FIG. 6.
Figure 13:
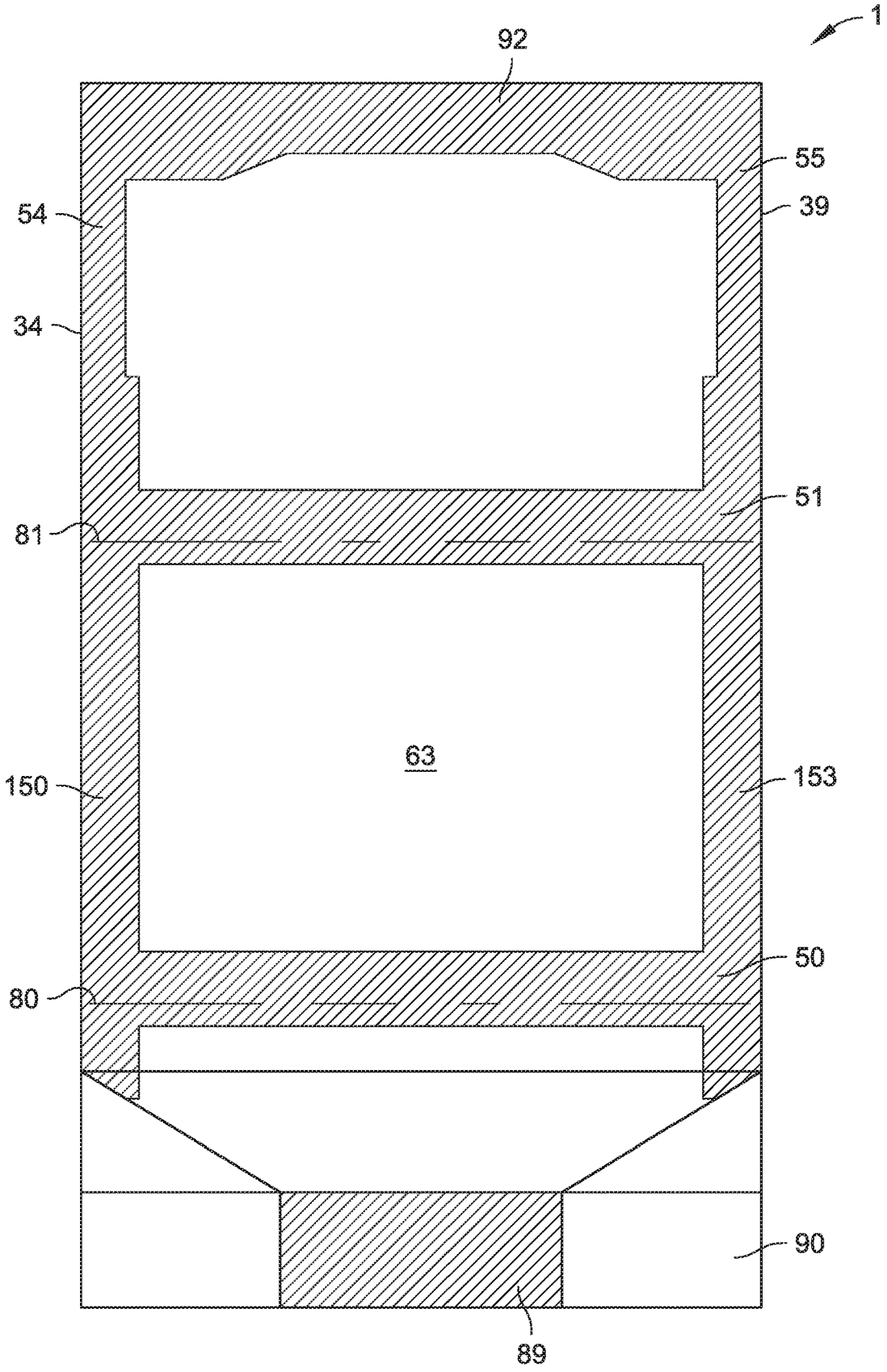
FIG. 13 is a cross-sectional back elevation view of the microwave popcorn bag of FIG. 6, taken generally along line 13-13 of FIG. 12.
Figure 14:
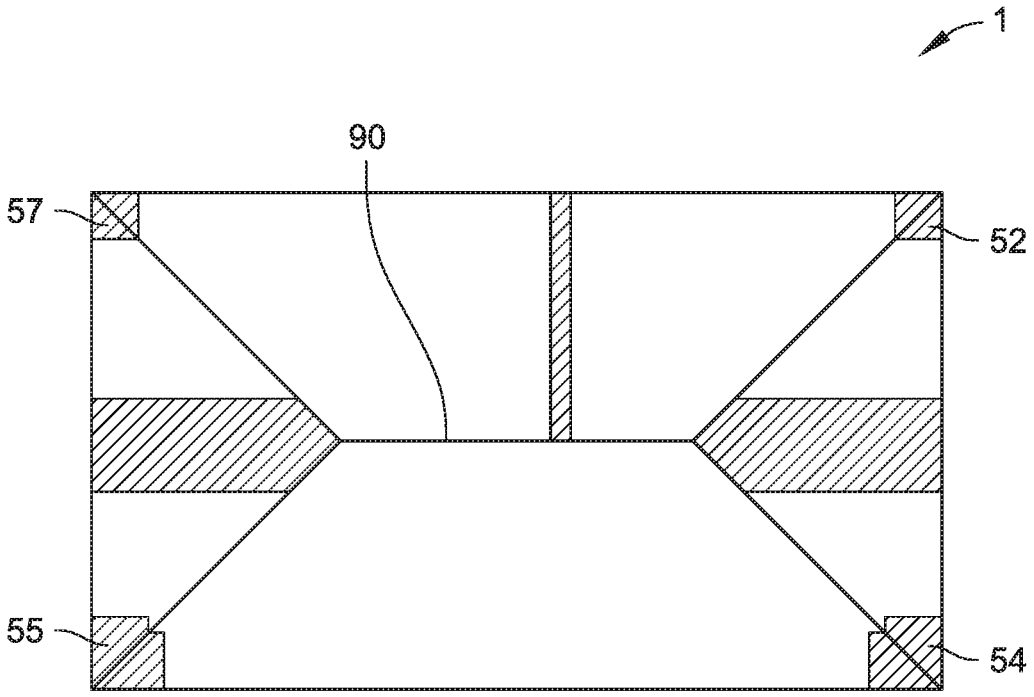
FIG. 14 is a top view of the microwave popcorn bag of FIG. 6.
Figure 15:
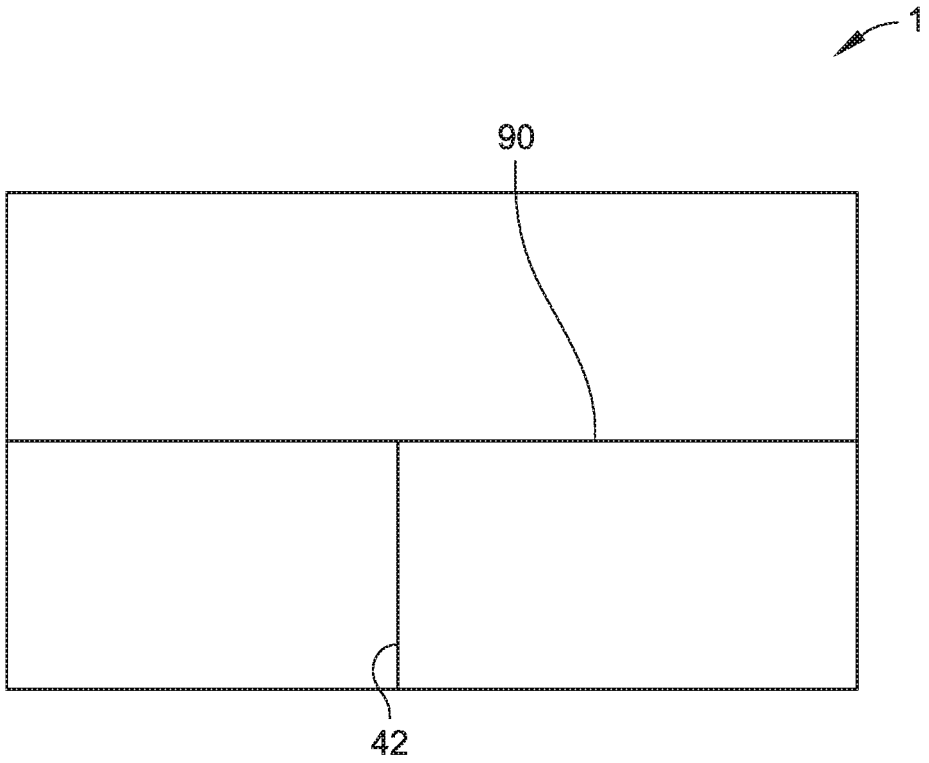
FIG. 15 is a bottom view of the microwave popcorn bag of FIG. 6.
Figure 16:
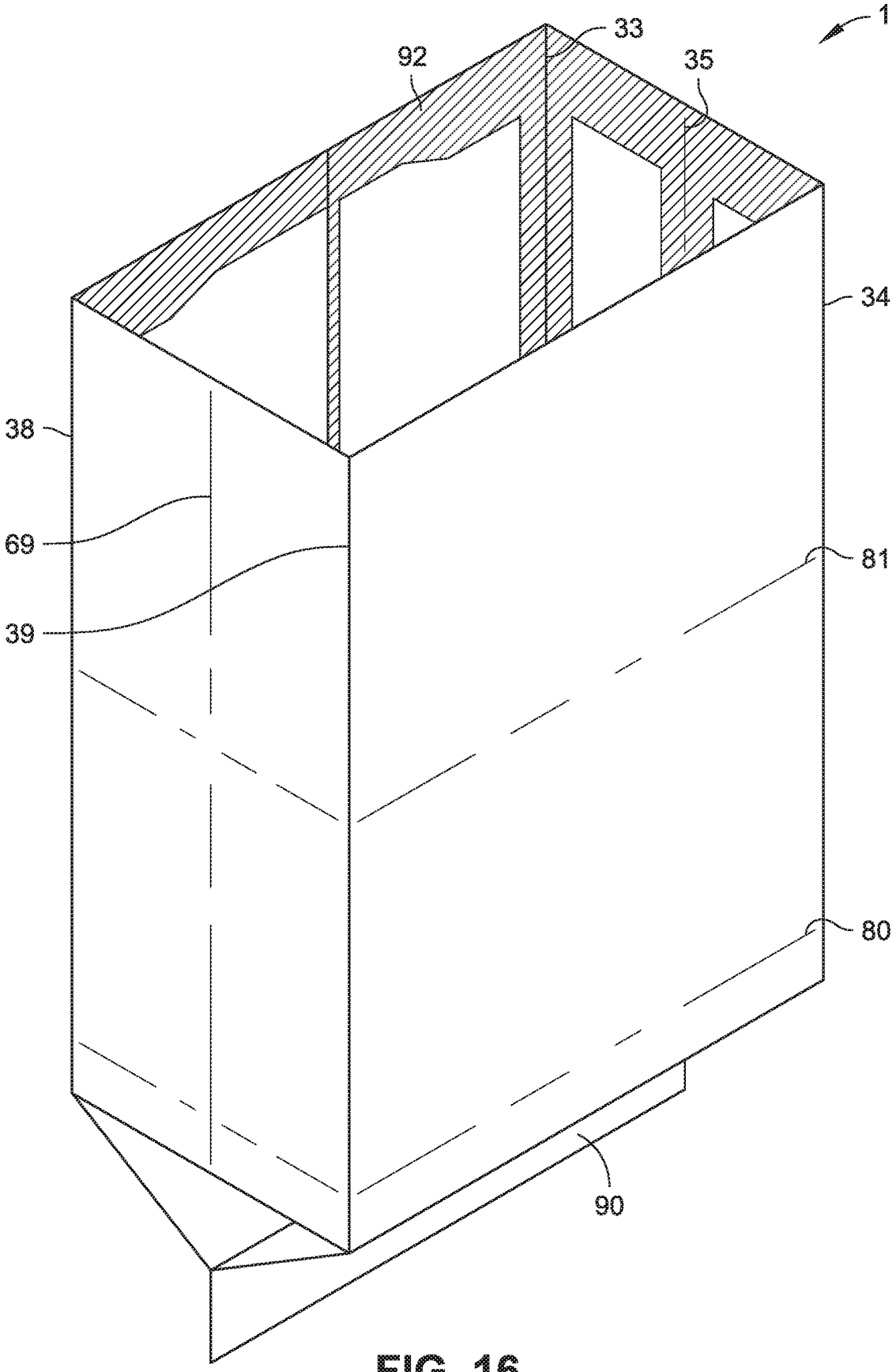
FIG. 16 is an isometric view of the microwave popcorn bag of FIG. 6.
Figure 17:
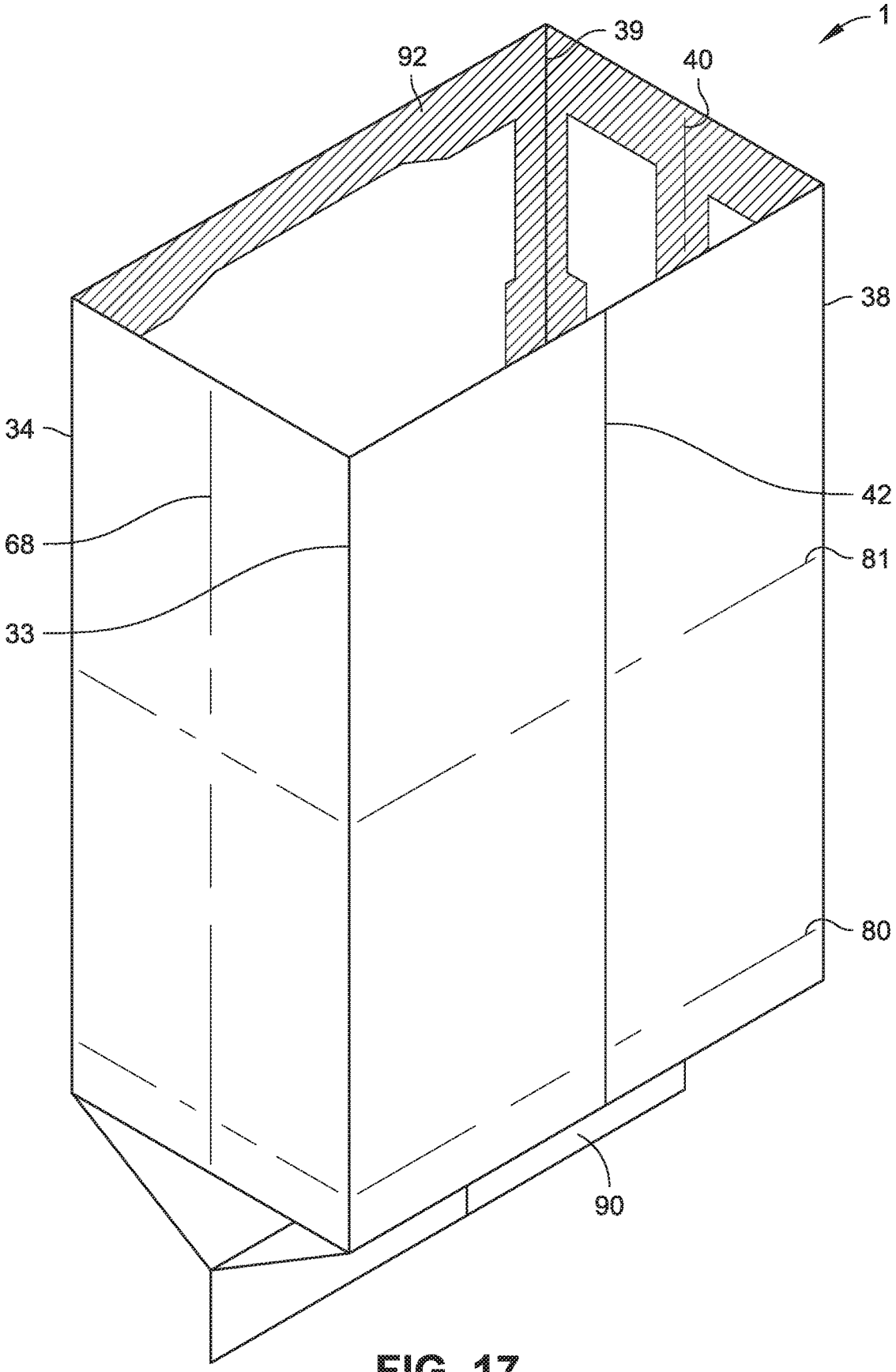
FIG. 17 is another isometric view of the microwave popcorn bag of FIG. 6.

FIGS. 10 and 11 best illustrates the arrangement of sealant fields on opposing side gusset 21 of the expanded bag 1. Sealant fields 52 and 54 overlap folds 33 and 34, respectively (e.g., as described with reference to FIGS. 10, 11, 14, and 16). Sealant field 53 overlaps fold line 68 of the side gusset 21 (e.g., as described with reference to FIGS. 11 and 16). FIG. 11 also illustrates the position of sealant field 130 on the expanded bag 1. FIGS. 12 and 13 illustrate the arrangement of sealant fields on the opposing face panel 21. Sealant fields 150 and 153 can be positioned on opposing sides of the face panel 21, overlapping portions of folds 34 and 39, respectively. Sealant fields 150 and 153 can also overlap and/or intersect with portions of sealant fields 54 and 55, respectively. This arrangement sealant fields can help retain grease/oil in the center portion 63 of the folded bag 1, and can help retain the unpopped corn near the susceptor 45, as described above. Sealant fields 50 and 51 can overlap fold lines 80 and 81, respectively.

The end seal 93 (not shown) can be formed from the alignment of various portions of sealant field 92, as described above (e.g., as described with reference to FIGS. 9, 13, 16, and 17). For example, various portions of sealant field 92 from face panel 20 can align with various portions of sealant field 92 from opposing face panel 21 to form end seal 93. The end seal 93 can form a top edge of the completed bag through which popcorn can be removed after popping Various portions of sealant field 89 can align to form end seal 90, as described above (e.g., as described with reference to FIGS. 6-17). The end seal 90 can form a bottom edge of the bag.

Figure 18:
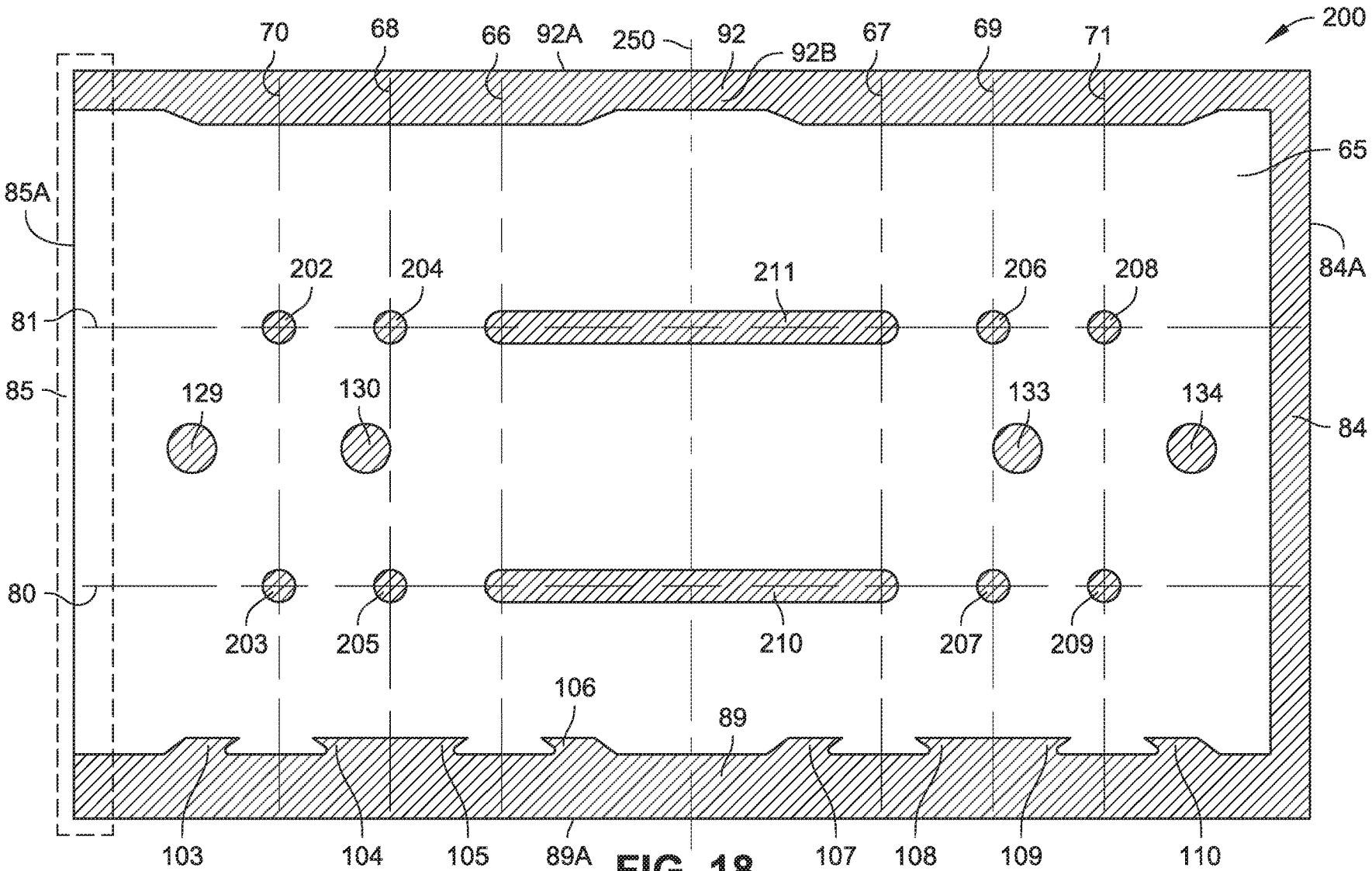
FIG. 18 is an enlarged top plan view of a sheet of flexible material from which a microwave popcorn bag, such as that shown in FIGS. 1 and 2, can be folded in accordance with embodiments of the present disclosure.

Attention is now directed to FIG. 18, which depicts another example foldable blank 200 from which the package according to FIGS. 1, 2 and 3 can be folded. Referring to FIG. 18, the view is of side 201, which will form an inside of the package when folded. In other embodiments, a mirror image to the view of FIG. 18 could also be used as the interior surface. In FIG. 18, the same reference numerals as used in FIG. 4 are used to reference analogous seal features. Unless otherwise described with reference to FIG. 18 below, these analogous seal features interact as described above (e.g., with reference to FIG. 4) to form the folded bag 1.

It has been found, in some instances, that the areas of the bag 1 most likely to leak or tear are those area where the fold lines intersect (e.g., those areas where double creasing or double folding occurs when the bag 1 is folded into the tri-fold 2, FIG. 2. Thus, blank 200 can include one or more sealant fields 202, 203, 204, 205, 206, 207, 208, and 209 positioned at the intersections of fold lines 66, 67, 68, 69, 70, 71 with fold lines 80 and 81. For example, sealant field 202 can be disposed at the intersection of fold lines 70 and 81, sealant field 203 can be disposed at the intersection of fold lines 70 and 80, sealant field 204 can be disposed at the intersection of fold lines 68 and 81, sealant field 205 can be disposed at the intersection of fold lines 68 and 80, sealant field 206 can be disposed at the intersection of fold lines 69 and 81, sealant field 207 can be disposed at the intersection of fold lines 69 and 80, sealant field 208 can be disposed at the intersection of fold lines 71 and 81, and sealant field 209 can be disposed at the intersection of fold lines 71 and 80.

The blank 200 can also include one or more transverse sealant fields overlapping fold line 80 and/or fold line 81. For example, the blank 200 can include a transverse sealant field 210 overlapping fold line 80 at a location below center area 63, and/or a transverse sealant field 211 overlapping fold line 81 at a location above center area 63. Transverse sealant fields 210, 211 can also overlap the point of intersection between fold lines 66, 80 and the point of intersection between fold lines 66, 81, respectively; and/or the point of intersection between fold lines 67, 80 and the point of intersection between fold lines 67, 81, respectively. In embodiments, the sealant fields 210 and 211 form a barrier coating. The barrier coating can help inhibit undesirable wicking of oil/fat from the center area 63 at outer edges 4 and 7 of the folded bag 1; FIG. 1. Where sealant fields 210 and 211 form a barrier coating, a transverse containment seal is generally not needed to obtain appropriate control over oil/fat location. Avoiding the use of transverse containment seals can result in cost savings. However, it is to be understood that overlapping portions of sealant field 210 and/or sealant field 211 can be heat and/or pressure sealed to form containment seals.

Figure 19:
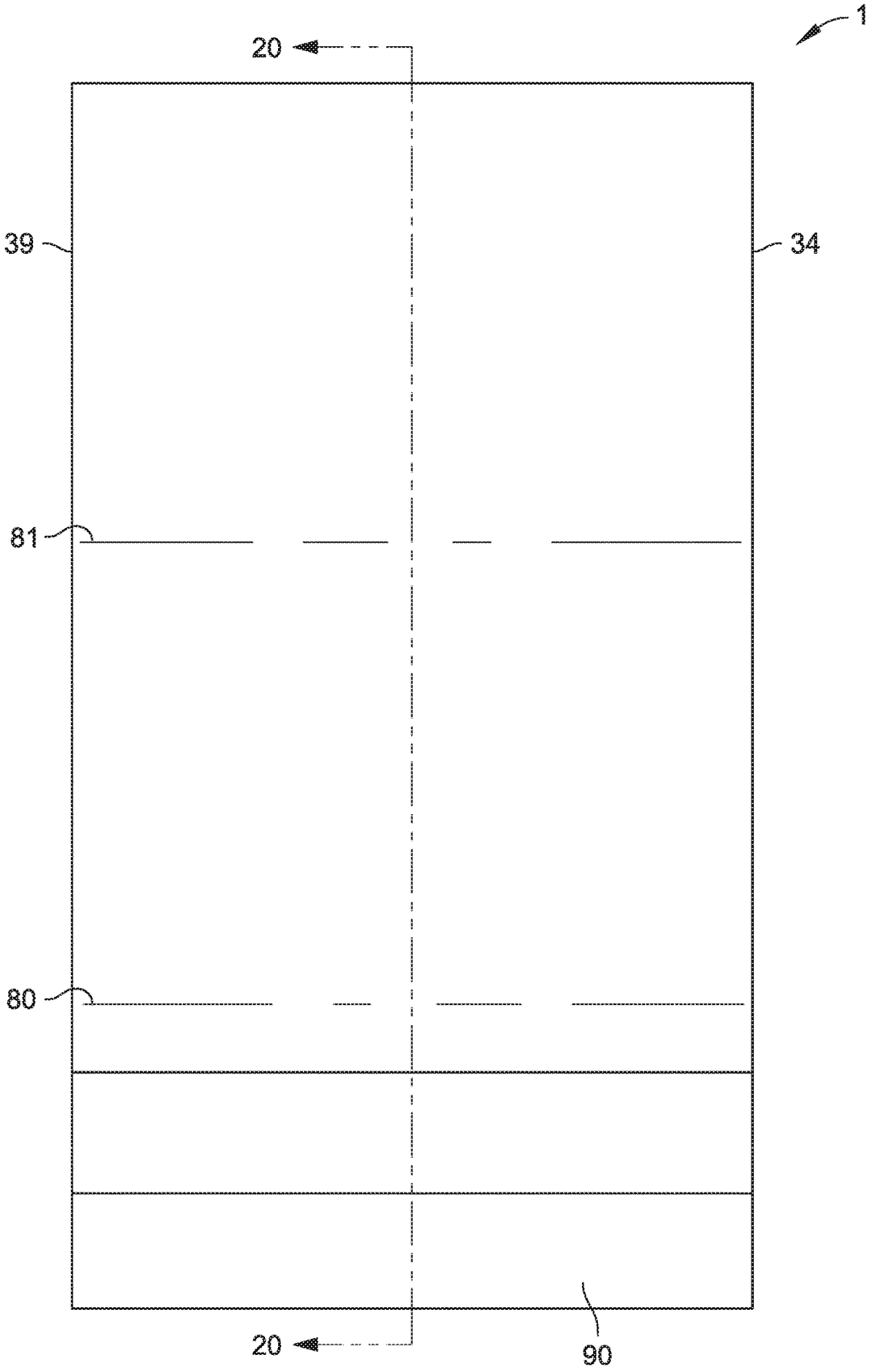
FIG. 19 is a front elevation view of a microwave popcorn bag folded from a sheet of flexible material, such as that shown in FIG. 18, in accordance with embodiments of the present disclosure.
Figure 20:
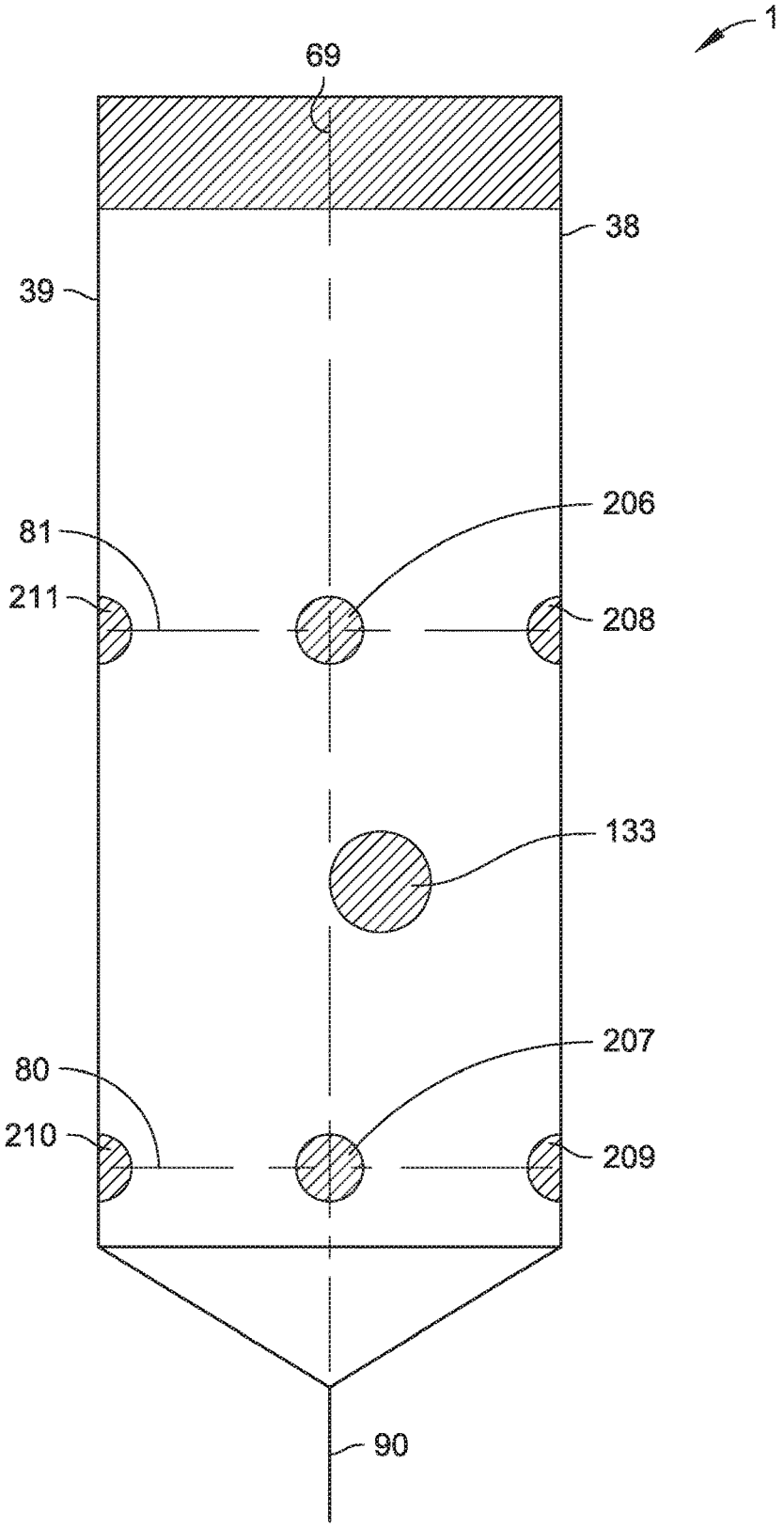
FIG. 20 is a cross-sectional right side elevation view of the microwave popcorn bag of FIG. 19, taken generally along line 20-20 of FIG. 19.

FIGS. 19 through 30 further illustrate an example arrangement of the fold lines and sealant fields of panel 200 (e.g., as described with reference to FIG. 18) once the folded bag 1 is expanded (e.g., popped). FIGS. 19 and 20 best illustrates the arrangement of sealant fields on inwardly directed side gusset 22 of the expanded bag 1, with sealant fields positioned at intersecting fold lines. For example, sealant field 206 can be disposed at the intersection of fold lines 69 and 81, and sealant field 207 can be disposed at the intersection of fold lines 69 and 80. Sealant field 208 can be disposed at the intersection of fold line 81 and fold 38, and sealant field 209 can be disposed at the intersection of fold line 80 and fold 38. Portions of transverse sealant fields 210, 211 overlap the point of intersection between fold line 80 and fold 39, and the point of intersection between fold line 81 and fold 39, respectively. FIG. 20 also illustrates the position of sealant field 133 on the expanded bag 1.

Figure 21:
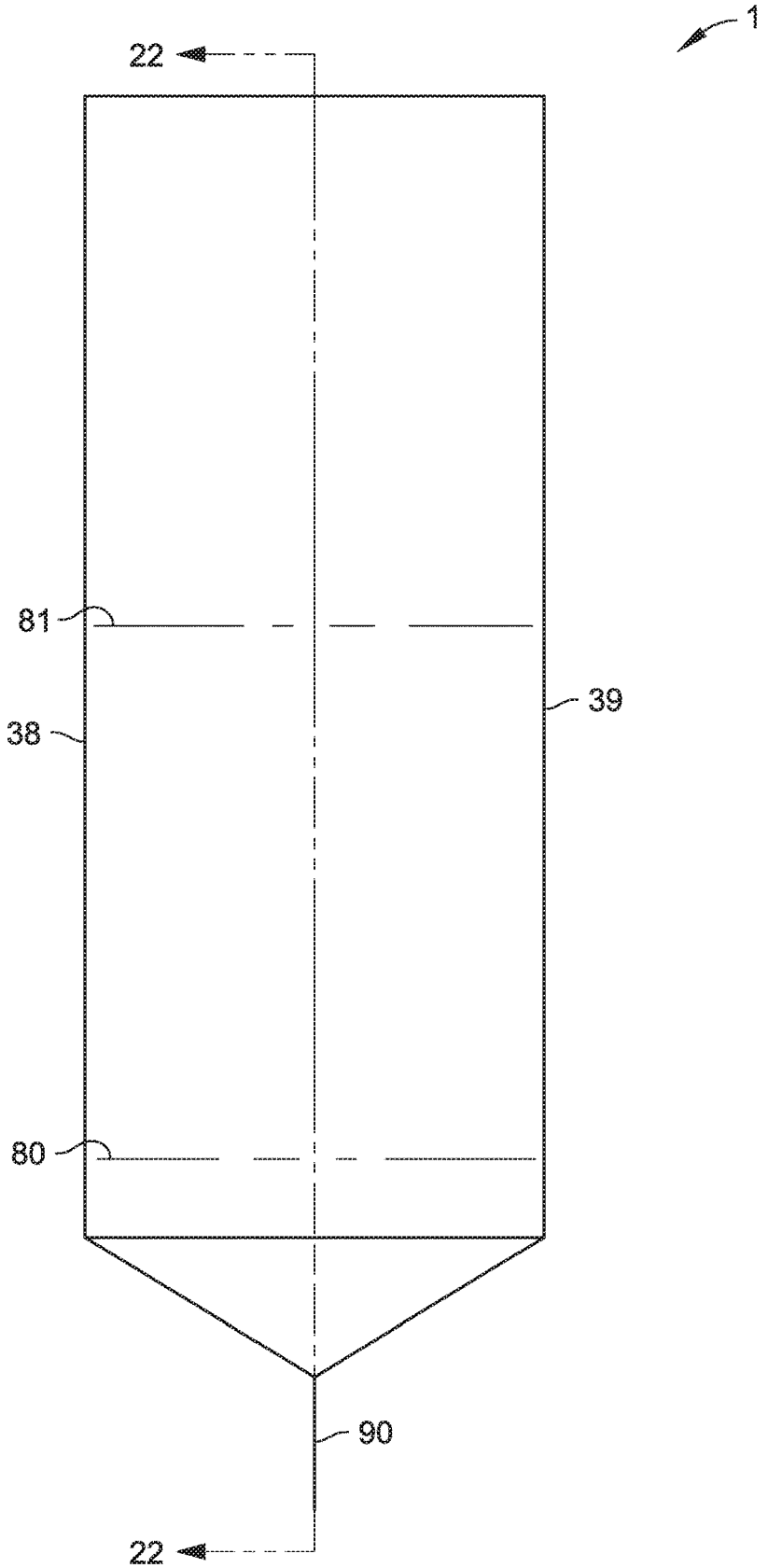
FIG. 21 is a right side elevation view of the microwave popcorn bag of FIG. 19.
Figure 22:
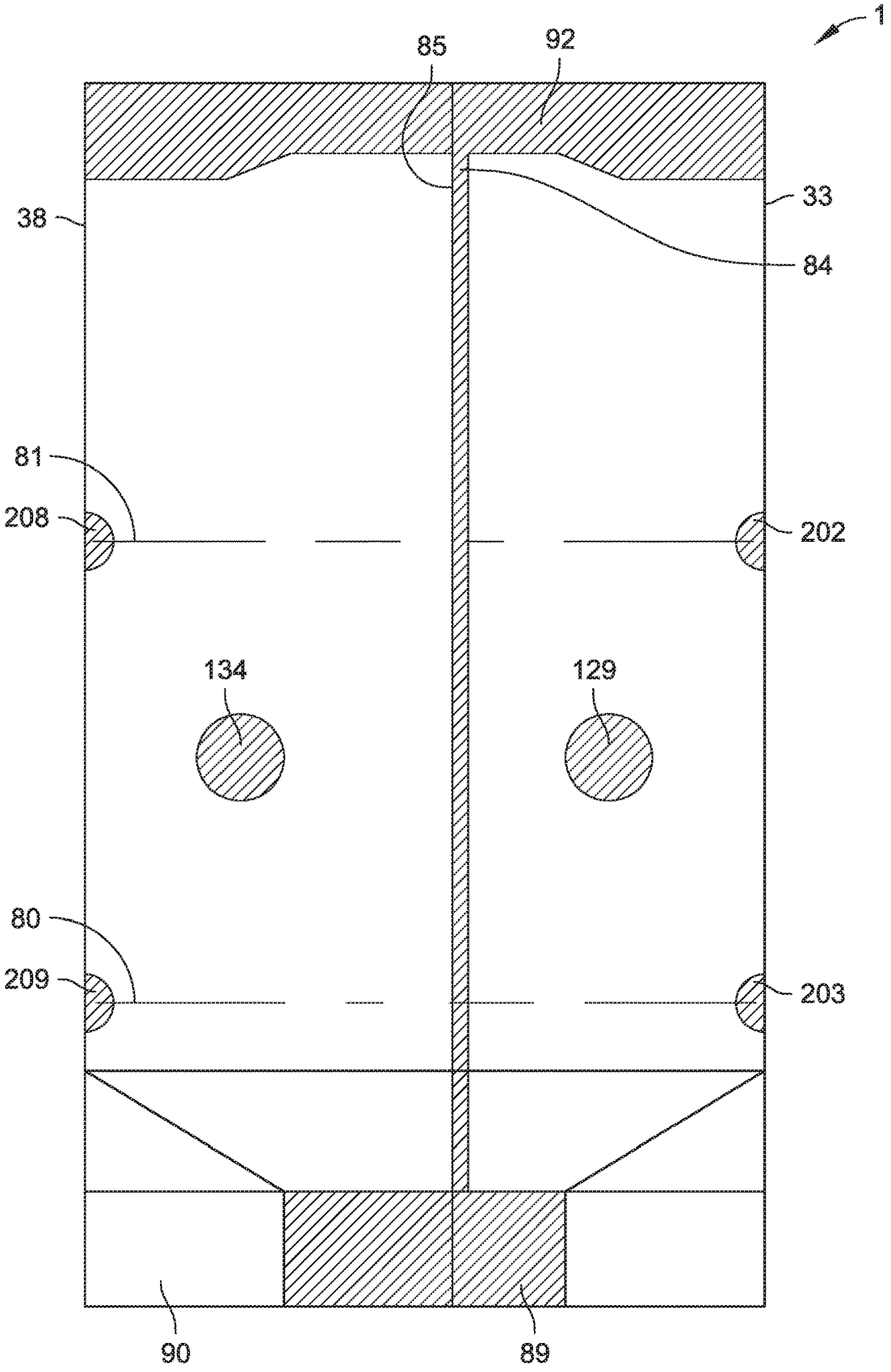
FIG. 22 is a cross-sectional front elevation view of the microwave popcorn bag of FIG. 19, taken generally along line 22-22 of FIG. 21.

FIGS. 21 and 22 illustrate the arrangement of sealant fields on the face panel 20. Sealant field 84 engages region 85 to form longitudinal seam 42, as described above (e.g., as described with reference to FIG. 23). While sealant fields 84 and 85 appear as a mirror image to the view of FIG. 18, it is to be understood that sealant fields 84 and 85 can also be positioned as they appear in FIG. 18. Sealant fields 202, 203 can be disposed at the intersection of fold line 81 and fold 33, and the intersection of fold line 80 and fold 33, respectively. Sealant fields 208, 209 can be disposed at the intersection of fold line 81 and fold 38, and the intersection of fold line 80 and fold 38, respectively. Sealant fields 206, 207, 208, and 209 can be analogous to sealant fields 202, 203, 204, and 205, respectively, except positioned as mirror images around center line 205. For example, Sealant field 208 can be analogous to field 202, except positioned over fold lines 71 and 70, respectively. Sealant field 208 can be positioned as a mirror image of field 202, around center line 250 and over fold line 71; sealant field 209 can be positioned as a mirror image of field 203, around center line 250 and over fold line 71; sealant field 206 can be positioned as a mirror image of field 204, around center line 250 and over fold line 69; and sealant field 207 can be positioned as a mirror image of field 205, around center line 250 and over fold line 69.

FIG. 22 also illustrates the positions of the sealant fields 129 and 134 after the tack seals formed between regions 129 and 130, and regions 133 and 134, have released during expansion of the bag 1. As described above, fields 129 and 130 are oriented to engage one another when the arrangement is folded about fold line 70; and fields 133 and 134 are oriented to engage one another when the arrangement is folded about fold line 71.

Figure 23:
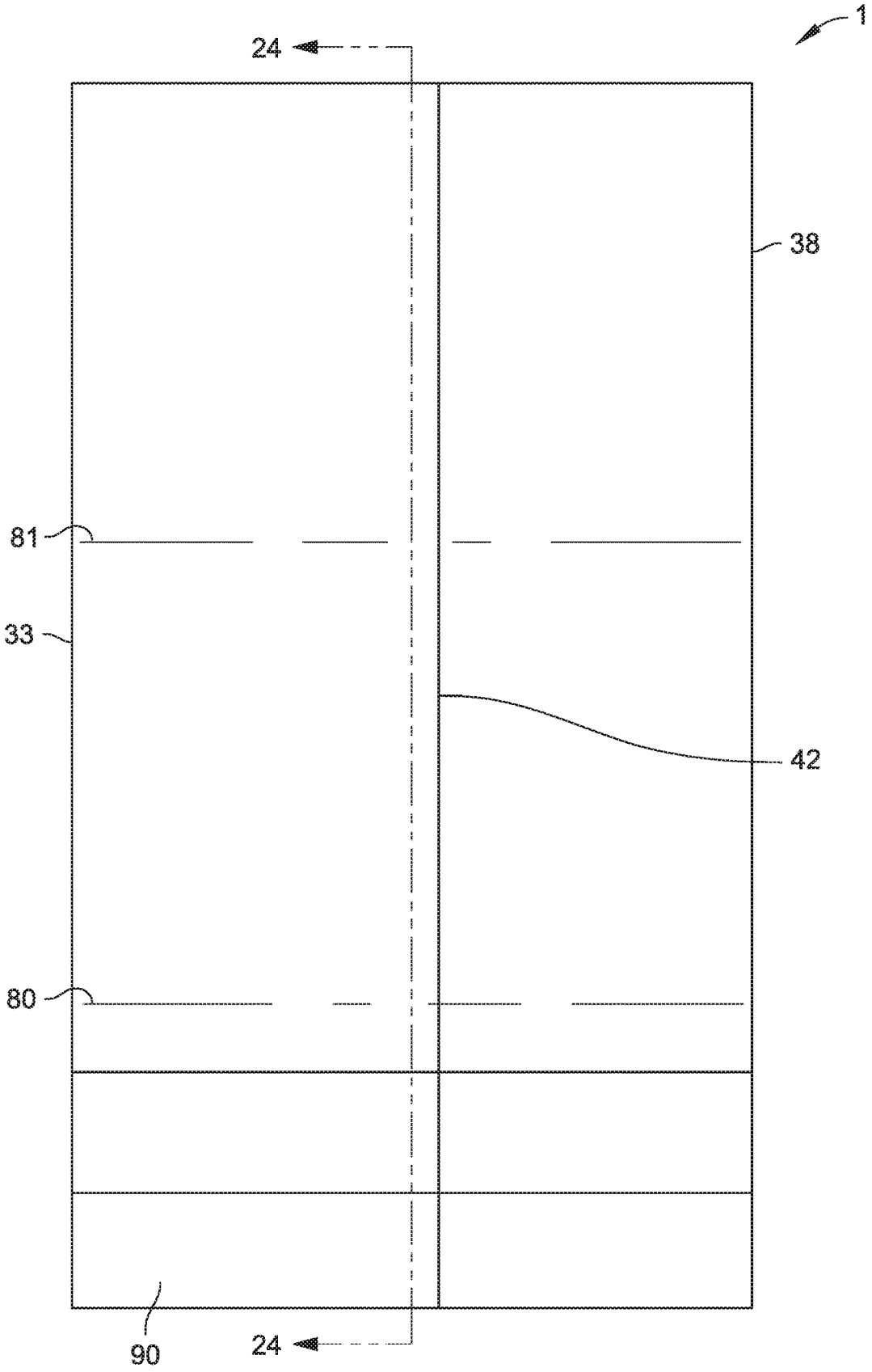
FIG. 23 is a back elevation view of the microwave popcorn bag of FIG. 19.
Figure 24:
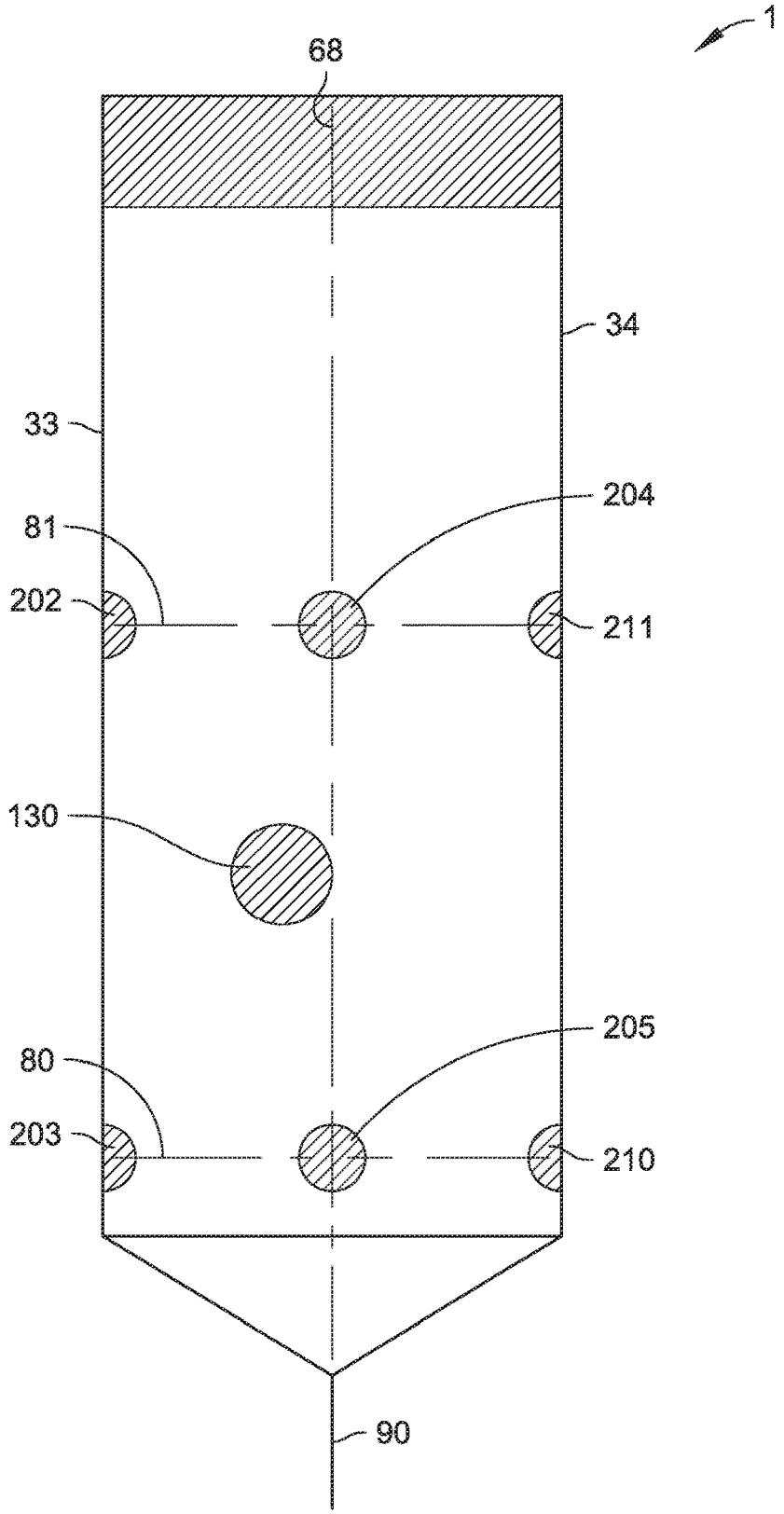
FIG. 24 is a cross-sectional left side elevation view of the microwave popcorn bag of FIG. 19, taken generally along line 24-24 of FIG. 23.

FIGS. 23 and 24 best illustrates the arrangement of sealant fields on opposing side gusset 21 of the expanded bag 1, with sealant fields positioned at intersecting fold lines. For example, sealant field 204 can be disposed at the intersection of fold lines 68 and 81, and sealant field 205 can be disposed at the intersection of fold lines 68 and 80. Sealant field 202 can be disposed at the intersection of fold line 81 and fold 33, and sealant field 203 can be disposed at the intersection of fold line 80 and fold 33. Portions of transverse sealant fields 210, 211 overlap the point of intersection between fold line 80 and fold 34, and the point of intersection between fold line 81 and fold 34, respectively. FIG. 24 also illustrates the position of sealant field 130 on the expanded bag 1.

Figure 25:
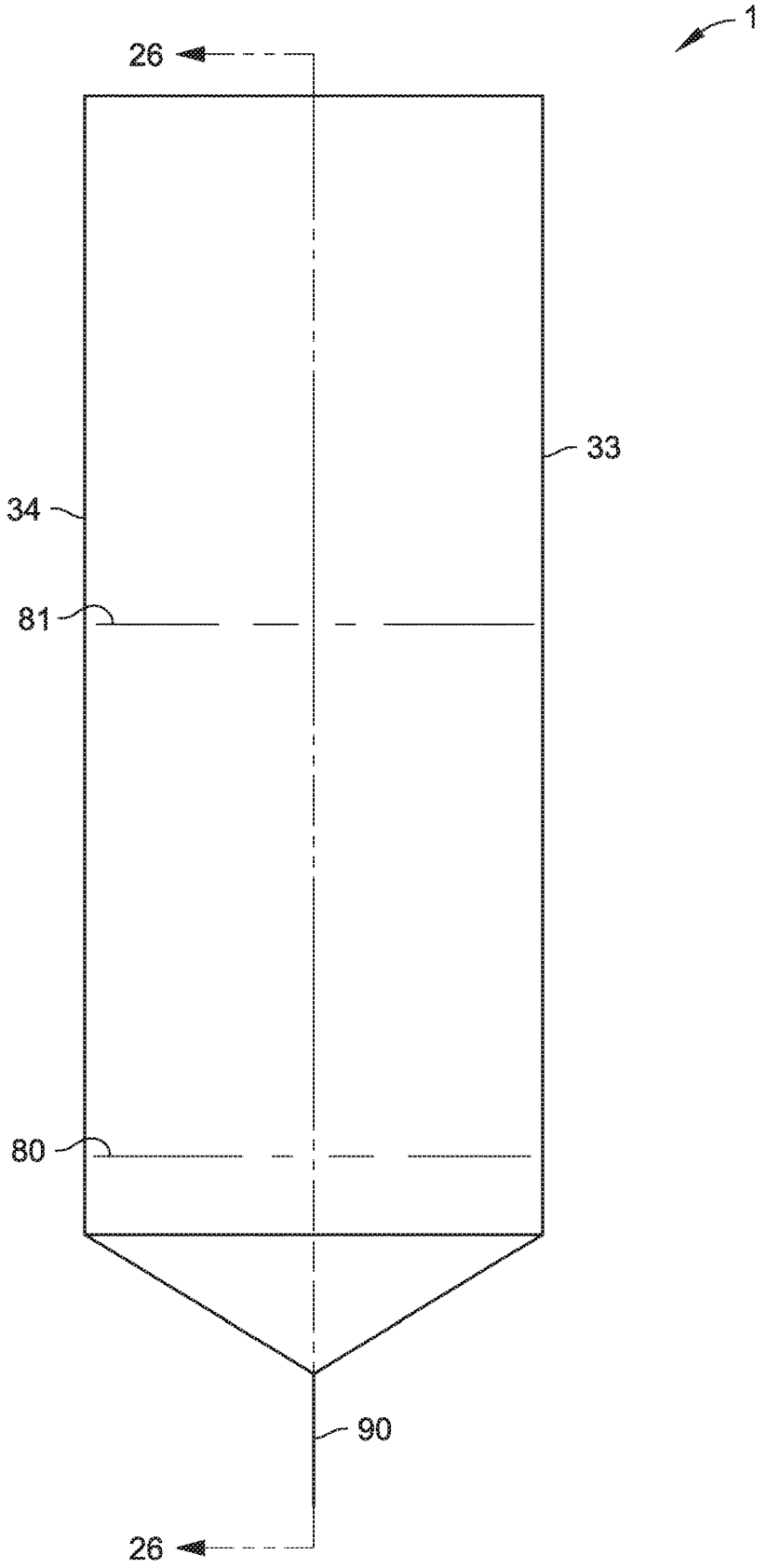
FIG. 25 is left side elevation view of the microwave popcorn bag of FIG. 19.
Figure 26:
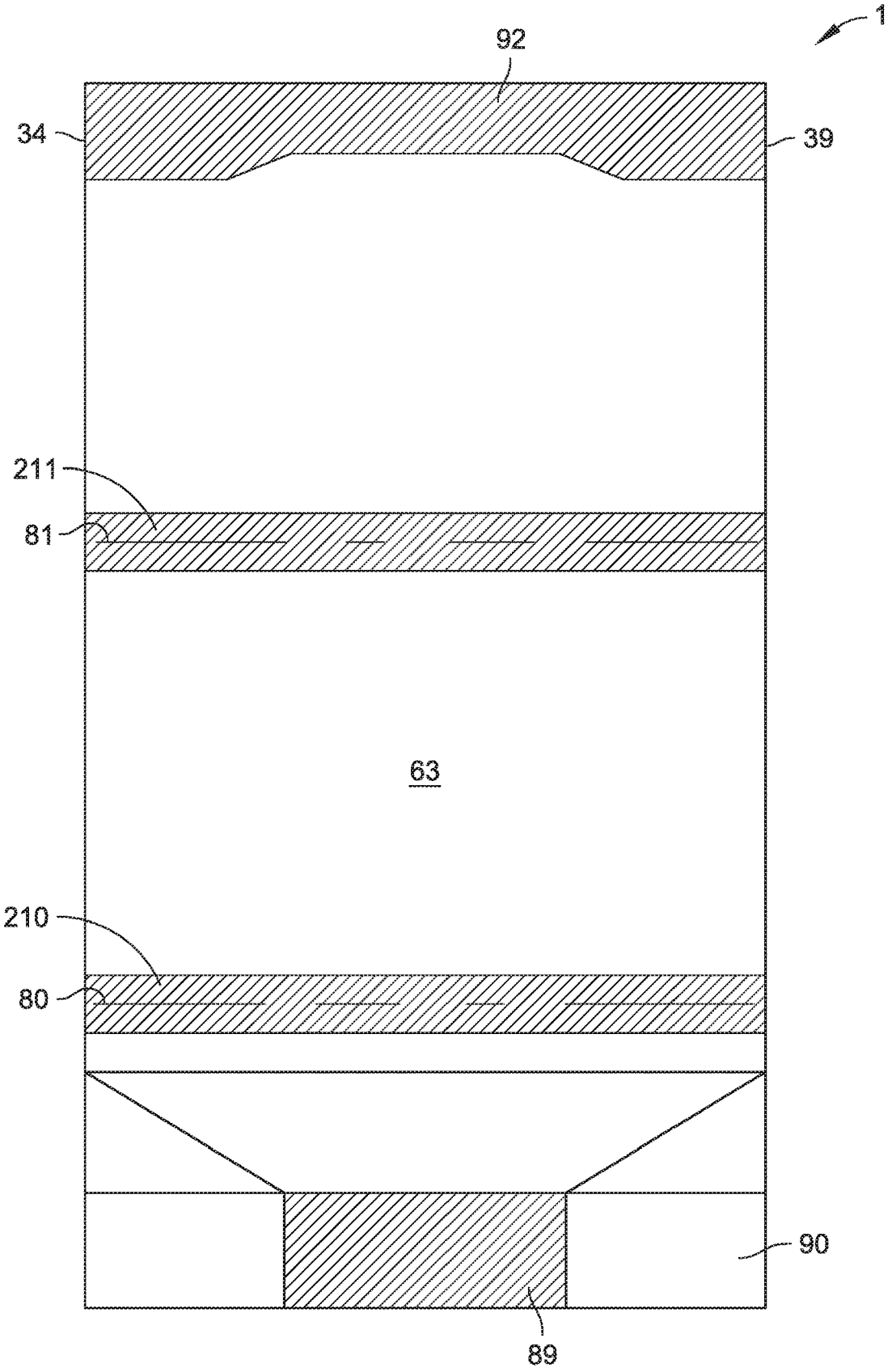
FIG. 26 is a cross-sectional back elevation view of the microwave popcorn bag of FIG. 19, taken generally along line 26-26 of FIG. 25.
Figure 27:
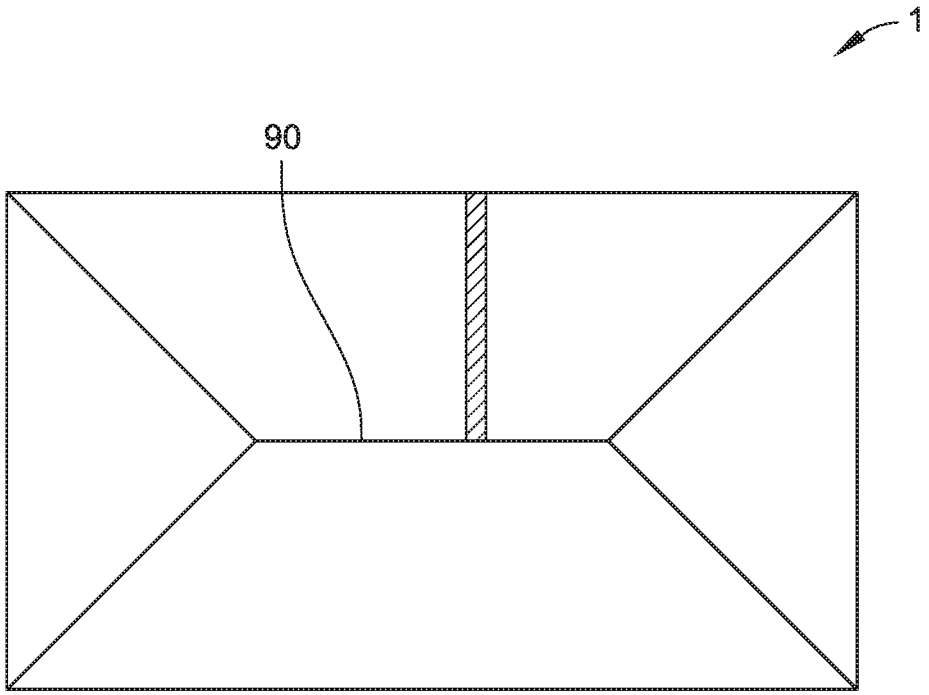
FIG. 27 is a top view of the microwave popcorn bag of FIG. 19.
Figure 28:
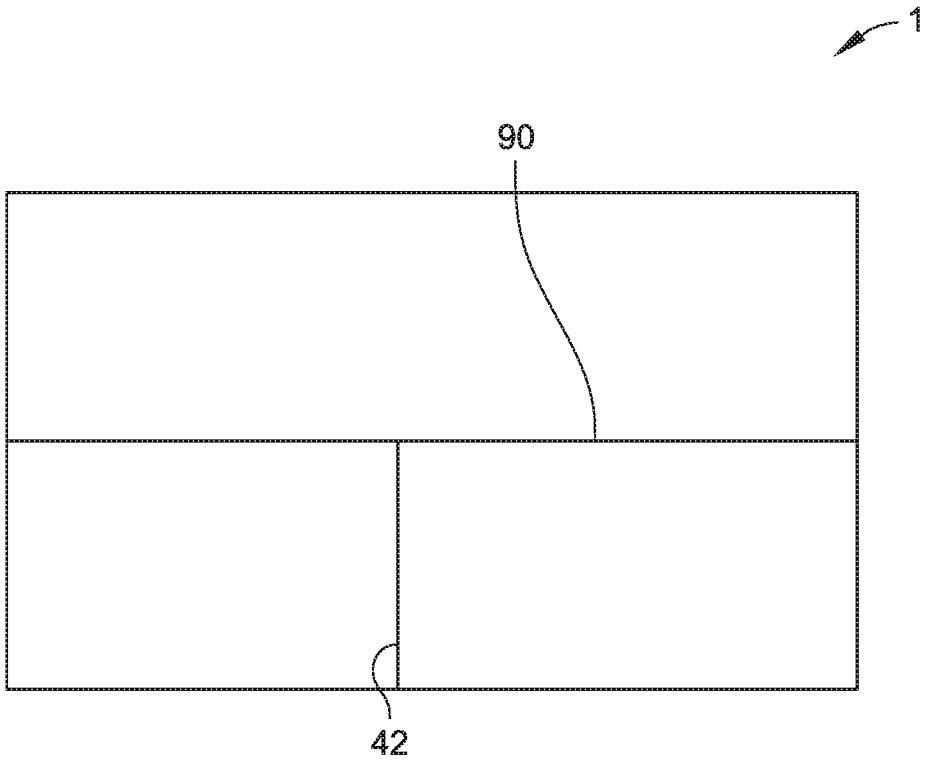
FIG. 28 is a bottom view of the microwave popcorn bag of FIG. 19.
Figure 29:
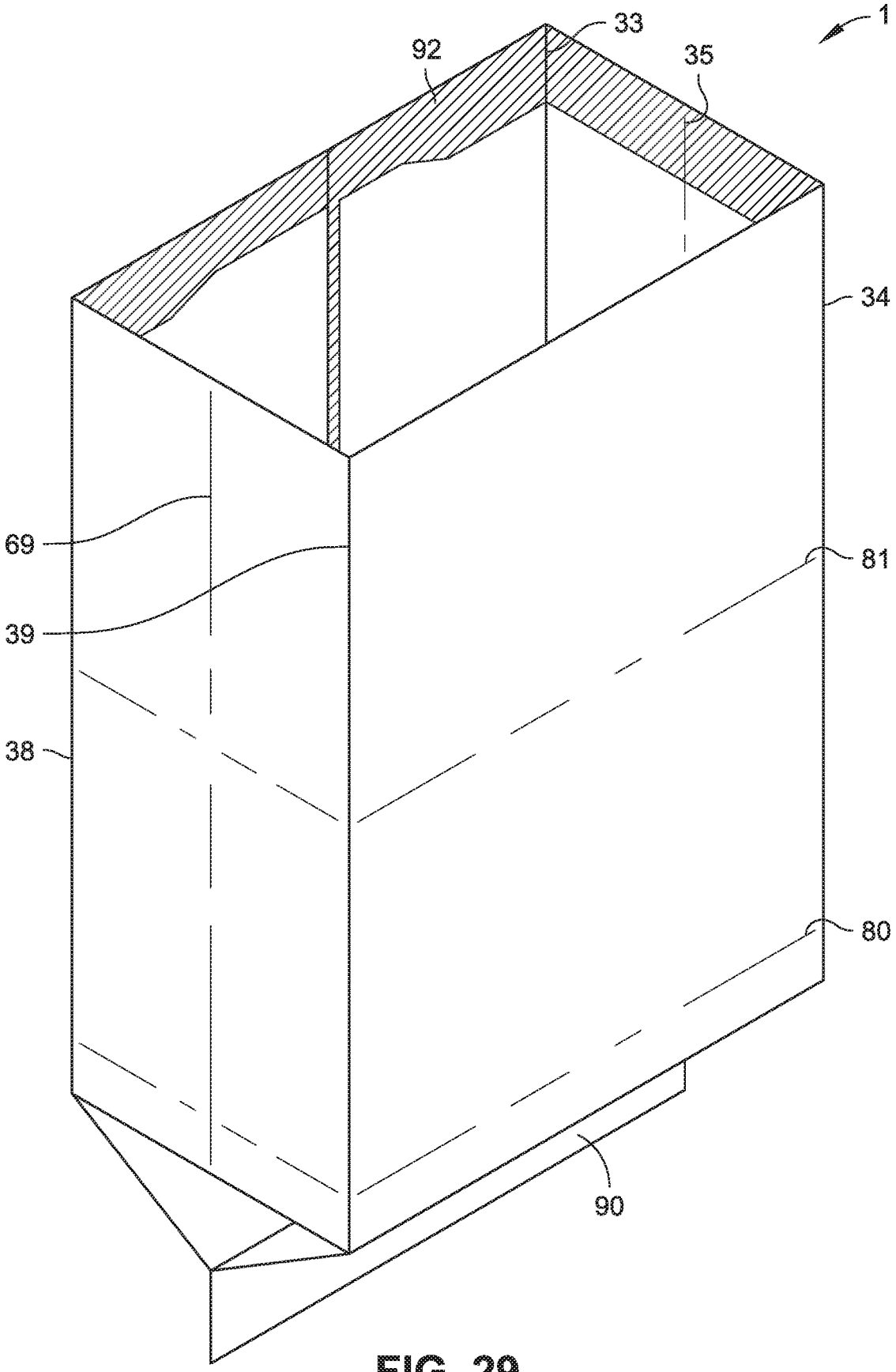
FIG. 29 is an isometric view of the microwave popcorn bag of FIG. 19.
Figure 30:
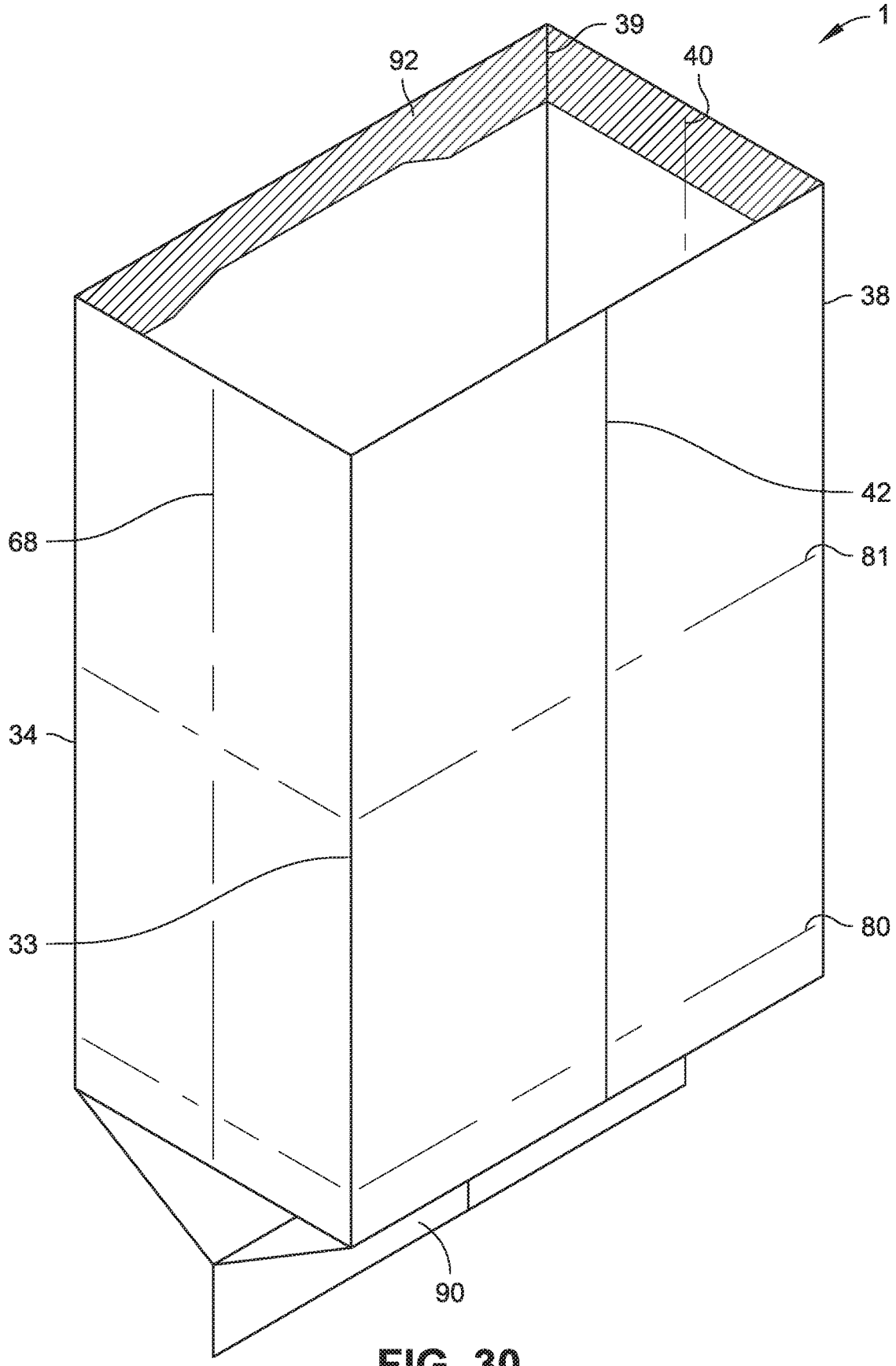
FIG. 30 is another isometric view of the microwave popcorn bag of FIG. 19.

FIGS. 25 and 26 illustrate the arrangement of sealant fields on the opposing face panel 21. Transverse sealant field 210 can be positioned to overlap fold line 80 at a location below center area 63, and/or transverse sealant field 211 can be positioned to overlap fold line 81 at a location above center area 63. In some embodiments, the sealant fields 210 and 211 form a barrier coating, as described above, which can help inhibit undesirable wicking of oil/fat from the center area 63 at outer edges 4 and 7 of the folded bag 1 (FIG. 1).

The end seal 93 (not shown) can be formed from the alignment of various portions of sealant field 92, as described above (e.g., as described with reference to FIGS. 22, 26, 29, and 30). For example, various portions of sealant field 92 from face panel 20 can align with various portions of sealant field 92 from opposing face panel 21 to form end seal 93. The end seal 93 can form a top edge of the completed bag through which popcorn can be removed after popping. Various portions of sealant field 89 can align to form end seal 90, as described above (e.g., as described with reference to FIGS. 19-30). The end seal 90 can form a bottom edge of the bag.

In embodiments where one or more of the sealant fields are formed from a coating sealant, one or more aligned sealant fields can be joined to form seals (e.g., seals that join one or more portions of the bag to form seams, tack seals, and so forth) by the application of heat and/or pressure. It is contemplated that some sealant fields are configured to seal, while other sealant fields form a sealant barrier (e.g., the physical properties of the selected polymer forms a barrier). For example, one or more sealant fields can be sealed by selectively applying heat and/or pressure to the desired region, while heat/pressure is not applied where formation of a seal is not desired. Where heat/pressure is not applied, the sealant field functions as a barrier coating. In example embodiments, areas where heat/pressure can be applied include: aligned portions of sealant fields 84 and 85 to form longitudinal seal 42; aligned sealant fields 129 and 130, and aligned sealant fields 133 and 134 to form tack seals; aligned portions of sealant field 92 to form end seal 93; and/or aligned portions of sealant field 89 to form end seal 90. In some embodiments, various aligned portions of sealant field 210 and/or various aligned portions of sealant field 211 can also be heat and/or pressure sealed to form containment seals, as described above.

Figure 31:
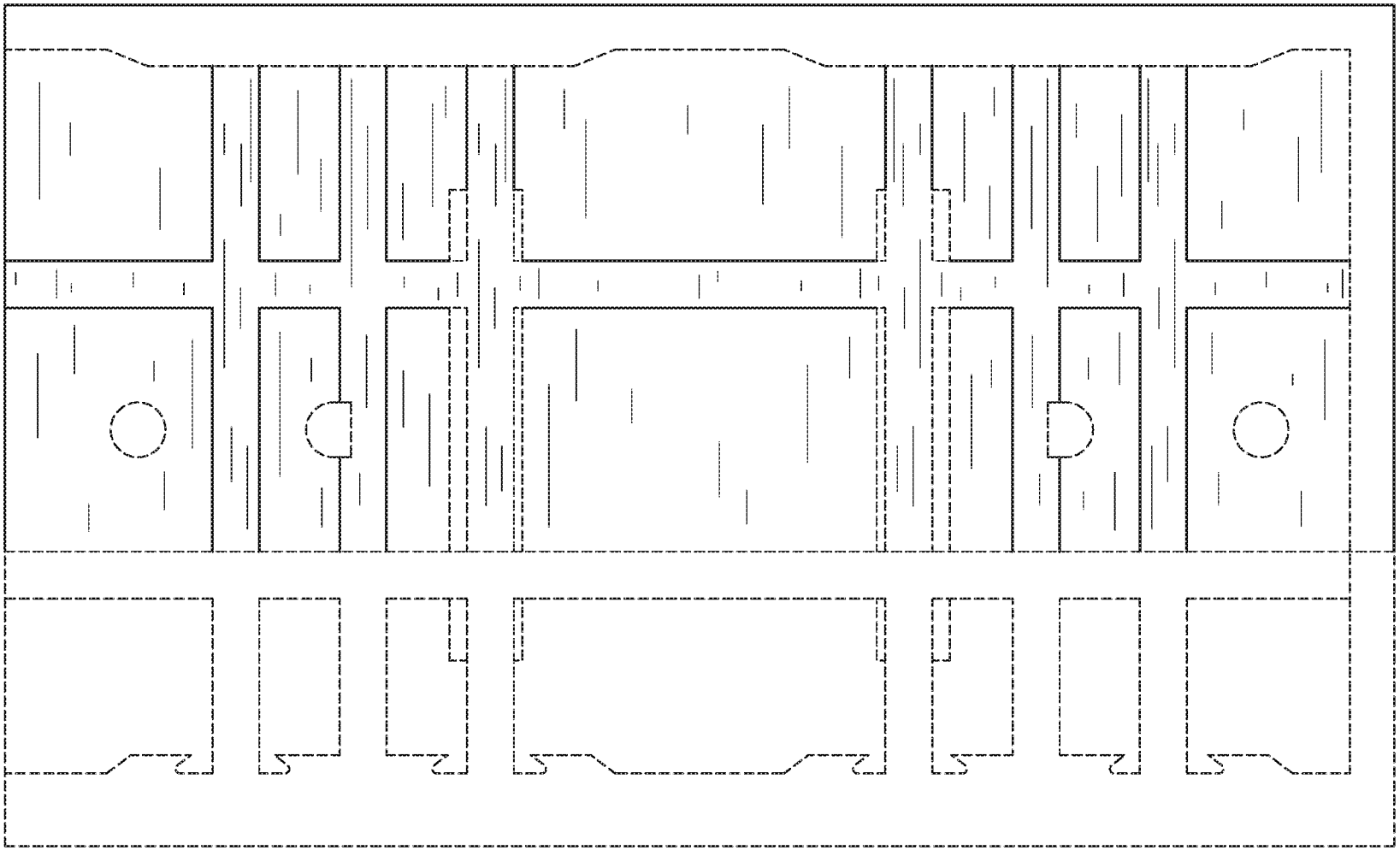
FIG. 31 is an enlarged top plan view of a sheet of flexible material from which a microwave popcorn bag, such as that shown in FIGS. 1 and 2, can be folded in accordance with embodiments of the present disclosure.
Figure 32:
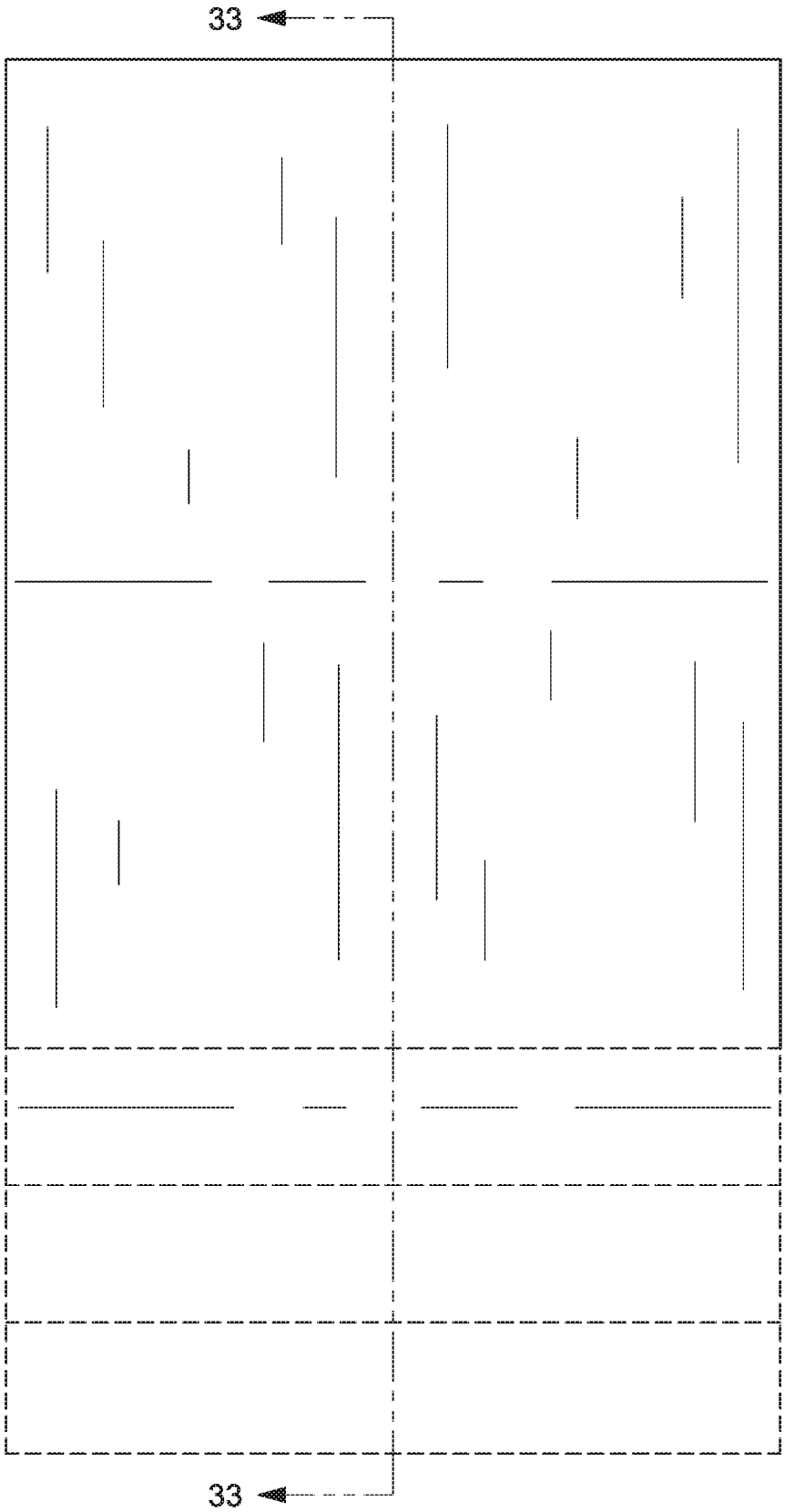
FIG. 32 is a front elevation view of a microwave popcorn bag folded from a sheet of flexible material, such as that shown in FIG. 31, in accordance with embodiments of the present disclosure.
Figure 33:
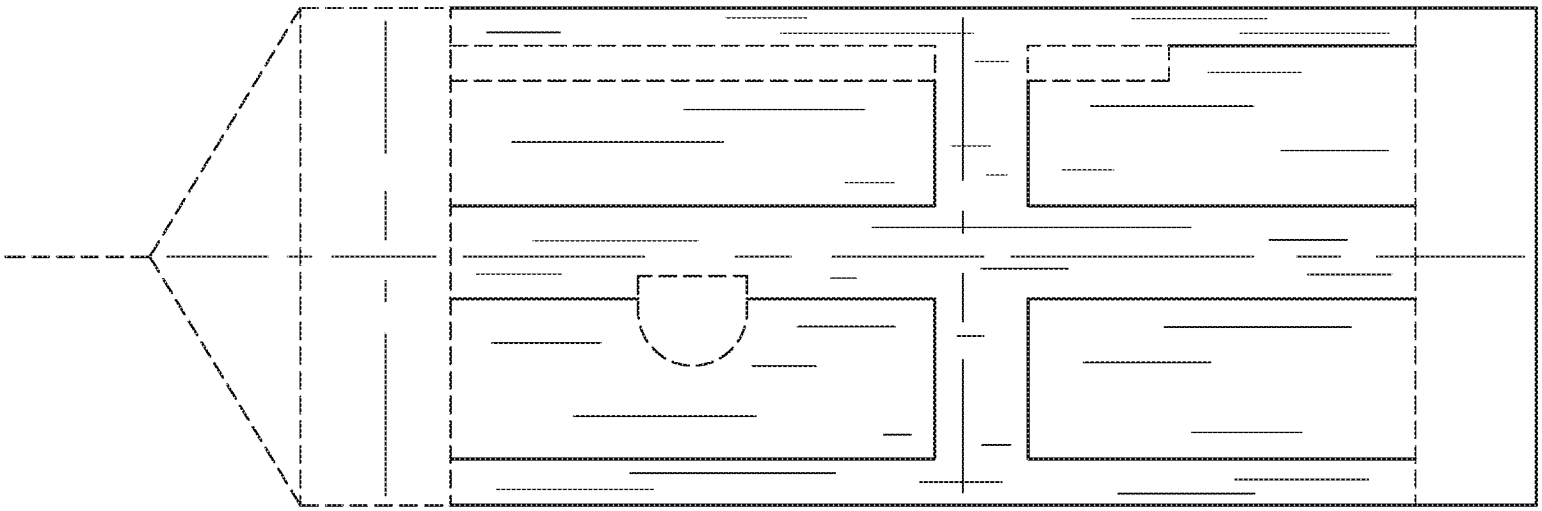
FIG. 33 is a cross-sectional right side elevation view of the microwave popcorn bag of FIG. 31, taken generally along line 33-33 of FIG. 32.
Figure 34:
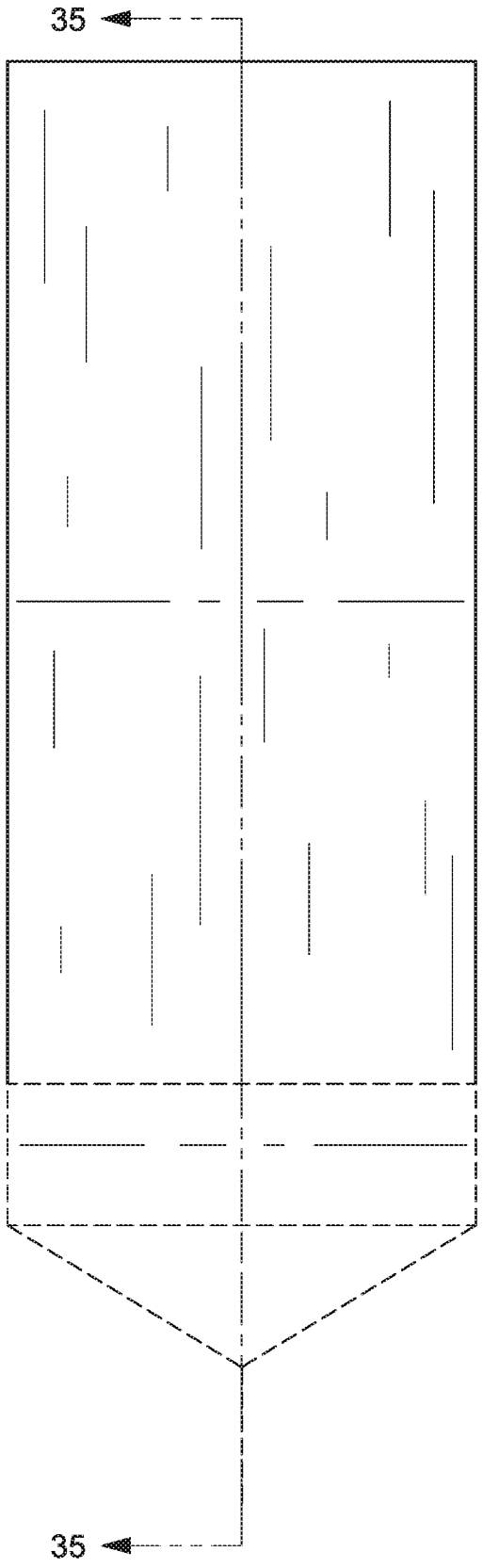
FIG. 34 is a right side elevation view of the microwave popcorn bag of FIG. 31.
Figure 35:
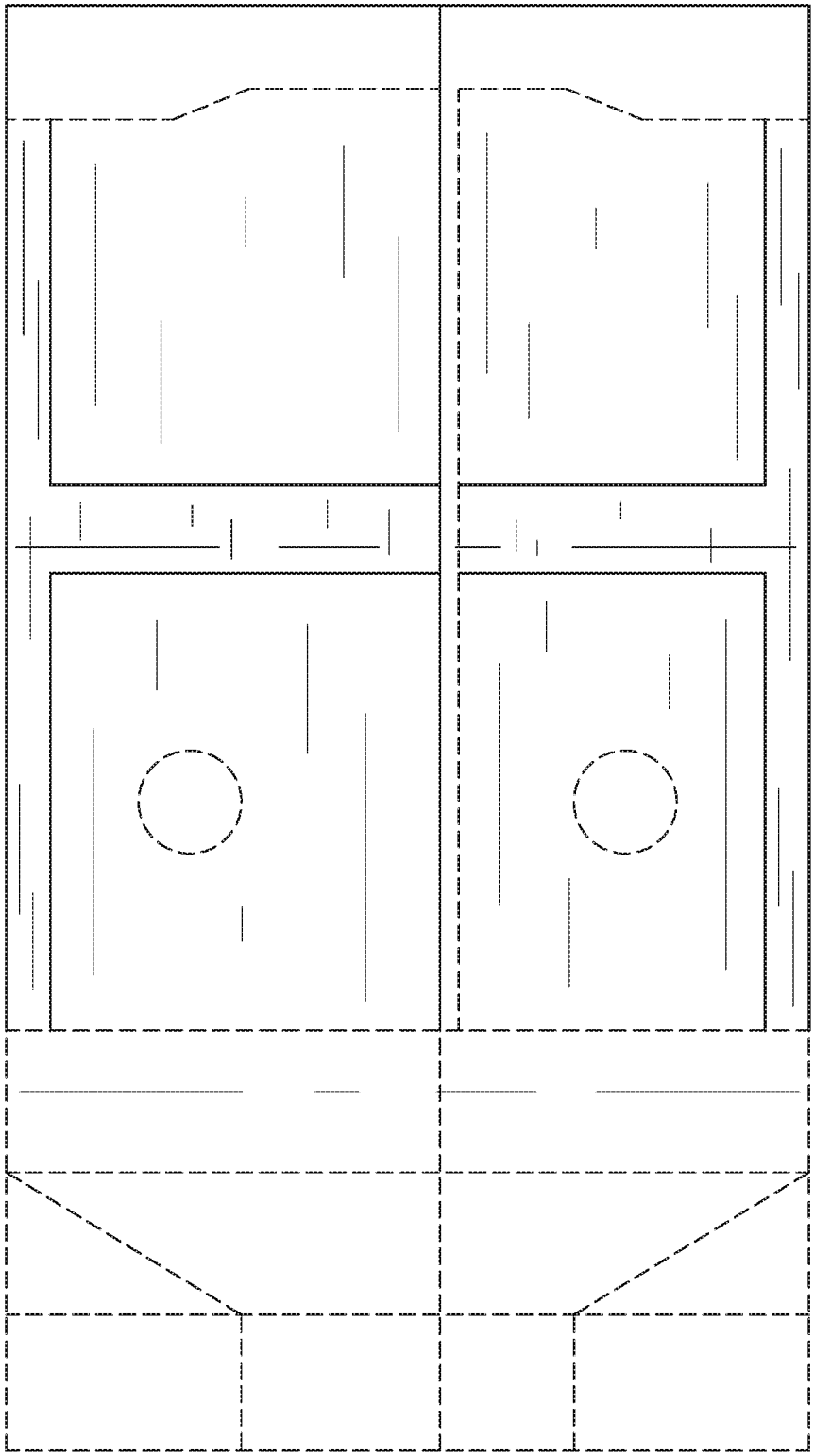
FIG. 35 is a cross-sectional front elevation view of the microwave popcorn bag of FIG. 31, taken generally along line 35-35 of FIG. 34.
Figure 36:
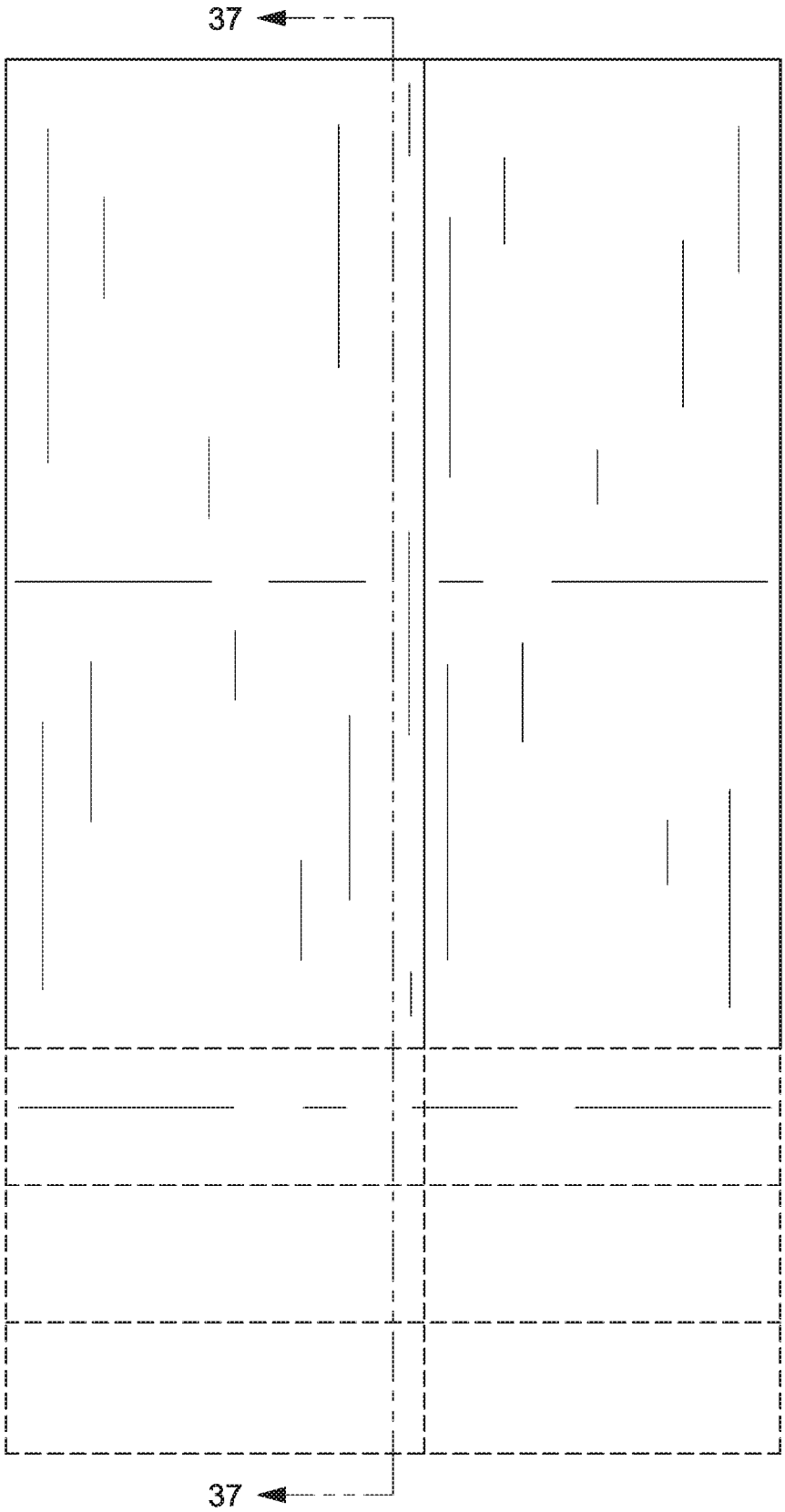
FIG. 36 is a back elevation view of the microwave popcorn bag of FIG. 31.
Figure 37:
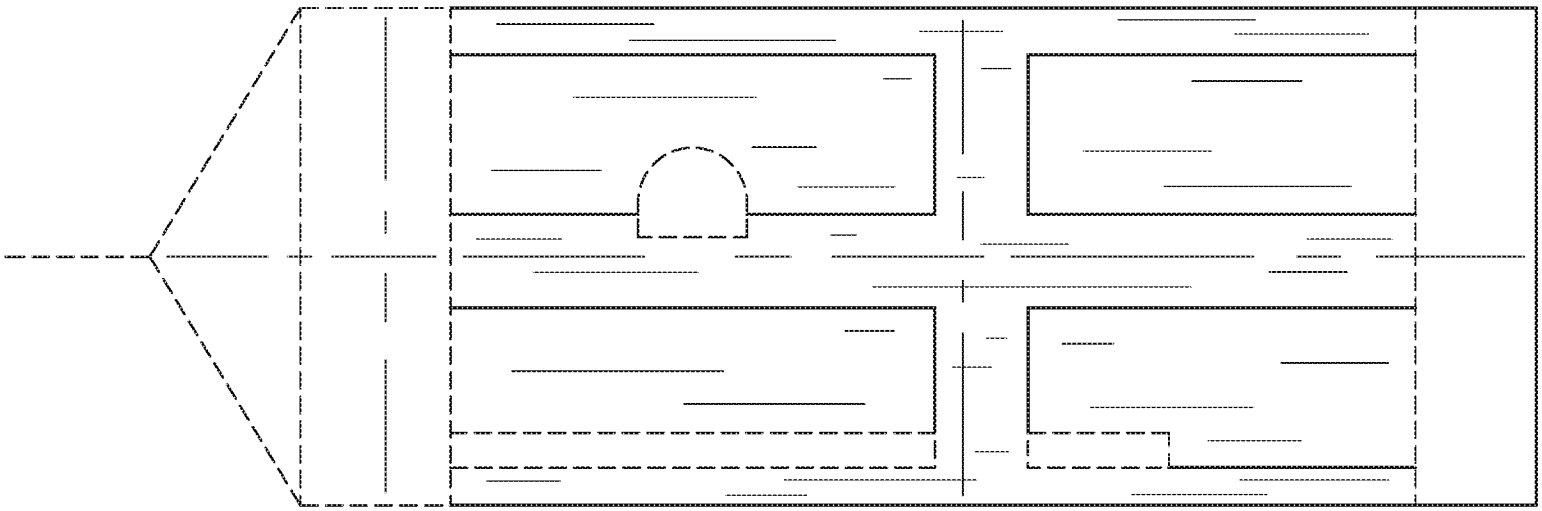
FIG. 37 is a cross-sectional left side elevation view of the microwave popcorn bag of FIG. 31, taken generally along line 37-37 of FIG. 36.
Figure 38:
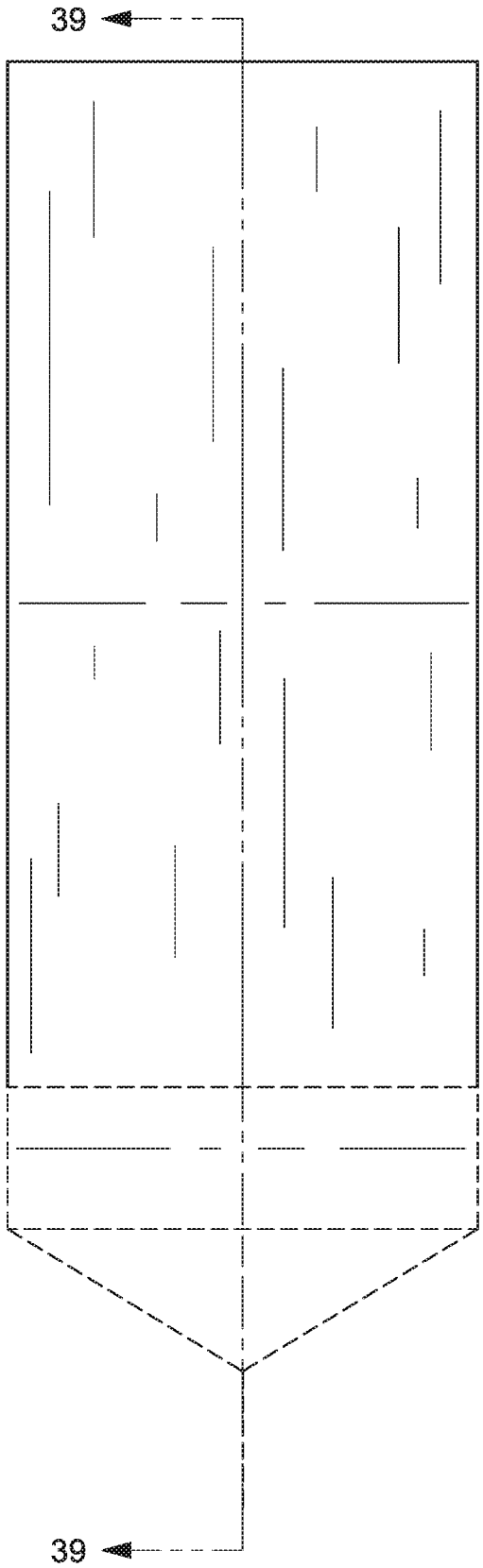
FIG. 38 is left side elevation view of the microwave popcorn bag of FIG. 31.
Figure 39:
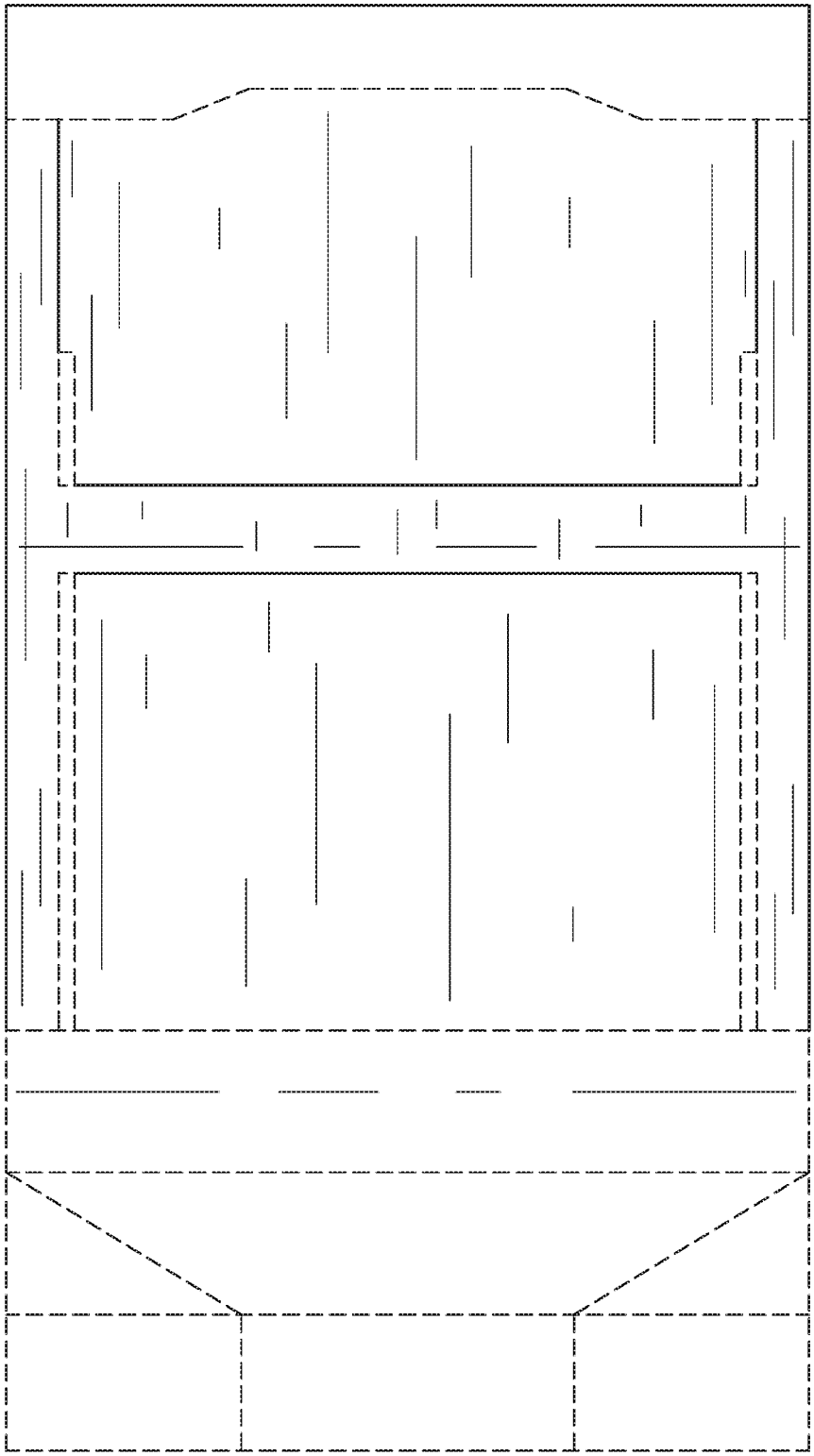
FIG. 39 is a cross-sectional back elevation view of the microwave popcorn bag of FIG. 31, taken generally along line 39-39 of FIG. 38.
Figure 40:
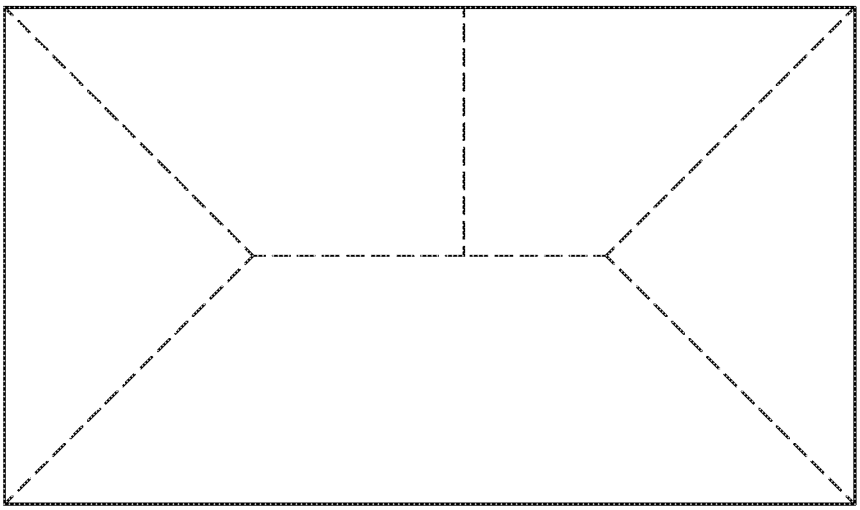
FIG. 40 is a top view of the microwave popcorn bag of FIG. 31.
Figure 41:
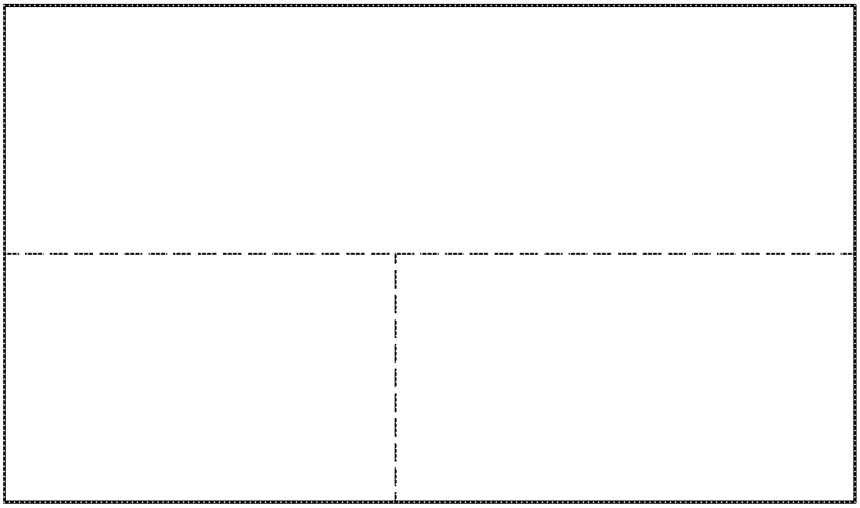
FIG. 41 is a bottom view of the microwave popcorn bag of FIG. 31.
Figure 42:
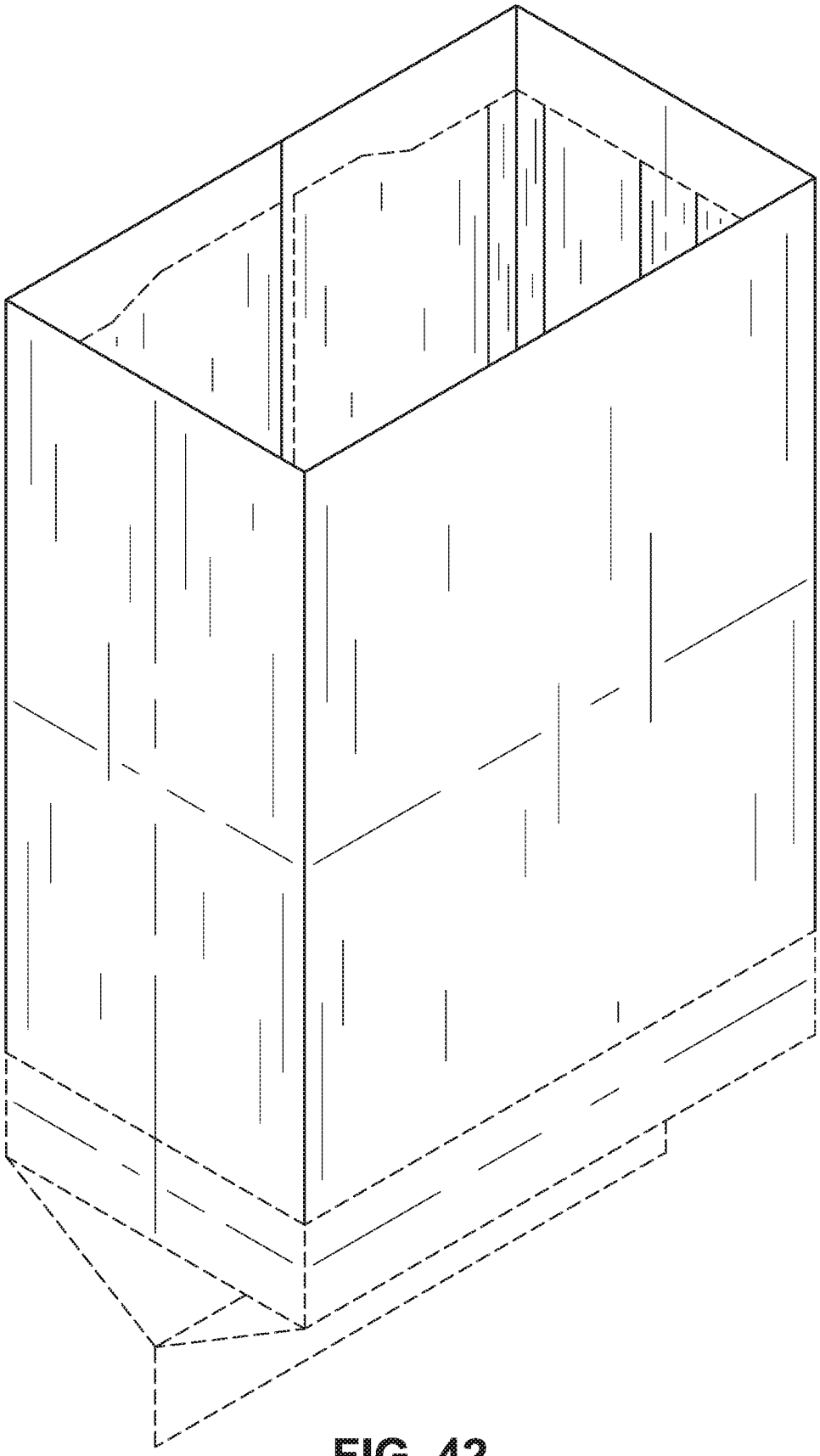
FIG. 42 is an isometric view of the microwave popcorn bag of FIG. 31.
Figure 43:
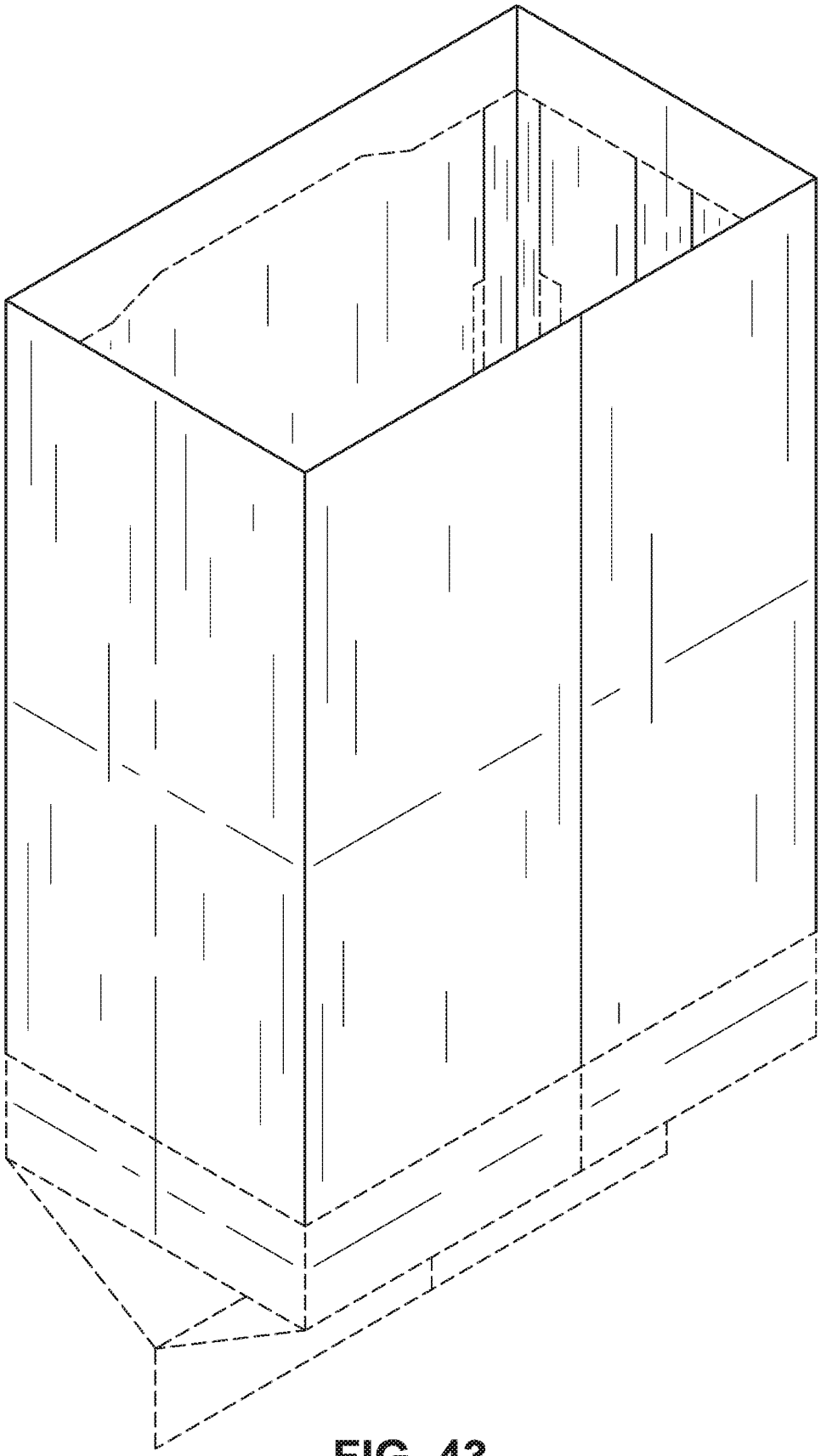
FIG. 43 is another isometric view of the microwave popcorn bag of FIG. 31.

Attention is now directed to FIG. 31, which depicts another example foldable blank from which the package according to FIGS. 1, 2 and 3 can be folded. FIGS. 32 through 43 further illustrate an example arrangement of fold lines and sealant fields of the blank on the expanded (e.g., popped) bag.

Figure 44:
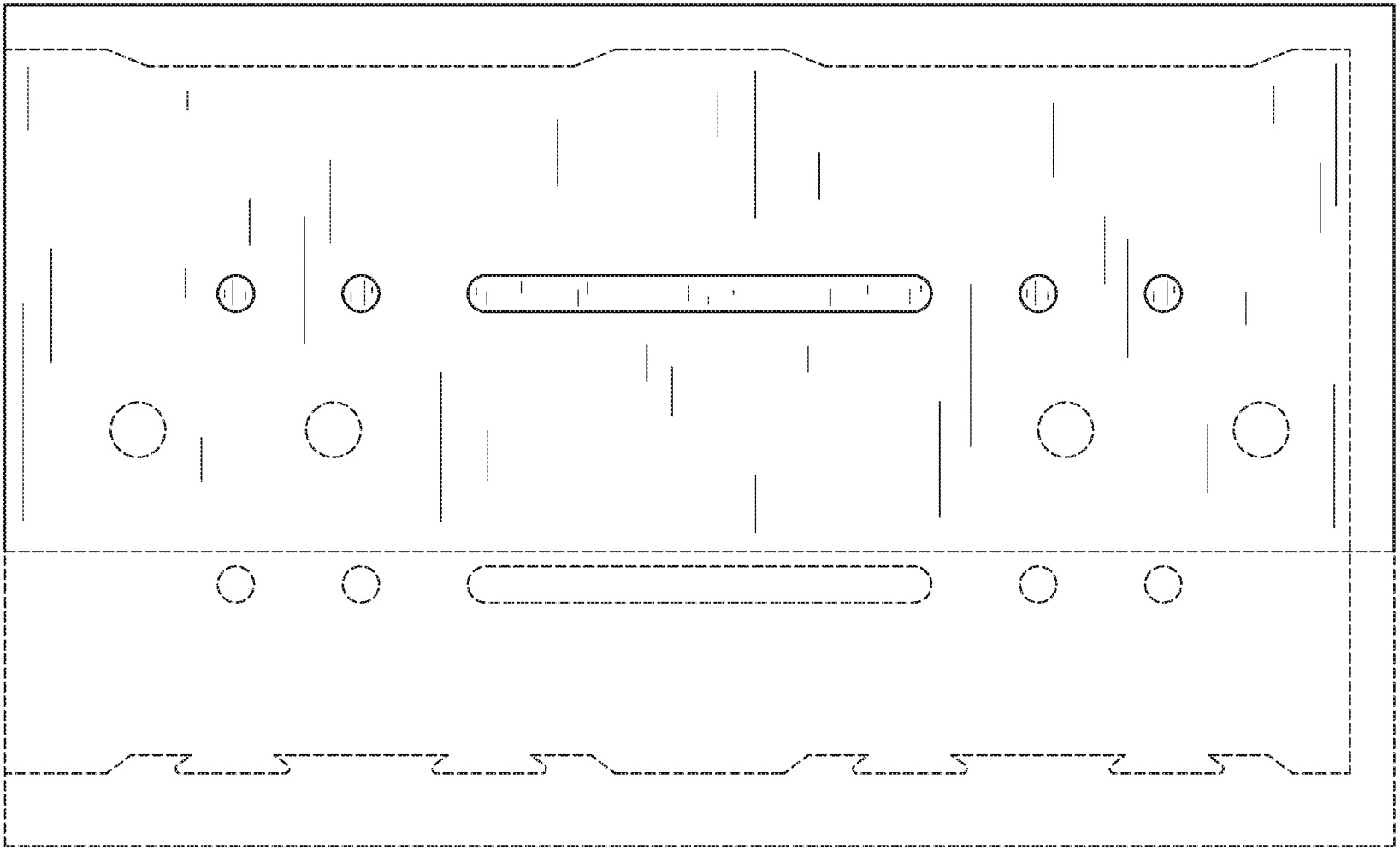
FIG. 44 is an enlarged top plan view of a sheet of flexible material from which a microwave popcorn bag, such as that shown in FIGS. 1 and 2, can be folded in accordance with embodiments of the present disclosure.
Figure 45:
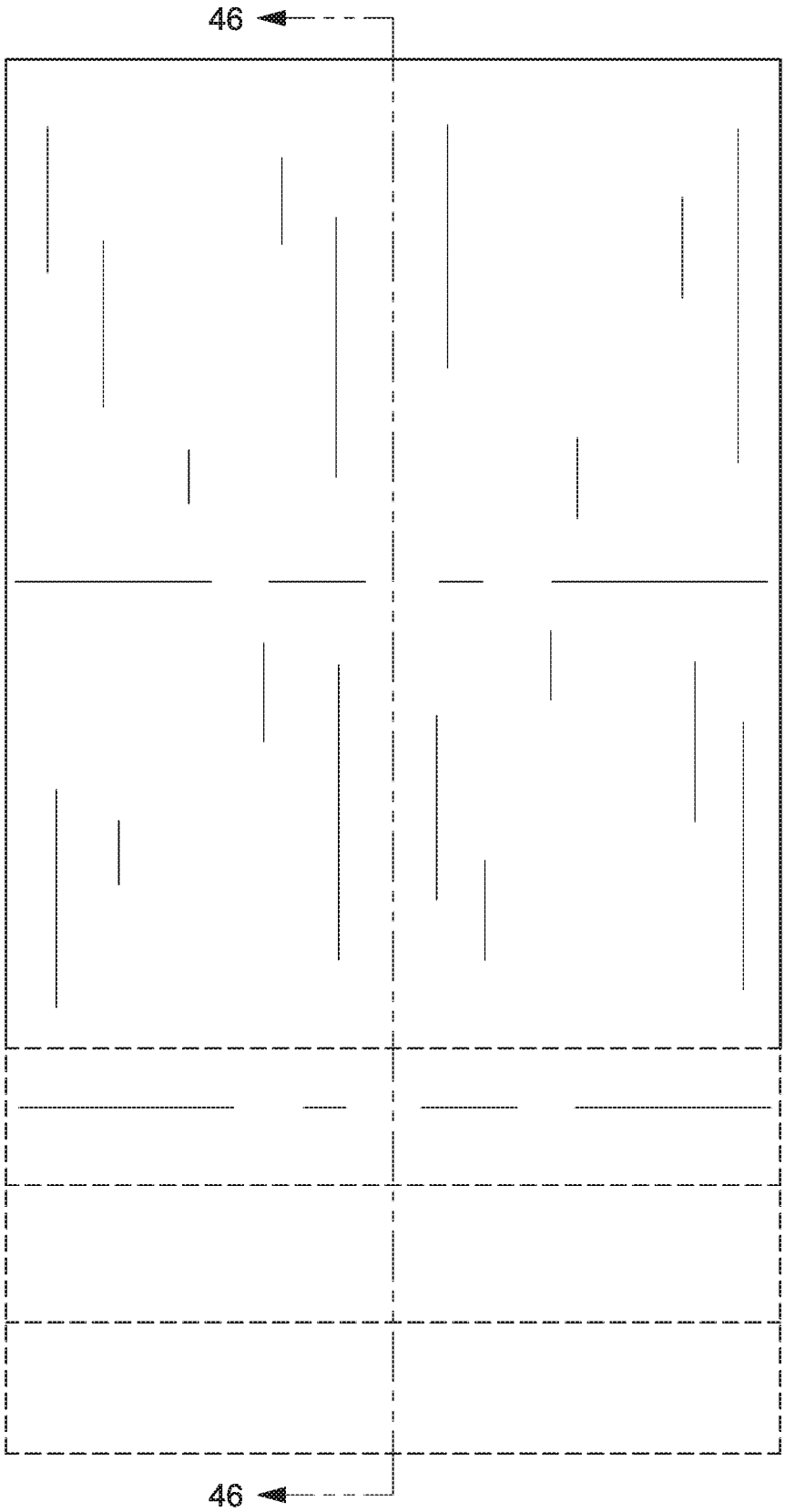
FIG. 45 is a front elevation view of a microwave popcorn bag folded from a sheet of flexible material, such as that shown in FIG. 44, in accordance with embodiments of the present disclosure.
Figure 46:
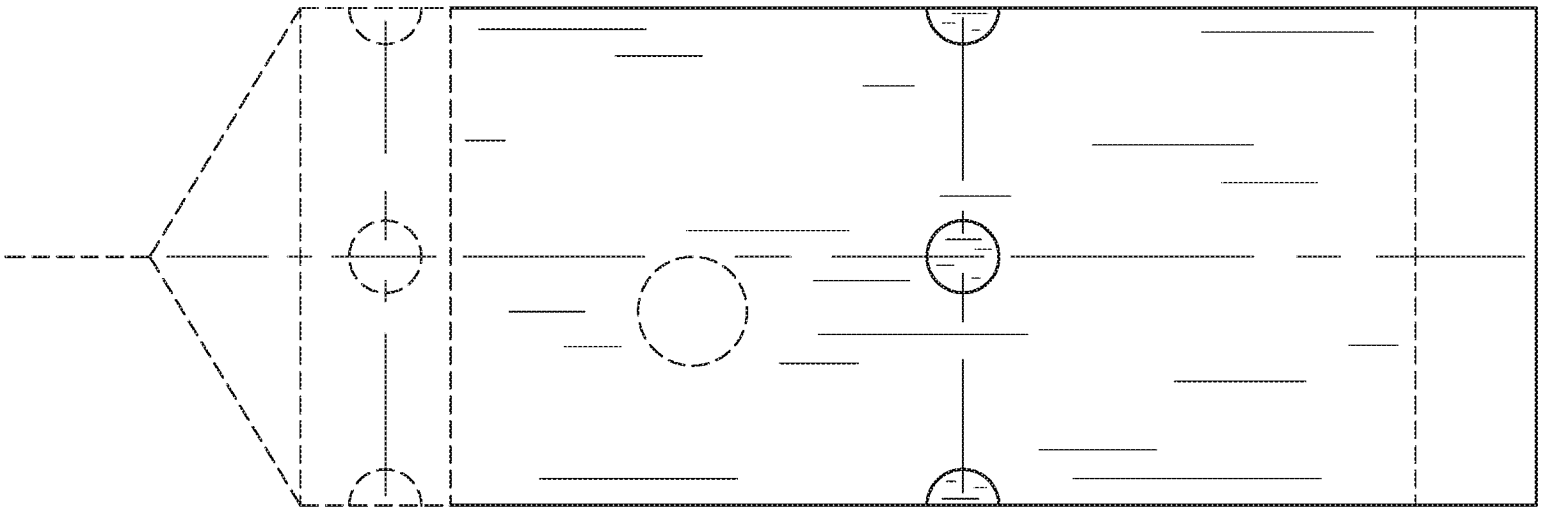
FIG. 46 is a cross-sectional right side elevation view of the microwave popcorn bag of FIG. 44, taken generally along line 46-46 of FIG. 45.
Figure 47:
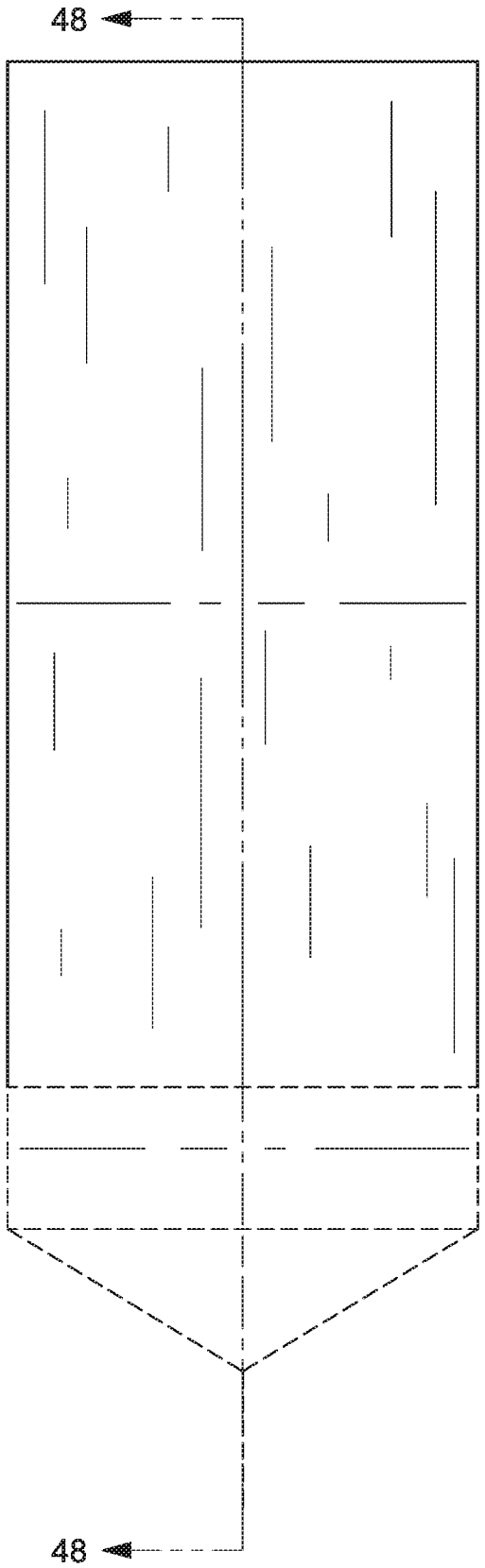
FIG. 47 is a right side elevation view of the microwave popcorn bag of FIG. 44.
Figure 48:
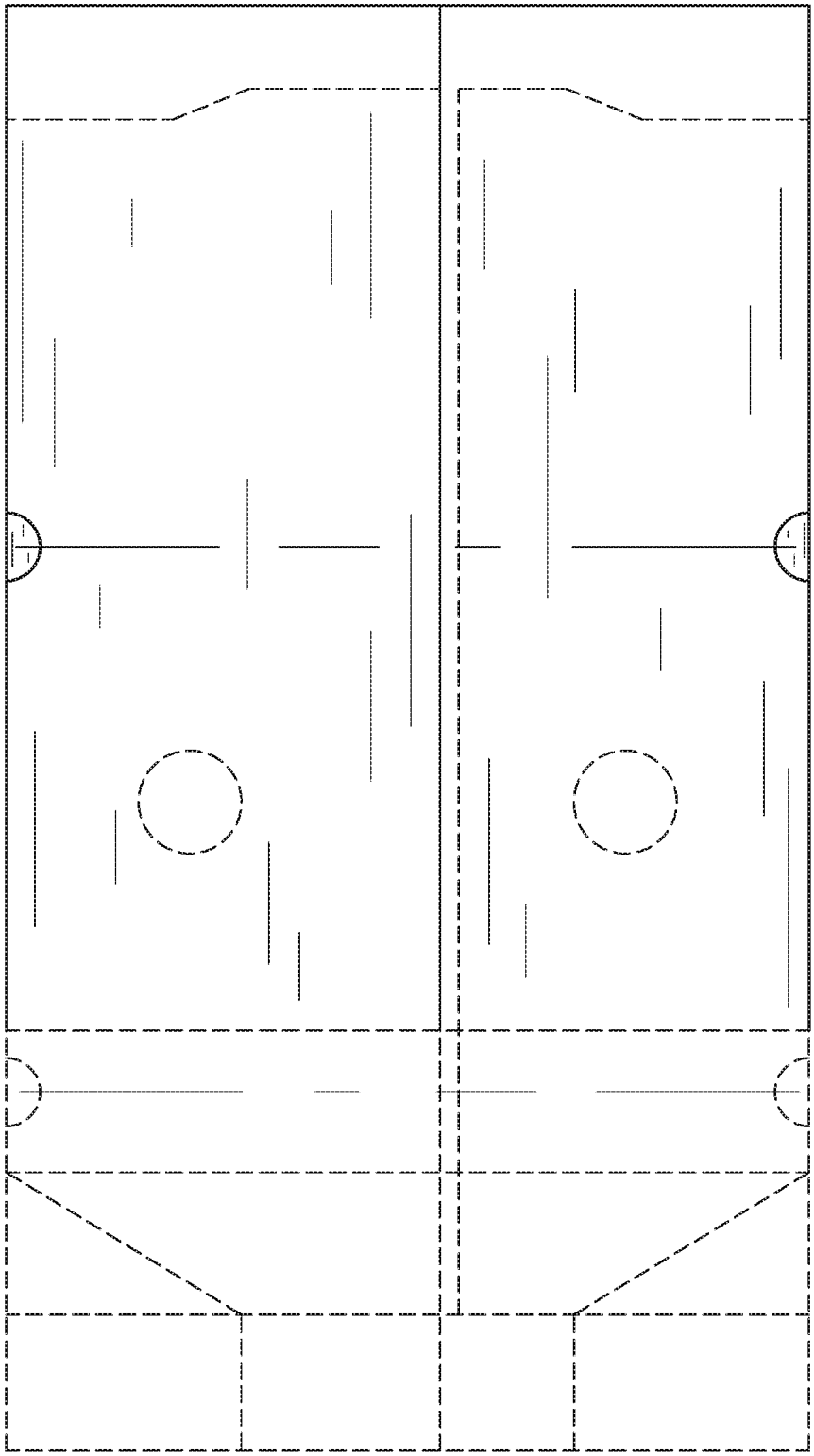
FIG. 48 is a cross-sectional front elevation view of the microwave popcorn bag of FIG. 44, taken generally along line 48-48 of FIG. 47.
Figure 49:
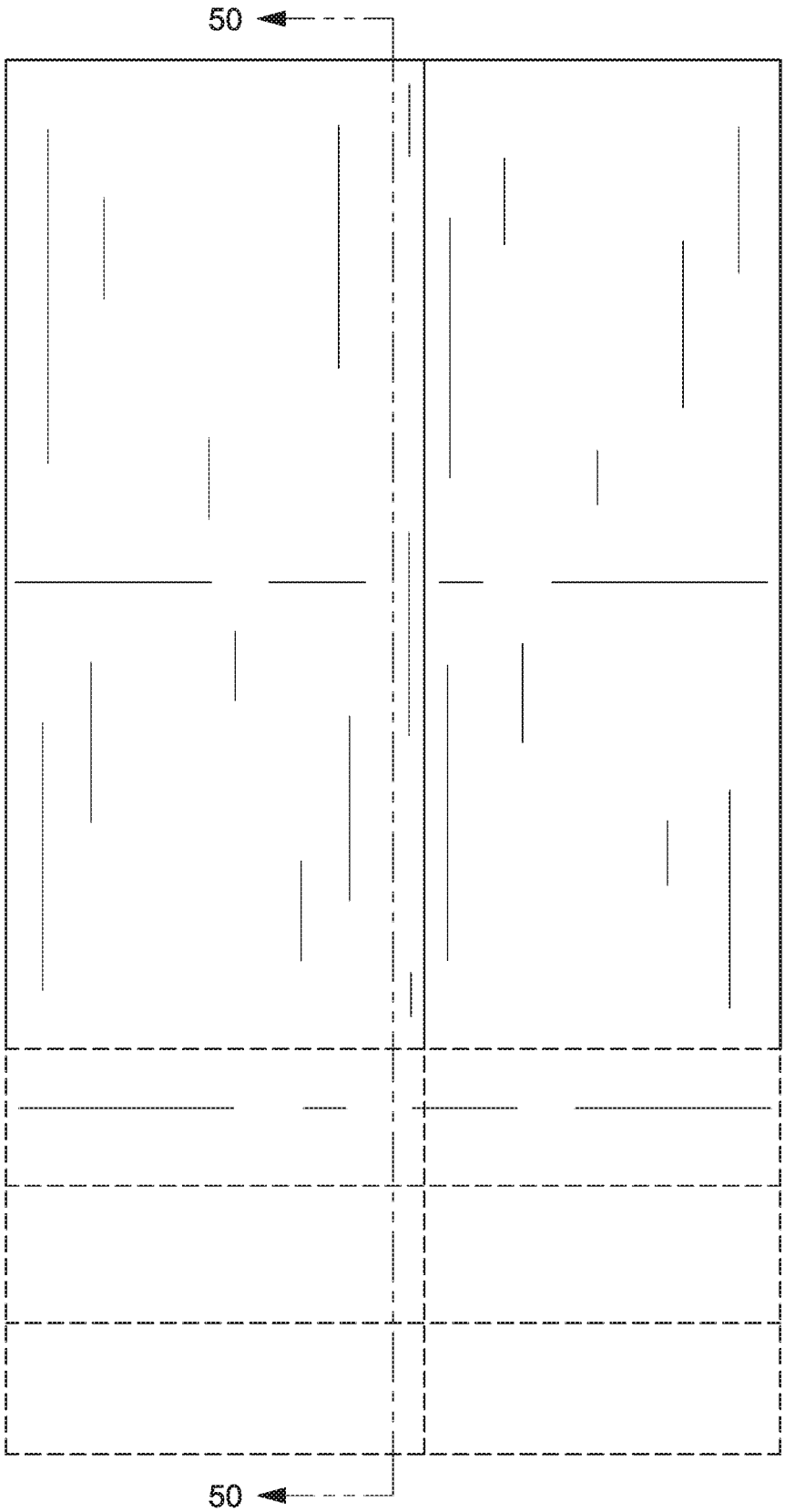
FIG. 49 is a back elevation view of the microwave popcorn bag of FIG. 44.
Figure 50:
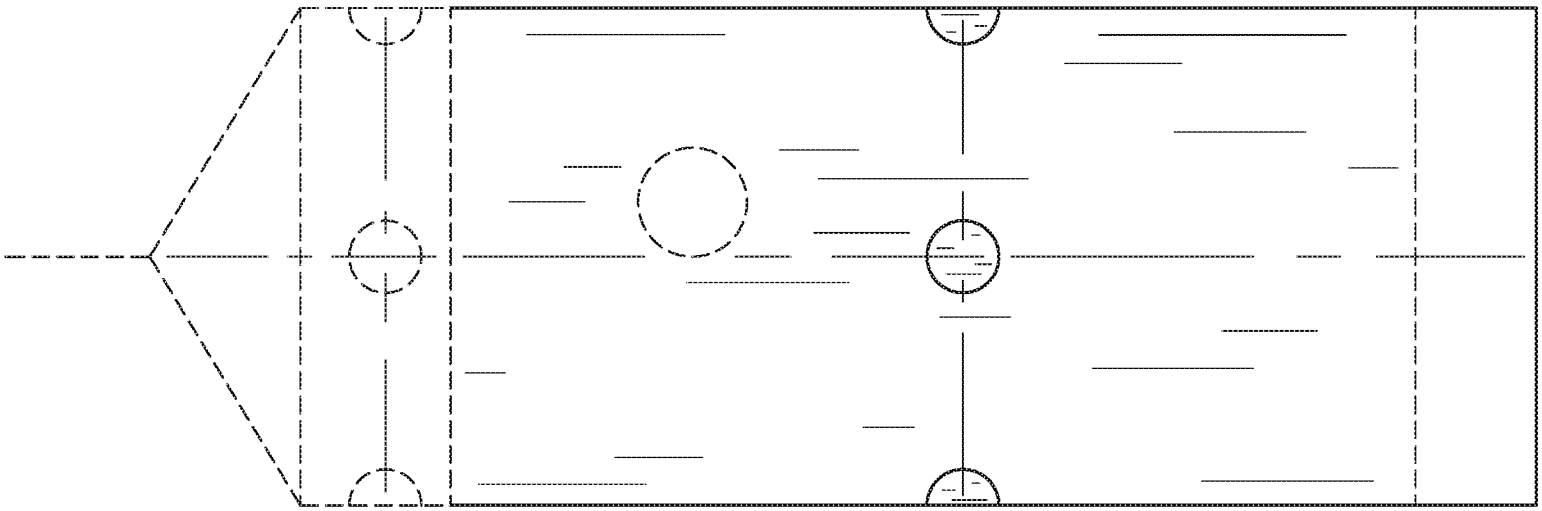
FIG. 50 is a cross-sectional left side elevation view of the microwave popcorn bag of FIG. 44, taken generally along line 50-50 of FIG. 49.
Figure 51:
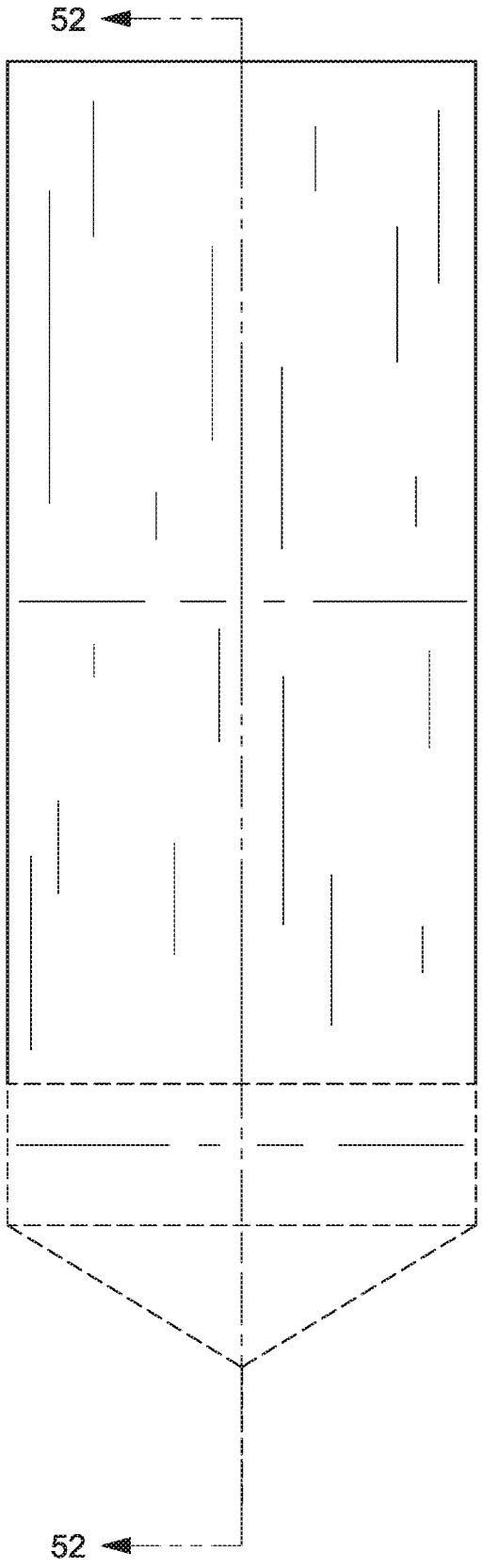
FIG. 51 is left side elevation view of the microwave popcorn bag of FIG. 44.
Figure 52:
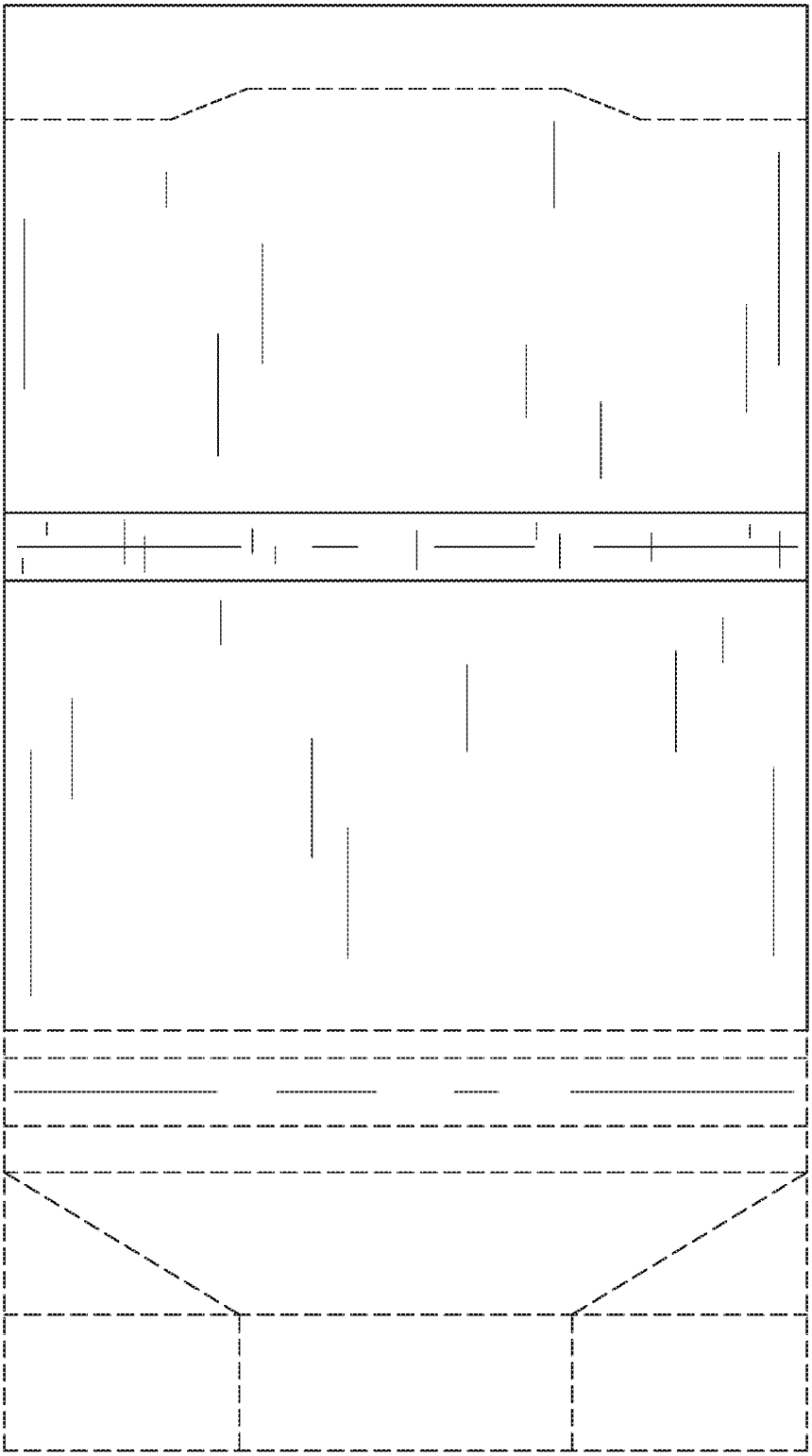
FIG. 52 is a cross-sectional back elevation view of the microwave popcorn bag of FIG. 44, taken generally along line 52-52 of FIG. 44.
Figure 53:
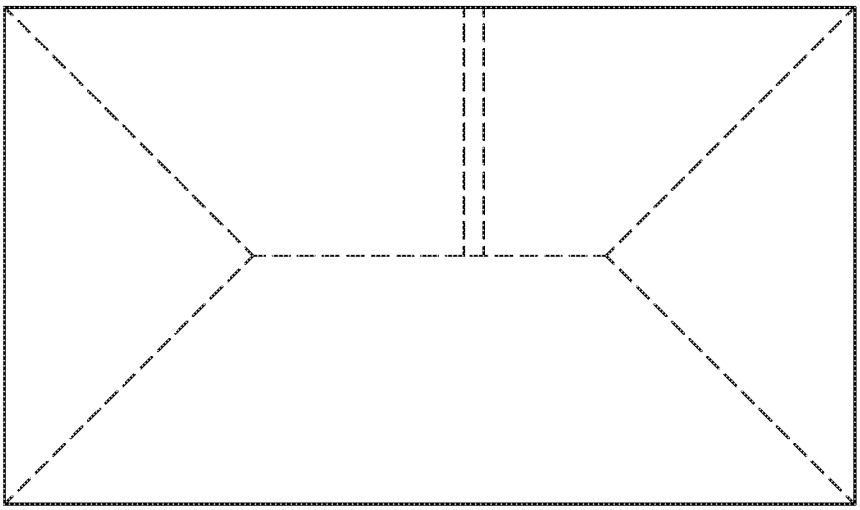
FIG. 53 is a top view of the microwave popcorn bag of FIG. 44.
Figure 54:
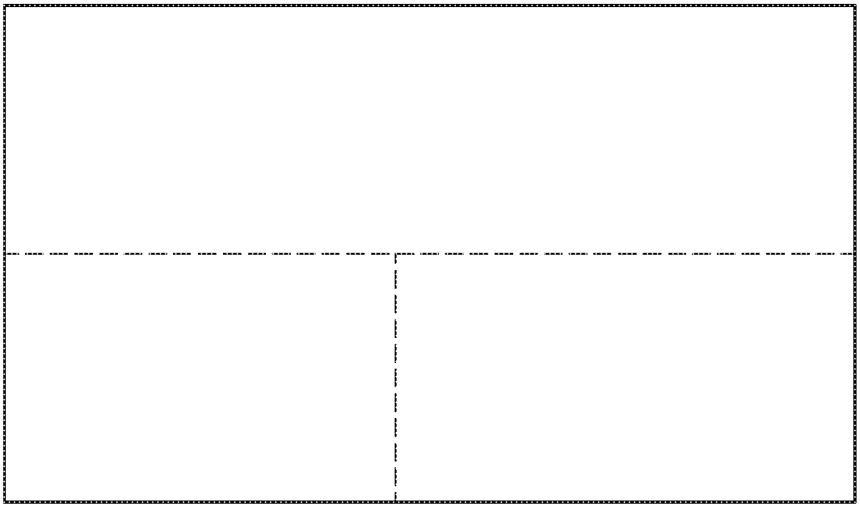
FIG. 54 is a bottom view of the microwave popcorn bag of FIG. 44.
Figure 55:
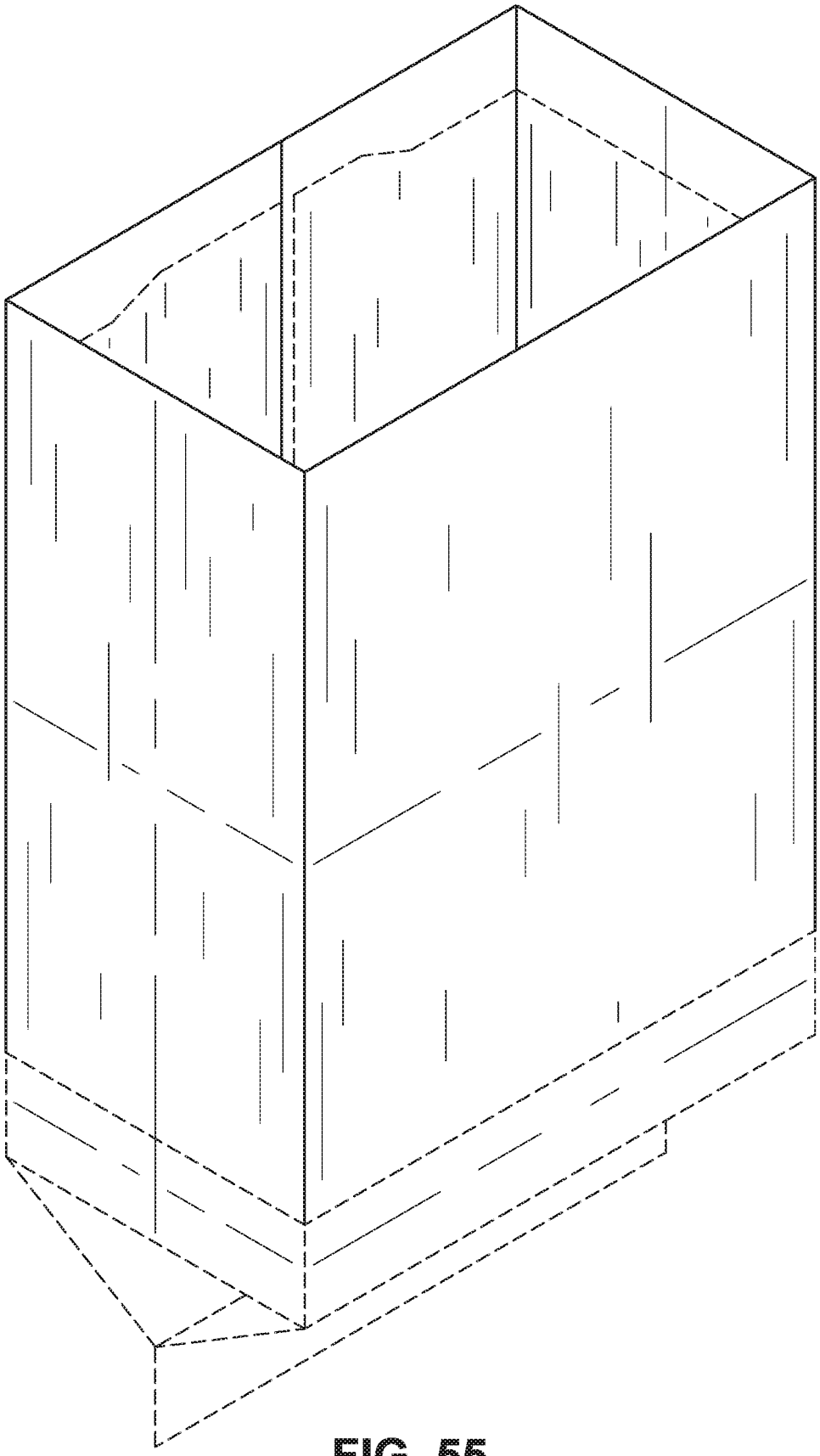
FIG. 55 is an isometric view of the microwave popcorn bag of FIG. 44.
Figure 56:
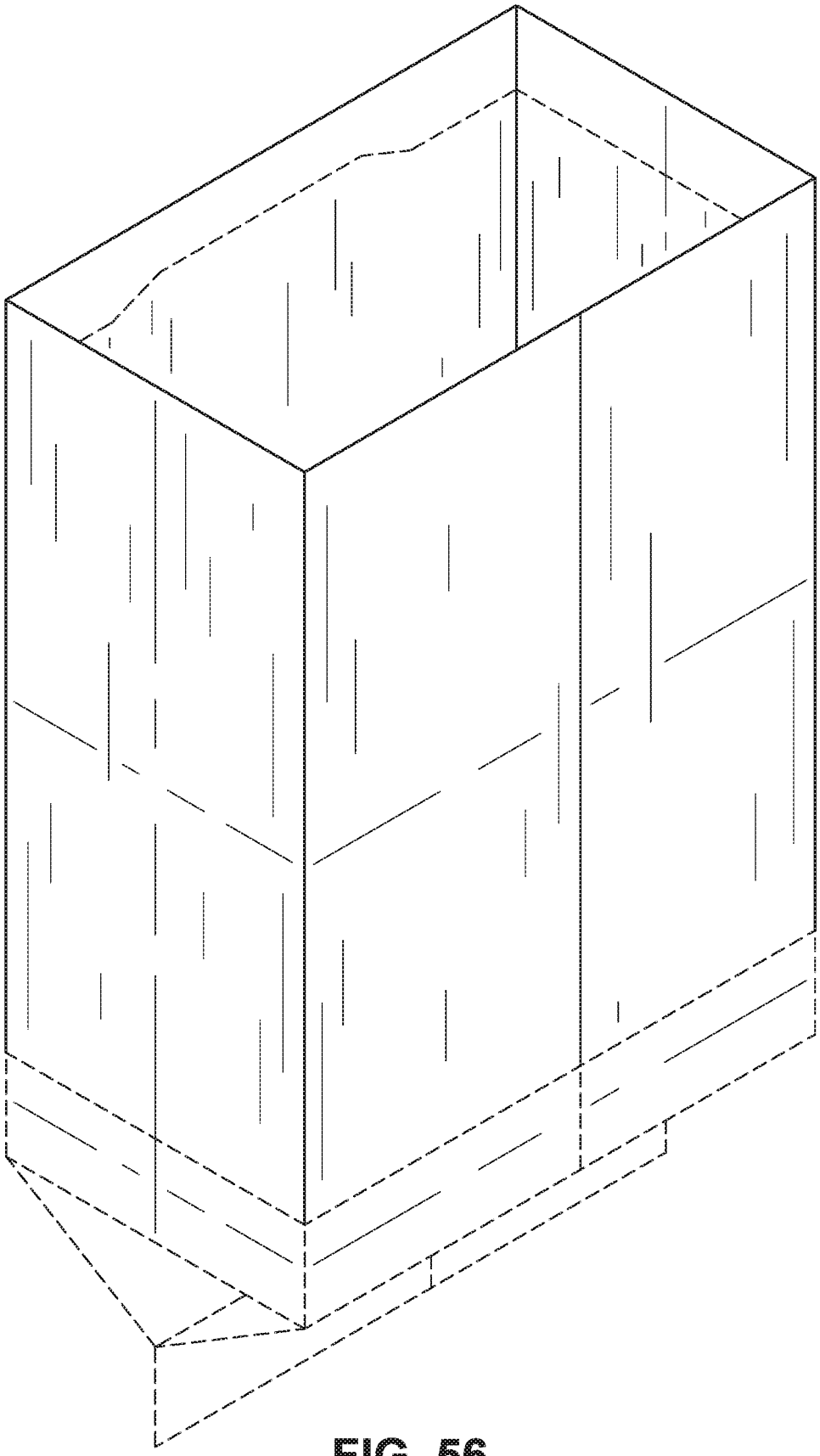
FIG. 56 is another isometric view of the microwave popcorn bag of FIG. 44.

FIG. 44 depicts yet another example foldable blank from which the package according to FIGS. 1, 2 and 3 can be folded. FIGS. 45 through 56 further illustrate an example arrangement of fold lines and sealant fields of the blank on the expanded (e.g., popped) bag.

Although the subject matter has been described in language specific to structural features and/or process operations, it is to be understood that the subject matter defined in the appended claims is not necessarily limited to the specific features or acts described above. Rather, the specific features and acts described above are disclosed as example forms of implementing the claims.

What is claimed is:

1. A wick resistant microwavable popcorn arrangement formed substantially entirely of non-fluorocarbon material, the wick resistant microwavable popcorn arrangement comprising:

a folded bag formed from folding a planar sheet to fold the planar sheet from a planar sheet form to a folded form, the folded bag defining a bag interior and including first and second opposite face panels joined by first and second opposite, inwardly directed, side gussets defined by gusset folds, the folded bag defining a portion of the bag interior with side creases defined at junctures between the first face panel and the first and second opposite side gussets;

a first plurality of sealant fields comprising a first sealant material, respective sealant fields of the first plurality of sealant fields comprising the first sealant material overlapping each of the side creases and the gusset folds, wherein the respective sealant fields of the first plurality of sealant fields that overlap the gusset folds extend longitudinally and continuously between end seals on opposing ends of the folded bag;

a second plurality of sealant fields comprising a second sealant material, respective sealant fields of the second plurality of sealant fields comprising the second sealant material overlapping a portion of the respective sealant fields of the first plurality of sealant fields comprising the first sealant material when the folded bag is in the planar sheet form and when the first sealant material is arranged at the side creases of the folded bag in the folded form, wherein the first sealant material is a different type than the second sealant material;

a popcorn charge including unpopped popcorn kernels and at least one of an oil component or a fat component positioned within the bag interior between the first and second opposite, inwardly directed, side gussets, the first plurality of sealant fields comprising the first sealant material and the respective sealant fields of the second plurality of sealant fields configured to retain at least one of the unpopped popcorn kernels or at least one of the oil component or the fat component within the bag interior.

2. The wick resistant microwavable popcorn arrangement as recited in claim 1, wherein the first sealant material comprises a coating sealant configured to form a liquid barrier along each of the side creases and the gusset folds.

3. The wick resistant microwavable popcorn arrangement as recited in claim 2, wherein the coating sealant comprises at least one of a vinyl acetate polymer, a vinyl-acetate acrylic polymer, an acrylic polymer, a styrene-acrylic polymer, or a polyolefin polymer.

4. The wick resistant microwavable popcorn arrangement as recited in claim 3, wherein the second sealant material comprises an adhesive sealant.

5. The wick resistant microwavable popcorn arrangement as recited in claim 4, wherein the adhesive sealant comprises at least one of a polyvinyl acetate adhesive or an ethylene vinyl acetate-polyvinyl alcohol adhesive.

6. The wick resistant microwavable popcorn arrangement as recited in claim 1, wherein a thickness of the first plurality of sealant fields comprising the first sealant material is in the range of about 2 g/m2 to about 20 g/m2.

7. The wick resistant microwavable popcorn arrangement as recited in claim 1, wherein the respective sealant fields of the first plurality of sealant fields that overlap the side creases also extend longitudinally and continuously between end seals on opposing ends of the folded bag.

8. A wick resistant microwavable popcorn arrangement formed substantially entirely of non-fluorocarbon material, the wick resistant microwavable popcorn arrangement comprising:

a folded bag formed from folding a planar sheet to fold the planar sheet from a planar sheet form to a folded form, the folded bag defining a bag interior and including first and second opposite face panels joined by first and second opposite, inwardly directed, side gussets defined by gusset folds, the folded bag defining a portion of the bag interior with side creases defined at junctures between the first face panel and the first and second opposite side gussets;

a first plurality of sealant fields comprising a coating sealant material, respective sealant fields of the first plurality of sealant fields comprising the coating sealant material overlapping each of the side creases and the gusset folds, wherein the respective sealant fields of the first plurality of sealant fields that overlap the gusset folds extend longitudinally and continuously between end seals on opposing ends of the folded bag;

a second plurality of sealant fields comprising an adhesive sealant material, respective sealant fields of the second plurality of sealant fields comprising the adhesive sealant material overlapping a portion of the respective sealant fields of the first plurality of sealant fields comprising the coating sealant material when the folded bag is in the planar sheet form and when the coating sealant material is arranged at the side creases of the folded bag in the folded form, wherein the coating sealant material is a different sealant type than the adhesive sealant material;

a popcorn charge including unpopped popcorn kernels and at least one of an oil component or a fat component positioned within the bag interior between the first and second opposite, inwardly directed, side gussets, the first plurality of sealant fields comprising the coating sealant material and the respective sealant fields of the second plurality of sealant fields configured to retain at least one of the unpopped popcorn kernels or at least one of the oil component or the fat component within the bag interior.

9. The wick resistant microwavable popcorn arrangement as recited in claim 8, wherein the coating sealant material includes one or more of a vinyl acetate polymer, a styrene-acrylic polymer, a vinyl acetate-acrylic copolymer, an acrylic polymer, or a polyolefin polymer.

10. The wick resistant microwavable popcorn arrangement as recited in claim 9, wherein the adhesive sealant material includes one or more of a polyvinyl acetate adhesive or an ethylene vinyl acetate-polyvinyl alcohol adhesive.

11. The wick resistant microwavable popcorn arrangement as recited in claim 8, wherein the respective sealant fields of the first plurality of sealant fields that overlap the side creases also extend longitudinally and continuously between end seals on opposing ends of the folded bag.

* * * * *